United States Patent [19]

Ohki et al.

[11] Patent Number: 4,978,606

[45] Date of Patent: Dec. 18, 1990

[54] COLOR PHOTOGRAPHIC MATERIAL WITH WATER INSOLUBLE AMIDO BOND POLYMER

[75] Inventors: Nobutaka Ohki; Keiji Mihayashi; Shigeru Nakamura; Hiroshi Fukuzawa, all of Kanagawa, Japan

[73] Assignee: Fuji Photo Film Co., Ltd., Kanagawa, Japan

[21] Appl. No.: 283,097

[22] Filed: Dec. 12, 1988

[51] Int. Cl.[5] ..... G03C 5/54; G03C 1/42; G03C 7/26

[52] U.S. Cl. ..... 430/505; 430/214; 430/215; 430/218; 430/545; 430/551; 430/566; 430/627; 430/628

[58] Field of Search ..... 430/214, 215, 545, 551, 430/627, 628, 566, 505, 218

[56] References Cited

U.S. PATENT DOCUMENTS

| | | | |
|---|---|---|---|
| 4,293,641 | 10/1981 | Takahashi et al. | 430/502 |
| 4,366,236 | 12/1982 | Takahashi | 430/505 |
| 4,717,651 | 1/1988 | Ohki et al. | 430/551 |
| 4,732,845 | 3/1988 | Keiji et al. | 430/551 |
| 4,840,885 | 6/1989 | Peters et al. | 430/545 |

*Primary Examiner*—Richard L. Schilling
*Attorney, Agent, or Firm*—Sughrue, Mion, Zinn, Macpeak & Seas

[57] ABSTRACT

A silver halide color photographic material comprising a support having thereon at least one light-sensitive silver halide emulsion layer, at least one layer of the material containing the combination of a water-insoluble homopolymer or copolymer which has an amido bond in the repeating unit and at least one compound represented by formula (I):

(I)

wherein X represents an alkyl group, an alkoxy group, an aryloxy group, an alkylthio group, an arylthio group, an amido group or a sulfonamido group; $R^1$ and $R^2$, which may be the same or different, each represents an alkyl group, an alkoxy group, an aryloxy group, an alkylthio group, an arylthio group, an amido group, a sulfonamido group, hydrogen, a halogen atom, a sulfo group, a carboxyl group, a carbamoyl group, a sulfamoyl group, an acyl group or a sulfonyl group, provided that $R^1$ and $R^2$ may be linked to form a carbocyclic ring; and Y represents a hydroxyl group or a sulfonamido group.

16 Claims, 1 Drawing Sheet

FIG. 1-(a)
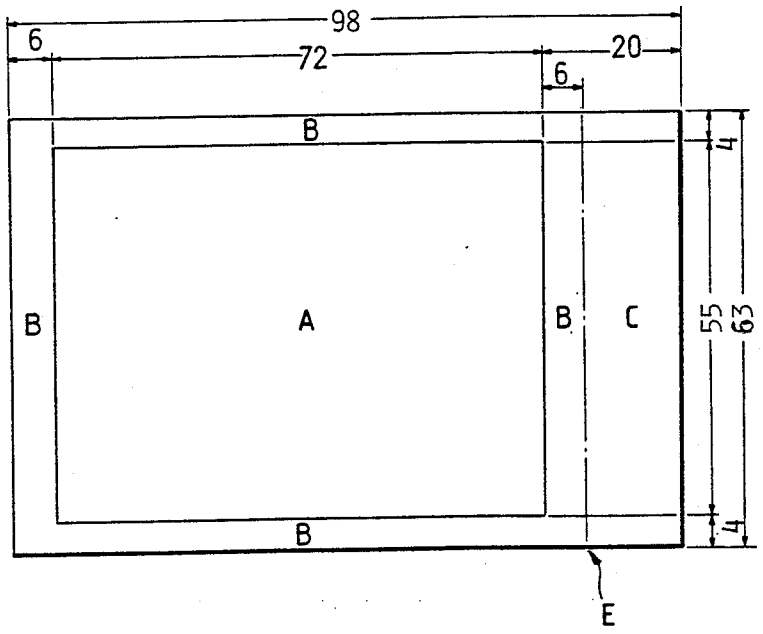
FIG. 1-(b)
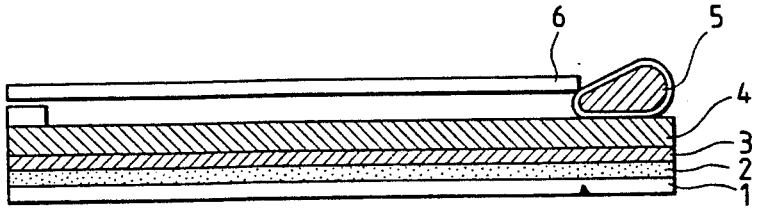

COLOR PHOTOGRAPHIC MATERIAL WITH WATER INSOLUBLE AMIDO BOND POLYMER

FIELD OF THE INVENTION

This invention concerns color photographic materials and, more precisely, the invention concerns color photographic materials of high picture quality which have improved storage properties.

BACKGROUND OF THE INVENTION

The occurrence of color turbidity (color mixing) where the oxidized form of a color developing agent produced during development migrates into an adjacent colored image forming layer and forms the wrong dye is well known in multi-layer color photographic materials of the type which contain color forming couplers in the silver halide photographic emulsion layers and which are developed using a color developing agent such as p-phenylenediamine. Methods in which various hydroquinones are used have been suggested in the past as a means of preventing the occurrence of color turbidity. For example, the use of mono-linear chain alkylhydroquinones has been disclosed in U.S. Pat. No. 2,728,659 and in JP-A-No. 49-106329 etc. (the term "JP-A" as used herein signifies an unexamined published Japanese patent application), and the use of mono-branched alkylhydroquinones has been disclosed in U.S. Pat. No. 3,700,453, West German Patent Application (OLS) No. 2,149,789, and JP-A-No. 50-156438 and JP-A-No. 49-106329. The use of di-linear chain alkyl-hydroquinones has been disclosed in U.S. Pat. Nos. 2,728,659, and 2,732,300, in British Patents Nos. 752,146 and 1,086,208, and in *Chemical Abstract,* Volume 58, abstract number 6367h and the use of di-branched alkyl-hydroquinones has been disclosed in U.S. Pat. Nos. 3,700,453 and 2,732,300, in British Patent No. 1,086,208, in the aforementioned *Chemical Abstracts,* in JP-A-No. 50-156438, and in JP-B-No. 50-21249 and JP-B-No. 51-40818, (the term "JP-B" as used herein signifies an examined Japanese patent publication).

Other cases of the use of alkylhydroquinones as anticolor turbidity agents have been disclosed in British Patents Nos. 558,258, 557,750 (corresponding to U.S. Pat. Nos. 2,360,290), 557,802 and 731,301 (corresponding to U.S. Pat. No. 2,701,197), in U.S. Pat. Nos. 2,336,327, 2,403,721 and 3,582,333, in West German Patent Application (OLS) No. 2,505,016 (corresponding to JP-A-No. 50-110337), and in JP-B-No. 56-40816.

Also, the use of sulfonamidophenols as anticolor turbidity agents have been disclosed in JP-A-Nos. 59-5247 and 59-202465.

Color turbidity similar to that which occurs in ordinary color photographic materials is also known to occur in color diffusion transfer photographic materials, and the above mentioned hydroquinones have been used in order to prevent this. Hydroquinones for use as anti-color turbidity agents in diffusion transfer sensitive materials have been disclosed in JP-A- No. 58-21249.

The use of sulfonamidophenols as anti-color turbidity agents in diffusion transfer sensitive materials has been disclosed in *Research Disclosure,* 15162 (March 1973), page 83, and in JP-A-No. 55-72158 and JP-A-No. 57-24941.

Hydroquinones and sulfonamidophenols have also been used in color sensitive materials as toe cutting agents and anti-color fogging agents in coupling systems, and as development accelerators, toe cutting agents and electron donor compounds in diffusion transfer systems, as well as being used as anti-color turbidity agents.

However, these hydroquinones and sulfonamidophenols are known to deteriorate (undergo aerial oxidation) during the lifetime of the sensitive material and to migrate between layers, and this is undesirable since it results in a change in photographic performance with the passage of time. Thinner films are being used in the latest sensitive materials with a view to improving picture quality (increasing sharpness), and techniques in which the deterioration with the passage of time and inter-layer migration of the reducing agents are markedly suppressed are clearly desirable in order to minimize as far as possible the amount of hydroquinones and sulfonamidophenols which have to be added.

Furthermore, the reduction in the amount of gelatin which accompanies any reduction in layer thickness has an adverse effect on the inter-layer adhesion of multilayer sensitive materials and improvement in this connection is also desirable.

As well as the methods for dispersing the hydroquinones in a sensitive material which involve dispersion along with a high boiling point organic solvent which are often used in practice, methods of dispersion together with a polymer have been disclosed in JP-A-No. 55-144239 (corresponding to U.S. Pat. No. 4,293,641) and JP-A-No. 56-125738 (corresponding to U.S. Pat. No. 4,366,236), but the suppressing effect on the deterioration with the passage of time and the interlayer migration of the hydroquinones achieved thereby is inadequate.

SUMMARY OF THE INVENTION

An object of this invention is to provide color photographic materials which exhibit little change in photographic performance with the passage of time and which have excellent storage properties.

Another object of the invention is to provide a novel method of dispersion by which hydroquinones and sulfonamidophenols can be incorporated into a sensitive material in a stable manner.

It has now been discovered that these and other objects of the invention can be achieved by a silver halide color photographic material composed of a support having thereon at least one light-sensitive silver halide emulsion layer, at least one layer of the material containing the combination of a water-insoluble homopolymer or copolymer which has an amido bond in the repeating unit and at least one compound represented by formula (I):

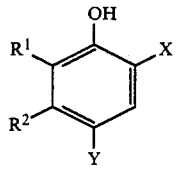

(I)

wherein X represents an alkyl group, an alkoxy group, an aryloxy group, an alkylthio group, an arylthio group, an amido group or a sulfonamido group; $R^1$ and $R^2$, which may be the same or different, each represents an alkyl group, an alkoxy group, an arylpoxy group, an alkylthio group, an arylthio group, an amido group, a sulfonamido group, hydrogen, a halogen atom, a sulfo group, a carboxyl group, a carbamoyl group, a sulfamoyl group, an acyl group or a sulfonyl group, provided that $R^1$ and $R^2$ may be linked to form a carbocyclic ring; and Y represents a hydroxyl group or a sulfonamido group.

BRIEF DESCRIPTION OF THE DRAWINGS

FIG. 1-(*a*) and FIG. 1-(*b*) are respectively a plan view and a side view of the photosensitive material used in Example 2.

In FIG. 1-(*a*), A is the photosensitive surface, B is the part on which the spacer is laminated, and C is the pod which houses the alkaline processing composition. The numbers indicate the length of each part (units: mm).

In FIG. 1-(*b*), the numbers (1) to (6) have the significance indicated below.

(1) White support.
(2) Image receiving layer and other layers consisting of layers (1) to (5).
(3) Peeling layer (6).
(4) Photosensitive layer consisting of layers (7) to (18).
(5) Processing liquid pod.
(6) Transparent cover sheet.

DETAILED DESCRIPTION OF THE INVENTION

General formula (I) is described in more detail below.

In formula (I), X represents a substituted or unsubstituted alkyl group (which has from 1 to 60 carbon atoms, for example, methyl, t-butyl, sec-octyl, decyl, benzyl, phenethyl, 4-hexyloxycarbonyl-1,1-dimethylbutyl, sec-octadecyl, t-pentadecyl group); an alkoxy (which has from 1 to 60 carbon atoms, for example, methoxy, methoxyethoxy, dodecyloxy); an aryloxy group (which has from 6 to 60 carbon atoms, for example, phenoxy, 4-methoxyphenoxy); an alkylthio group (which has from 1 to 60 carbon atoms, for example, butylthio, dodecylthio); an arylthio group (which has from 6 to 60 carbon atoms, for example, phenylthio, 2-octyloxy-5-t-octylphenylthio); an amido group (which has from 2 to 60 carbon atoms, for example, acylamino, benzylamino, 3,5-bis(2-hexyldecanamido)benzoylamino, α-(2,4-di-tertamylphenoxy)butanamido); or a sulfonamido group (which has from 1 to 60 carbon atoms, for example, benzenesulfonamido, 4-octadecyloxybenzenesulfonamido, hexadecanesulfonamido). $R^1$ and $R^2$, which may be the same or different, each represents the same group as X, or hydrogen, a halogen atom, sulfo group, carboxyl group, or a substituted or unsubstituted carbamoyl group (which have from 1 to 60 carbon atoms, for example carbamoyl, N,N-dipropylcarbamoyl, N-phenylcarbamoyl), a sulfamoyl group (which have from 0 to 60 carbon atoms, for example, sulfamoyl, N,N-dihexylsulfamoyl, N-phenylsulfamoyl), an acyl group (which have from 2 to 60 carbon atoms, for example acetyl, benzoyl, 3-carboxypropanoyl) or a sulfonyl group (which have from 1 to 60 carbon atoms, for example, methanesulfonyl, benzenesulfonyl, dodecyloxybenzenesulfonyl). $R^1$ and $R^2$ may be linked to form a carbocyclic ring. Y represents a hydroxyl group or a sulfonamido group, and the total number of carbon atoms in X, $R^1$, $R^2$ and Y is at least 10.

The compounds of general formula (I) may be linked to form of a dimer, a trimer, an oligomer or a polymer.

X preferably represents an alkyl group, alkylthio group, amido group or a sulfonamido group and, more preferably, it represents an alkyl group or an amido group.

$R^1$ and $R^2$ preferably represent hydrogen, halogen atoms, sulfo groups, alkyl group, alkylthio groups or sulfonyl groups, and more preferably they represent hydrogen, halogen atoms, alkyl groups or sulfonyl groups.

Y preferably represents a hydroxyl group.

Specific examples of compounds of formula (I) of this invention are indicated below, but the invention is not to be construed as being limited by these examples.

I-(1)

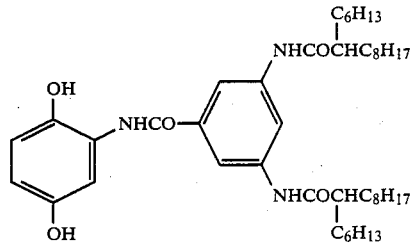

I-(2)

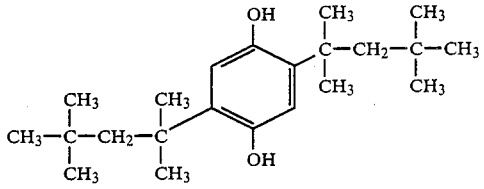

I-(3)

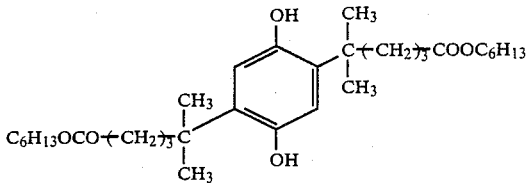

I-(4)

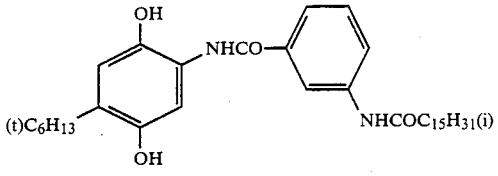

I-(5)

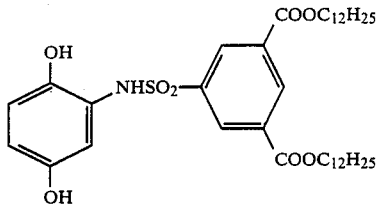

I-(6)

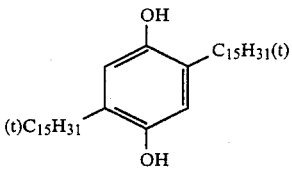

-continued
I-(7)
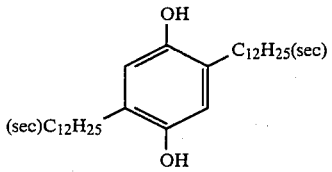
I-(8)
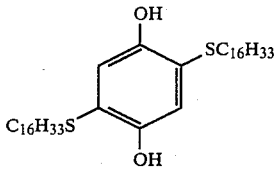
I-(9)
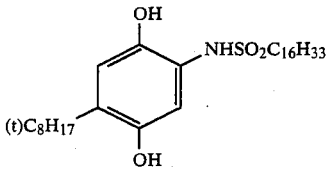
I-(10)
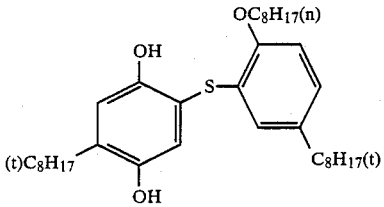
I-(11)
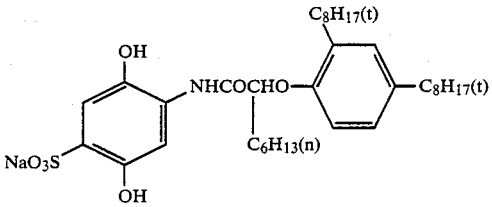
I-(12)
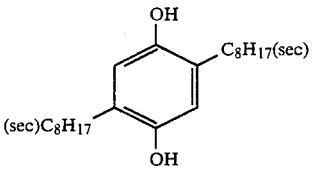
I-(13)
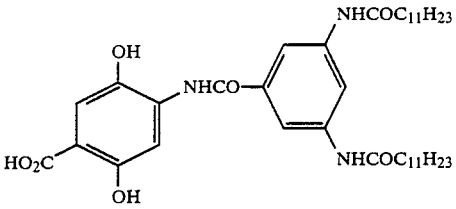
I-(14)
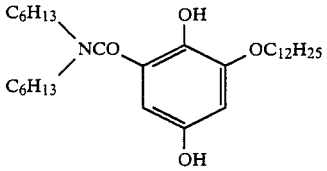
-continued
I-(15)
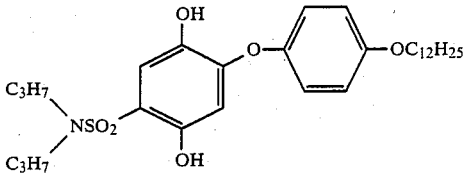
I-(16)
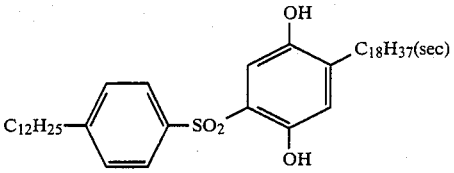
I-(17)
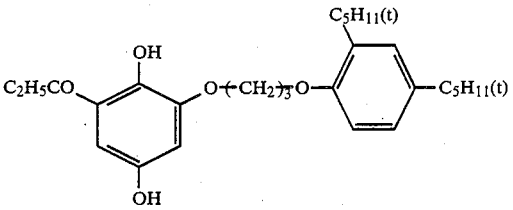
I-(18)
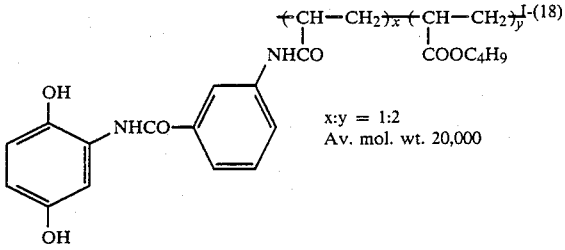
I-(19)
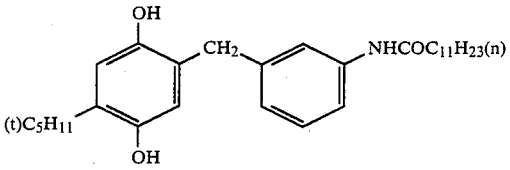
I-(20)
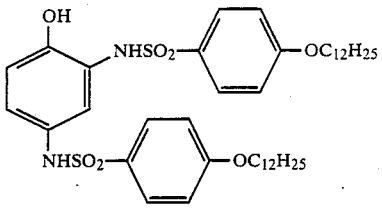
I-(21)
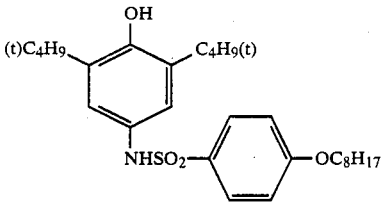
I-(22)
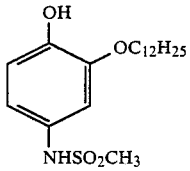

-continued

I-(23)

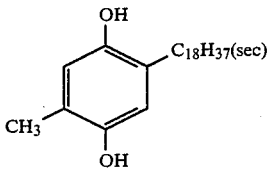

I-(24)

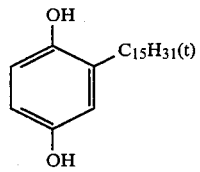

I-(25)

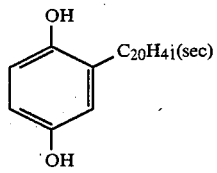

I-(26)

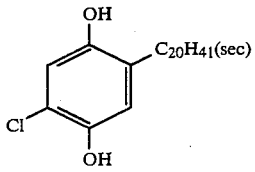

I-(27)

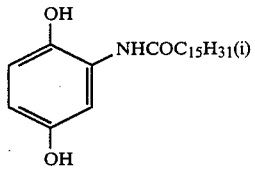

The compounds of general formula (I) of this invention can be prepared using the methods disclosed in JP-A-No. 53-32034, JP-A-No. 55-55121, JP-A-No. 59-5247 and JP-A-No. 62-103638, in JP-B-No. 61-13748, and in JP-A-No. 62-103053, and using methods which are based upon the aforementioned methods.

When used as anti-color turbidity agents in light-insensitive layers (e.g., an intermediate layer, an antihalation layer, a protective layer) other than emulsion layers, the compounds of general formula (I) of this invention are preferably used in an amount of from $1.0\times10^{-2}$ to $1.0\times10^{-5}$ mol per square meter per layer, and when used as anti-color fogging agents in the emulsion layers they are preferably used in an amount of from $1.0\times10^{-4}$ to $1.0\times10^{-6}$ mol per square meter per layer, but they are not limited to use in these amounts. The compounds can be added to the emulsion layers and to other layers to prevent the occurrence of both color turbidity and color fogging. The use of combinations of the compounds of general formula (I) of this invention and polymers which have amido bonds in the repeating units in light-insensitive layers other than the emulsion layers is most prefered.

In this invention, any monomer can be used for the water insoluble homopolymers or copolymers which have amido bonds in the repeating unit provided that the amido bonds do not form heterocyclic structural units, and one or more such monomer can be included as a copolymer monomer. The term "water insoluble" as used herein reefers to a polymer with a solubility in water of not more than 10 grams per liter, and preferably not more than 1 gram per liter.

The water insoluble homopolymers or copolymers which have an amido bond in the repeating unit in this invention preferably have a repeating unit represented by formula (II):

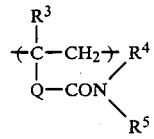

(II)

In this formula, $R^3$ represents hydrogen, a halogen atom or an alkyl group, and Q represents a single bond or a divalent linking group.

$R^4$ and $R^5$, which may be the same or different, each represents hydrogen, an alkyl group, aryl group or heterocyclic group; and $R^4$ and $R^5$ may form, together with the adjacent nitrogen atom, a heterocyclic ring.

In general formula (II), $R^3$ represents hydrogen, a halogen atom (e.g., chlorine, bromine, or fluorine) or an alkyl group (which has from 1 to 6 carbon atoms, for example, methyl, propyl, hexyl), and Q represents a single bond or a divalent linking group (which has from 1 to 20 carbon atoms, for example, p-phenylene or

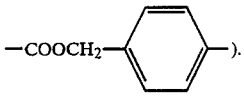

$R^4$ and $R^5$ represent hydrogen, alkyl groups (which have from 1 to 20 carbon atoms, for example, methyl, ethyl, propyl, n-butyl, t-butyl, hexyloxypropyl), aryl groups (which have from 6 to 20 carbon atoms, for example, phenyl, p-methoxyphenyl), heterocyclic groups (five to seven membered rings and which have from 2 to 20 carbon atoms, for example, pyridin-4-yl), and $R^4$ and $R^5$ may, together with the adjacent nitrogen atom, form a heterocyclic ring (a five to seven-membered ring which has from 2 to 20 carbon atoms, for example, piperidine, pyrrolidine, indole).

$R^3$ is preferably hydrogen or an alkyl group and, more preferably, it is hydrogen or methyl.

Q is preferably a single bond.

$R^4$ and $R^5$ are preferably hydrogen or alkyl groups and, more preferably, at least one of $R^4$ and $R^5$ is an alkyl group.

Specific examples of the repeating units of water insoluble homopolymer or copolymer which have an amido bond in the repeating unit of this invention are indicated below, but the invention is not to be construed as being to be construed limited to these units.

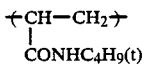

(a)

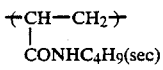

(b)

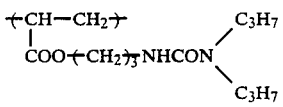

(c)

-continued (d)

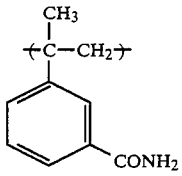

(e)

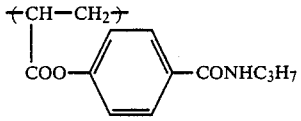

(f)

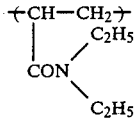

(g)

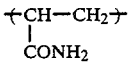

(h)

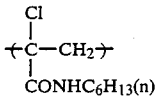

(i)

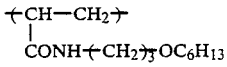

(j)

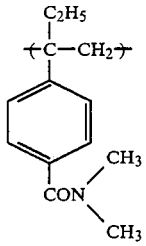

(k)

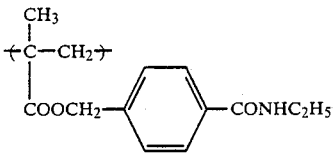

(l)

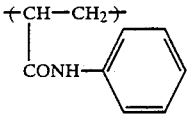

(m)

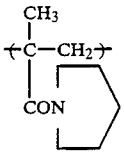

(n)

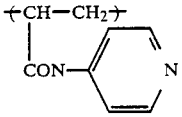

-continued (o)

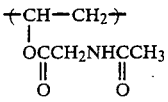

(p)

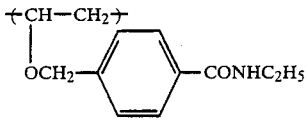

(q)

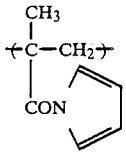

(r)

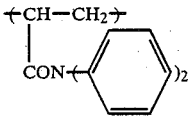

(s)

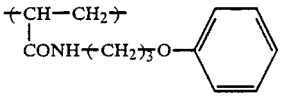

(t)

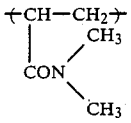

The polymers in this invention may contain other monomers as copolymer monomers. The generally used copolymer monomers, such as acrylic acid esters (e.g., methyl acrylate, ethyl acrylate, butyl acrylate, 2-ethylhexyl acrylate, 2-chloroethyl acrylate, cyanoethyl acrylate, methoxybenzyl acrylate), methacrylic acid esters (e.g., methyl methacrylate, ethyl methacrylate, butyl methacrylate, cyclohexyl methacrylate, chlorobenzyl methacrylate, sulfopropyl methacrylate), vinyl esters (e.g., vinyl acetate, vinyl propionate, vinyl methoxyacetate), olefins (e.g., dicyclopentadiene, propylene, 1-butene, vinyl chloride, isoprene, styrene, chlorostyrene), vinyl ethers (e.g., methyl vinyl ether, butyl vinyl ether), crotonic acid esters, itaconic acid diesters, maleic acid diesters, fumaric acid diesters, and vinyl ketones, can be used for this purpose.

The polymers of this invention may consist of two or more monomers of the type which have an amido bond and monomers of the type which do not have an amido bond. Furthermore, water soluble monomers (here signifying monomers which form water soluble homopolymers) can be used as copolymer monomers provided that the resulting copolymer is water insoluble.

However, the content of monomer which has an amido bond in the polymer is preferably from 30% to 100% (by weight) and more preferably it is from 60% to 100% (by weight).

Two or more of the polymers of this invention disclosed above can be used conjointly.

The molecular weights or degrees of polymerization of the polymers of this invention do not in practice have a great effect on the effect of the invention, but problems can arise with the time taken to form a solution on dissolving the polymers in an auxiliary solvent if the molecular weight is high and, because of the high viscosities of the resulting solutions, difficulties can arise with emulsification and dispersion, coarse particles can be produced, and this may result in a lowering of coloration or it may give rise to problems such as those caused by poor coating properties. The use of large amounts of auxiliary solvent to lower the solution viscosity in order to overcome these problems causes another problems in the process. From this point of view, the polymer is preferably such that the viscosity of a solution obtained by dissolving 30 grams of the polymer in 100 cc of the auxiliary solvent which is being used is not more than 5,000 cps, and more preferably the viscosity of such a solution is not more than 2,000 cps. The molecular weight of the polymers which can be used in the invention is preferably not more than 500,000, more preferably from 2,000 to 150,000, and most preferably from 5,000 to 80,000.

The homopolymer or copolymer of the present invention is present in amount of from 10 g/m$^2$ to $1\times10^{31}$ 4 g/m$^2$, preferably 0.1 g/m$^2$ to $1\times10^{-4}$ g/m$^2$ in a photographic material, but they are not limit to use in these amounts.

The proportion of the polymer of this invention with respect to the auxiliary solvent differs according to the type of polymer which is being used, and varies across a wide range, depending on the solubility in the auxiliary solvent and the degree of polymerization, and the solubility of the compound represented by formula (I). Normally, the amount of auxiliary solvent used is that amount which is required to provide a sufficiently low viscosity so that the solution which consists of at least three substances, namely the compound represented by formula (I), the high boiling point organic solvent and the polymer, dissolved in the auxiliary solvent can be dispersed easily in water or in an aqueous hydrophilic coloid solution. The viscosity of the solution increases as the degree of polymerization of the polymer is increased and so it is difficult to establish a general rule for the proportion of polymer with respect to the auxiliary solvent irrespective of the type of polymer but, normally, proportions within the range from about 1:1 to about 1:50 (by weight) are preferred. The proportion of the polymer with respect to the compound represented by formula (I) of this invention is preferably within the range from 1:20 to 20:1 and more preferably it is within the range from 1:10 to 10:1.

Specific examples of polymers which can be used in the invention are indicated below, but the invention is not to be construed as being limited to these examples.

II-(1)

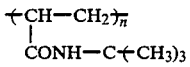

Average Molecular Weight About 100,000

II-(2)

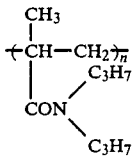

Average Molecular Weight About 300,000

-continued

II-(3)

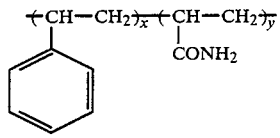

x:y = 65:35

Average Molecular Weight About 50,000

II-(4)

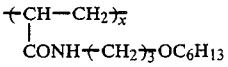

Average Molecular Weight About 250,000

II-(5)

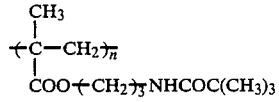

Average Molecular Weight About 30,000

II-(6)

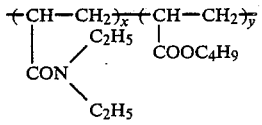

x:y = 45:55

Average Molecular Weight About 170,000

II-(7)

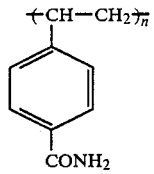

Average Molecular Weight About 10,000

II-(8)

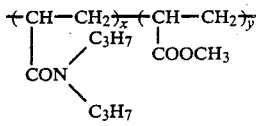

x:y = 95:5

Average Molecular Weight About 25,000

II-(9)

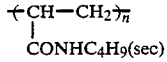

Average Molecular Weight About 180,000

II-(10)

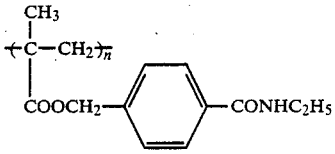

Average Molecular Weight About 120,000

II-(11)

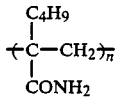

Average Molecular Weight About 55,000

II-(12)

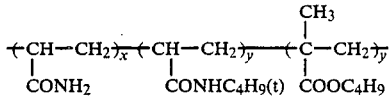

x:y:z = 20:30:50

Average Molecular Weight About 90,000

-continued

II-(13)

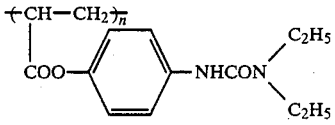

Average Molecular Weight About 35,000

II-(14)

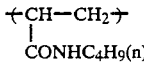

Average Molecular Weight About 250,000

II-(15)

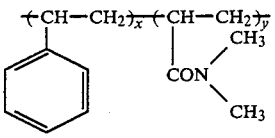

x:y = 35:65

Average Molecular Weight About 330,000

II-(16)

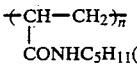

Average Molecular Weight About 500,000

II-(17)

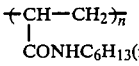

Average Molecular Weight About 22,000

II-(18)

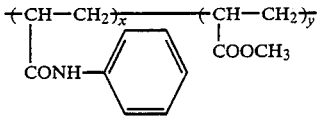

x:y = 70:30

Average Molecular Weight About 78,000

II-(19)

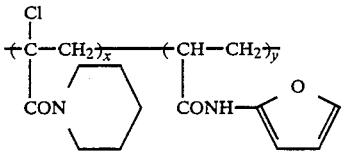

x:y = 80:20

Average Molecular Weight About 40,000

II-(20)

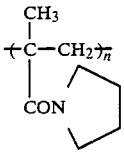

Average Molecular Weight About 170,000

II-(21)

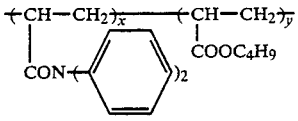

x:y = 40:60

Average Molecular Weight About 56,000

II-(22)

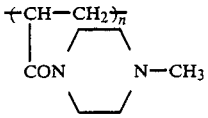

Average Molecular Weight About 280,000

II-(23)

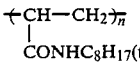

Average Molecular Weight About 70,000

-continued

II-(24)

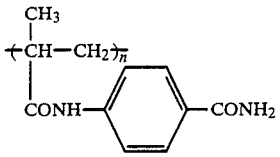

Average Molecular Weight About 35,000

The polymers of this invention can be synthesized using the compounds disclosed in JP-A-No. 56-5543, JP-A-No. 57-94752, JP-A-No. 57-176038, JP-A-No. 57-204038, JP-A-No. 58-28745, JP-A-No. 58-10738, JP-A-No. 58-42044 and JP-A-58-145944 as polymerization initiators and polymerization solvents, or using methods disclosed therein.

The polymerization temperature must be set in accordance with the molecular weight of the polymer which is being formed and the type of initiating agent, and temperatures from below 0° C. to in excess of 100° C. can be used, but polymerization is normally carried out at a temperature within the range from 30° C. to 100° C.

The silver halide contained in the photographic emulsion layer of a photographic material according to the invention is preferably a silver iodobromide, silver iodochloride or silver iodochlorobromide which contains not more than about 30 mol % of silver iodide. The use of silver iodobromides which contain from about 2 mol % to about 25 mol % of silver iodide is particularly desirable.

The silver halide grains in the photographic emulsion may have a regular crystalline form, such as a cubic, octahedral or tetradecahedral form, an irregular crystalline form, such as a spherical or tabular form, they may have crystal defects such as twinned crystal planes, or they may have a composite form consisting of these forms.

The silver halide grains may be of a small size not more than about 0.2 microns, or of a large size such that the projected area diameter is up to about 10 microns, and they may take the form of a poly-disperse emulsion or a mono-disperse emulsion.

The silver halide photographic emulsions which can be used in the invention can be prepared, for example, using the methods disclosed for example in *Research Disclosure (RD)* No. 17643 (December 1978), pages 22 to 23, "I. Emulsion Preparation and Types", and in *RD* No. 18716 (November 1979), page 648; in *Chemie et Physique Photographique,* by P. Glafkides, (Paul Montel, 1967); in *Photographic Emulsion Chemistry,* by G. F. Duffin, (Focal Press, 1966); and in *Making and Coating Photographic Emulsions,* by V. L. Zelikman et al., (Focal Press, 1964).

The mono-disperse emulsions disclosed in U.S. Nos. 3,574,628 and 3,655,394, and in British Patent No. 1,413,748, are preferred.

Furthermore, tabular grains which have an aspect ratio of at least about 5 can be used in the invention. Tabular grains can be prepared easily using the methods disclosed by Gutoff in *Photographic Science and Engineering,* Volume 14, pages 248 to 257 (1970), in U.S. Pat. Nos. 4,434,226, 4,414,310, 4,433,048 and 4,439,520, and in British Patent No. 2,112,157.

The crystal structure may be uniform, the interior and exterior parts may have a heterogeneous halogen composition, or the grains may have a layered structure and, moreover, silver halides which have different compositions may be joined with an epitaxial junction or they may be joined with compounds other than silver halides, such as silver thiocyanate or lead oxide.

Mixtures of grains of various crystalline forms can also be used.

The silver halide emulsions which are used are normally subjected to physical ripening, chemical ripening and spectral sensitization. Additives which can be used in these processes have been disclosed in *Research Disclosure,* Nos. 17643 and 18716 as summarized in the table below.

Known photographically useful additives which can be used in the invention are also disclosed in the two *Research Disclosures,* mentioned above, as shown in the table below.

| | Type of Additive | RD 17643 | RD 18716 |
|---|---|---|---|
| 1. | Chemical sensitizers | Page 23 | Page 648, right col. |
| 2. | Speed increasing agents | | As above |
| 3. | Spectral sensitizers Strong color sensitizers | Pages 23–24 | Pages 648 right col. to 649 right col. |
| 4. | Whiteners | Page 24 | |
| 5. | Anti-foggants and Stabilizers | Pages 24–25 | Page 649 right col. |
| 6. | Light absorbers, filter dyes, UV Absorbers | Pages 25–26 | Pages 649 right col. to 650 left col. |
| 7. | Anti-staining agents | Page 25, right col. | Page 650 left to right col. |
| 8. | Dye image stabilizers | Page 25 | |
| 9. | Film hardening agents | Page 26 | Page 651, left col. |
| 10. | Binders | Page 26 | As above |
| 11. | Plasticizers, lubricants | Page 27 | Page 650, right col. |
| 12. | Coating promotors, Surfactants | Pages 27 | As above |
| 13. | Anti-static agents | Page 26–27 | As above |

Various color couplers can be used in this invention and specific examples have been disclosed in the patents disclosed in *Research Disclosure,* No. 17643, VII-C to G. The couplers disclosed in U.S. Pat. Nos. 3,933,501, 4,022,620, 4,326,024 and 4,401,752, in JP-B-No. 58-10739, and in British Patent Nos. 1,425,020 and 1,476,760 are preferred as yellow couplers.

The 5-pyrazolone and pyrazoloazole based compounds are preferred as magenta couplers, and those disclosed in U.S. Pat. Nos. 4,310,619 and 4,351,897, in European Patent No. 73,636, in U.S. Pat. Nos. 3,061,432 and 3,725,067, in *Research Disclosure,* No. 24220 (June 1984), in JP-A-No. 60-33552, in *Research Disclosure,* No. 24230 (June 1984), in JP-A-No. 60-43659, and in U.S. Pat. Nos. 4,500,630 and 4,540,654 are particularly prefered.

Phenol and naphthol based couplers are used as cyan couplers, and those disclosed in U.S. Pat. Nos. 4,052,212, 4,146,396, 4,228,233, 4,296,200, 2,369,929, 2,801,171, 2,772,162, 2,895,826, 3,772,002, 3,758,308, 4,334,011 and 4,327,173, in West German Patent Application (OLS) No. 3,329,729, in European Patent No. 121,365A, in U.S. Pat. Nos. 3,446,622, 4,333,999, 4,451,559 and 4,427,767, and in European Patent No. 161,626A are preferred.

The colored couplers disclosed in *Research Disclosure,* No. 17643 section VII-G, in U.S. Pat. No. 4,163,670, in JP-B-No. 57-39413, in U.S. Pat. Nos. 4,004,929, and 4,138,258 and in British Patent No. 1,146,368 are preferred for correcting the unwanted absorptions of colored dyes.

The couplers of which the colored dyes have a suitable degree of diffusibility disclosed in U.S. Pat. No. 4,366,237, in British Patent No. 2,125,570, in European Patent No. 96,570B, and in West German Patent Application (OLS) No. 3,234,533 are preferred.

Typical examples of polymerized dye forming couplers have been disclosed in U.S. Pat. Nos. 3,451,820, 4,080,211, and 4,367,282, and in British Patent No. 2,102,173.

The use of couplers which release photographically useful residual groups on coupling is preferred in this invention. The DIR couplers which release development inhibitors disclosed in the patents disclosed in the aforementioned *Research Disclosure,* No. 17643, sections VII-F, in JP-A-Nos. 57-151944, 57-154234 and 60-184248, and in U.S. Pat. No. 4,248,962 are preferred.

The couplers disclosed in British Patent Nos. 2,097,140 and 2,131,188, and in JP-A-Nos. 59-157638 and 59-170840 are preferred as couplers which release nucleating agents or development accelerators in the form of the image during development.

Other couplers which can be used in the light sensitive materials of this invention include the competitive couplers disclosed in U.S. Pat. No. 4,130,427, the multi-equivalent couplers disclosed in U.S. Pat. Nos. 4,283,472, 4,338,393 and 4,310,618, the DIR redox compound releasing couplers and the DIR coupler releasing couplers or the DIR coupler releasing coupler and the DIR coupler releasing redox compounds disclosed in JP-A-Nos. 60-185950 and 62-24252, the couplers which release a dye to which color is restored after elimination as disclosed in European Patent No. 173,302A, the bleaching accelerator releasing couplers disclosed in *Research Disclosure,* Nos. 11449 and 24241, and in JP-A-No. 61-201247, and the ligand releasing couplers disclosed in U.S. Pat. No. 4,553,477.

Specific examples of color couplers which can be used in the invention are indicated below, but the invention is not to be construed as being limited to these color couplers.

C-(1)
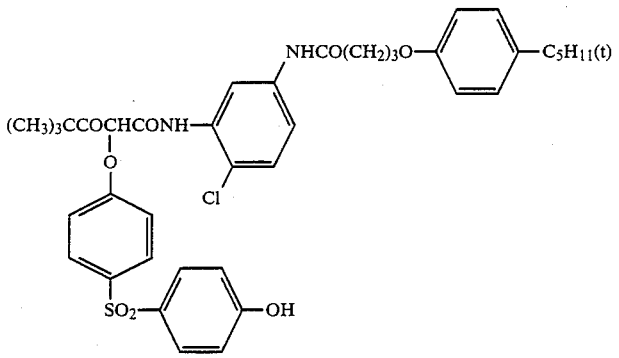
C-(2)
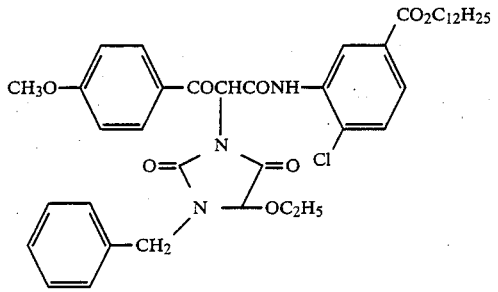
C-(3)
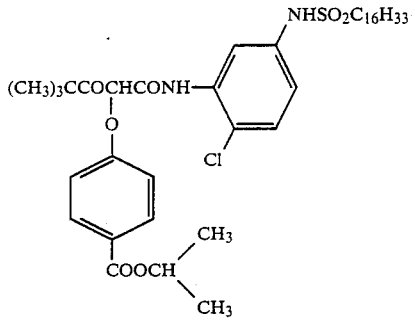
C-(4)
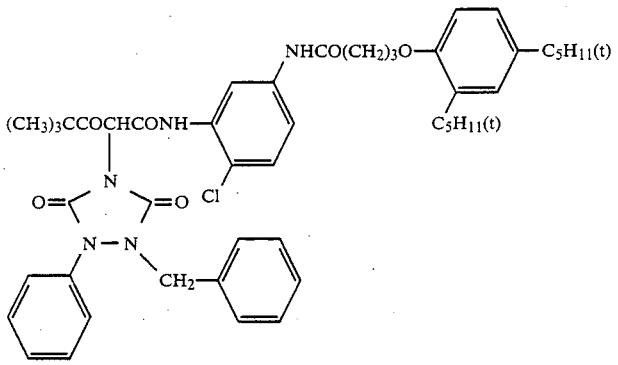
C-(5)
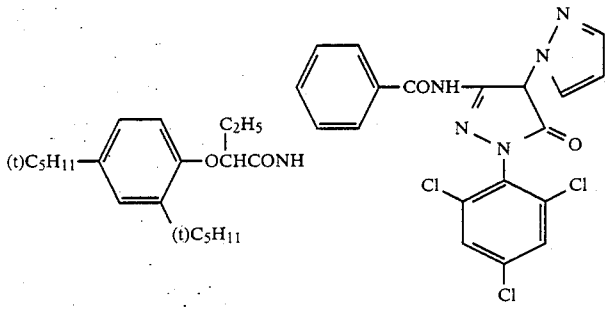

-continued
C-(6)
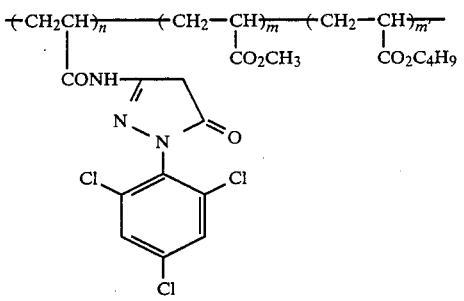
n:m:m' = 2:1:1 (weight ratio)
Molecular Weight About 40,000
C-(7)
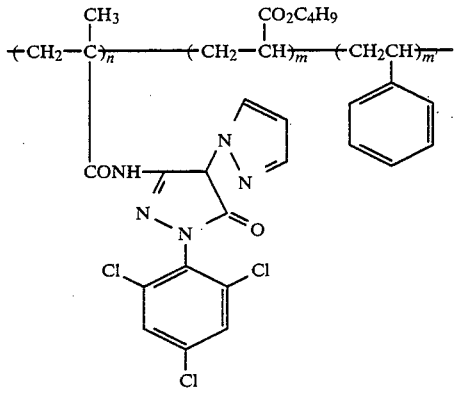
n/m/m' = 50/25/25 (weight %)
Average Molecular Weight About 30,000
C-(8)
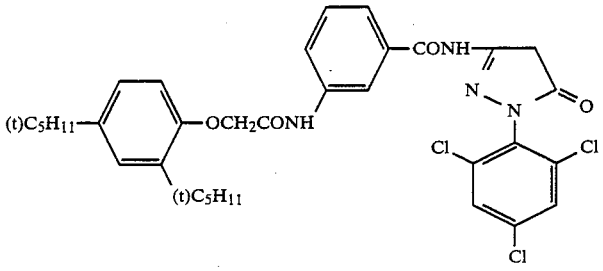
C-(9)
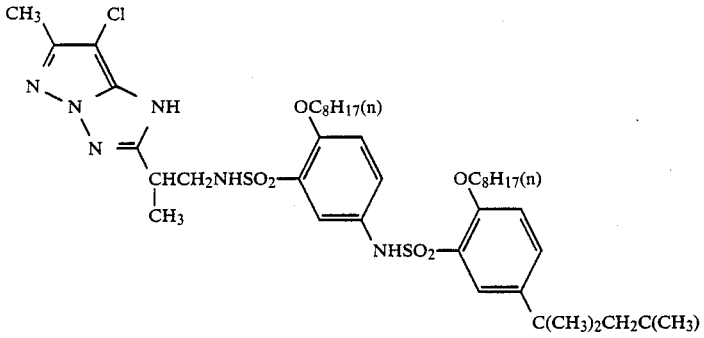
C-(10)
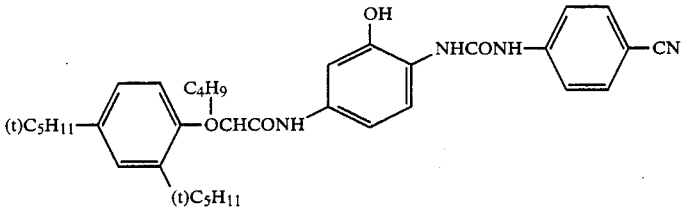

-continued
C-(11)
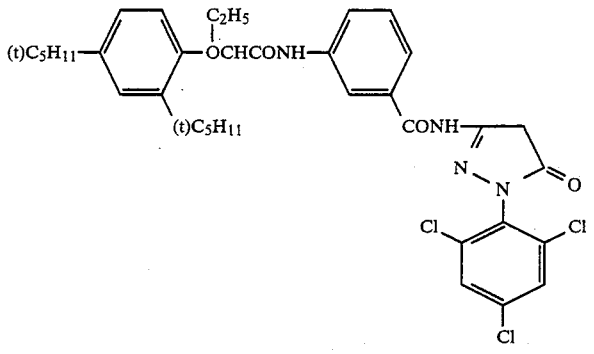
C-(12)
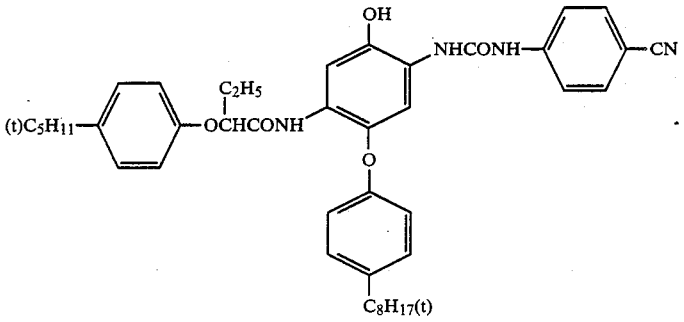
C-(13)
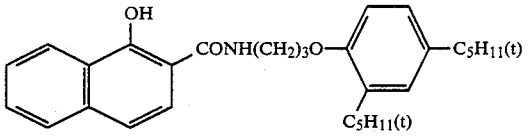
C-(14)
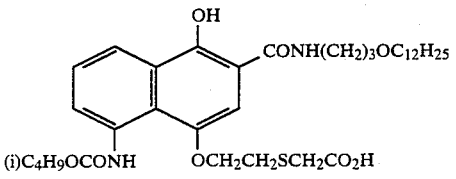
C-(15)
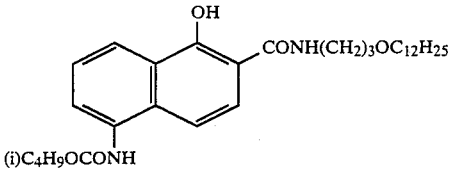
C-(16)
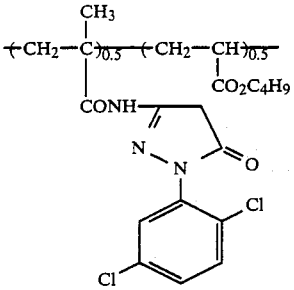
(weight ratio)

-continued
C-(17)
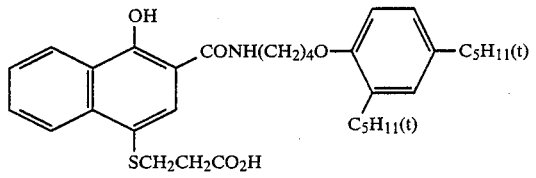
C-(18)
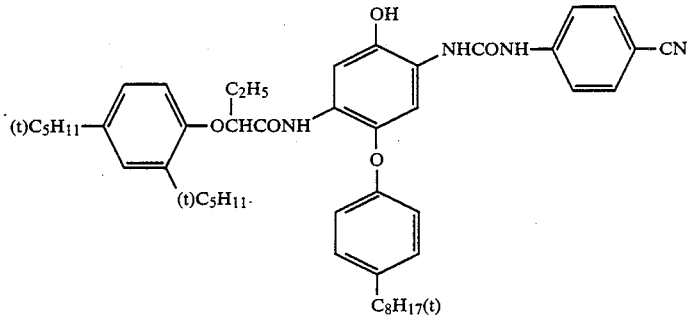
C-(19)
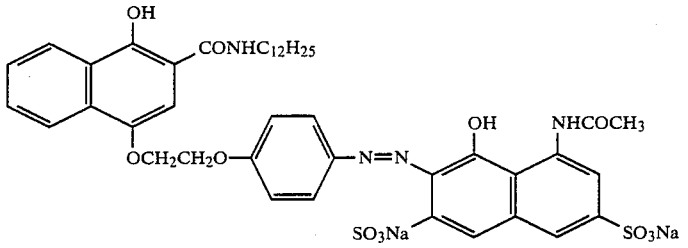
C-(20)
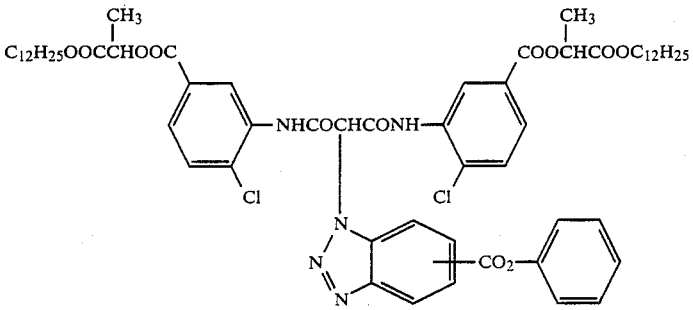
C-(21)
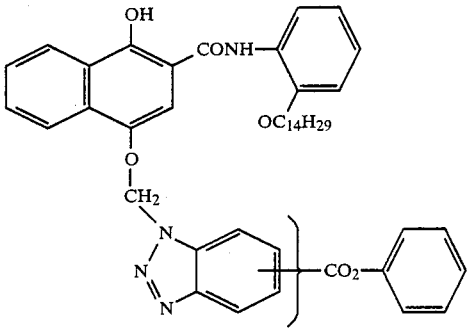

-continued
C-(22)
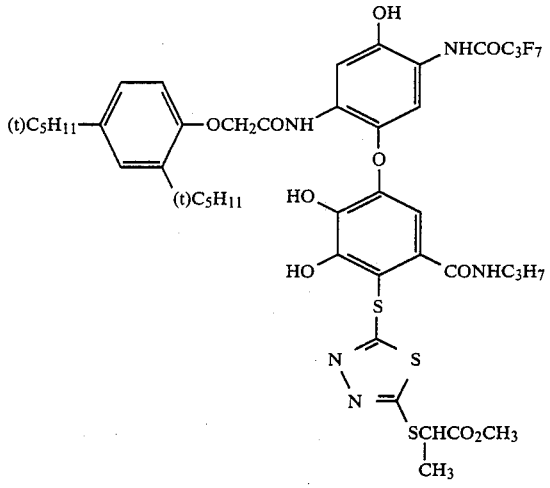
C-(23)
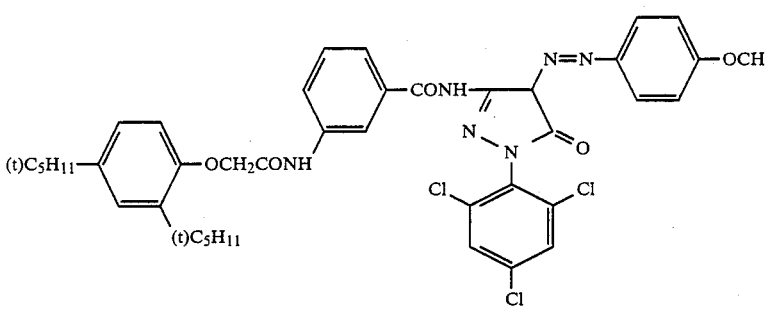
C-(24)
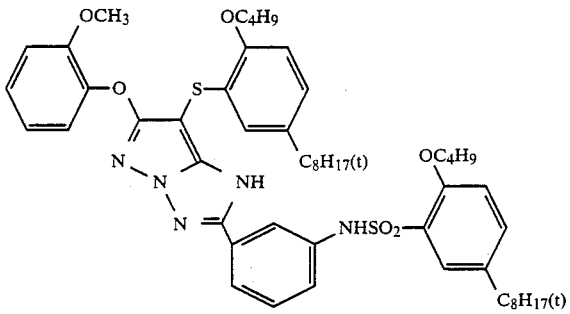
C-(25)
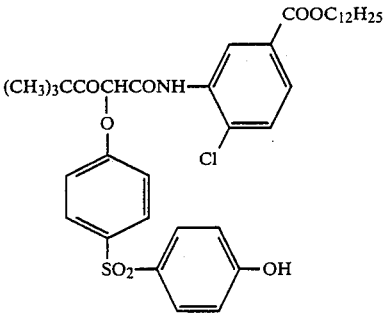

-continued
C-(26)
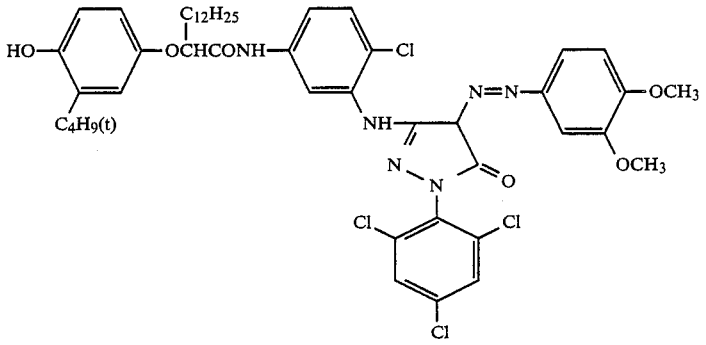
C-(27)
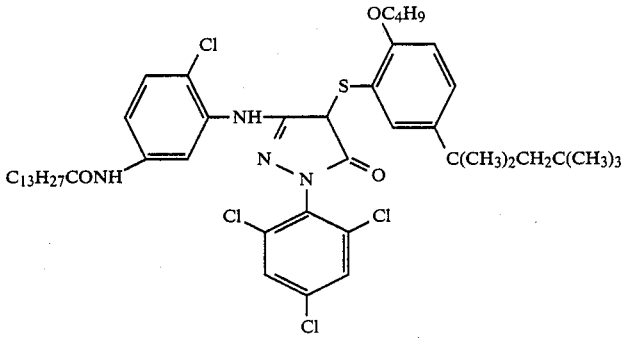
C-(28)
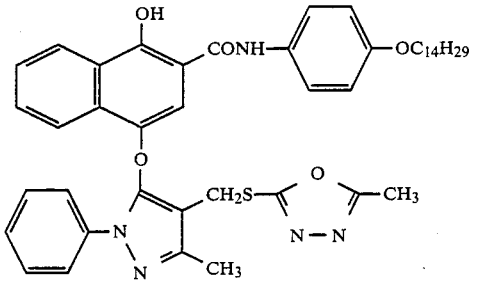
C-(29)
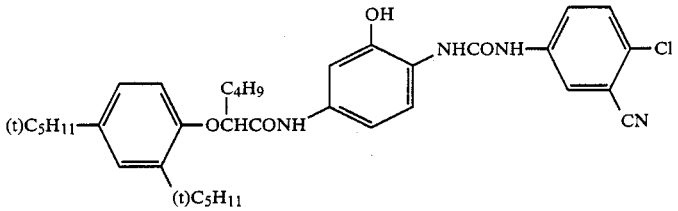
C-(30)
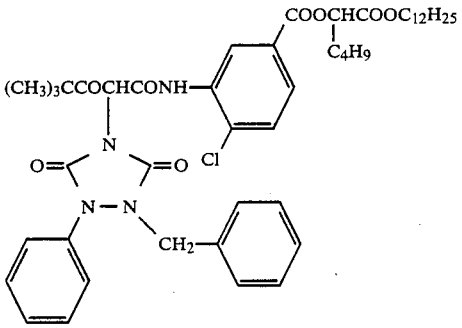

-continued
C-(31)
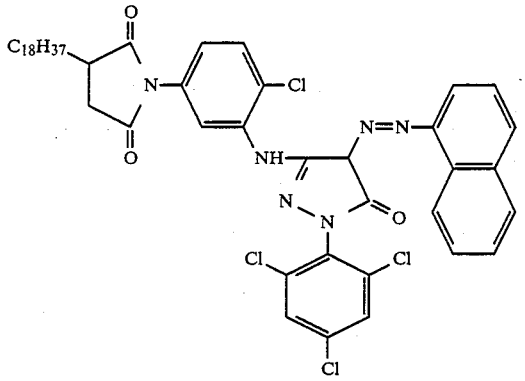
C-(32)
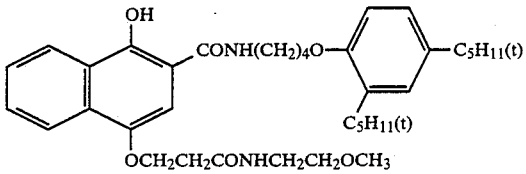
C-(33)
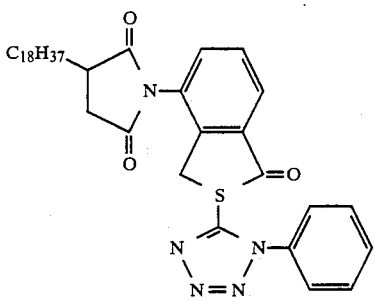
C-(34)
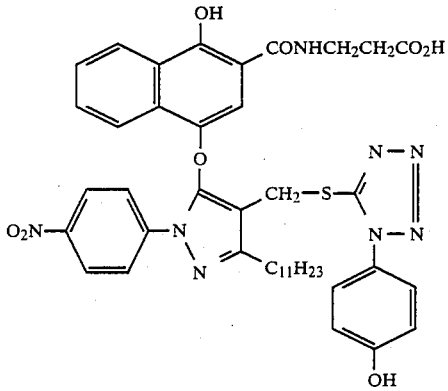
C-(35)
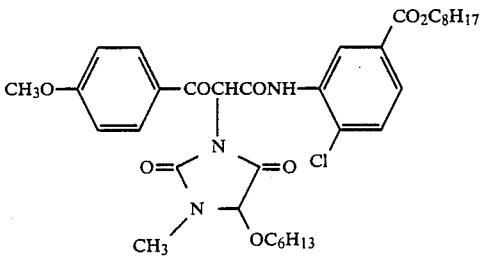

-continued
C-(36)
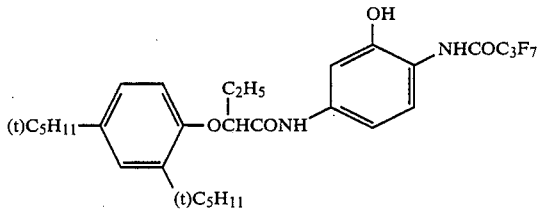
C-(37)
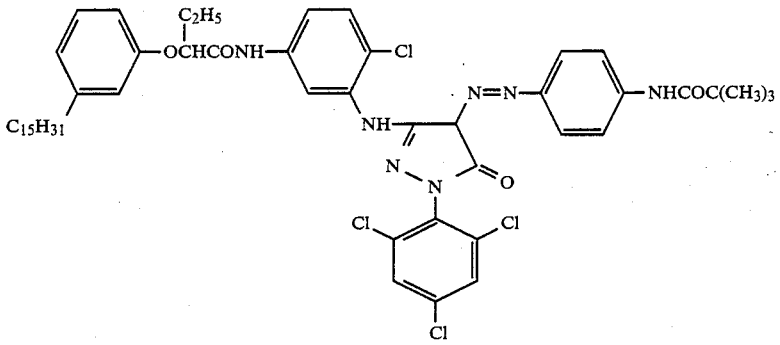
C-(38)
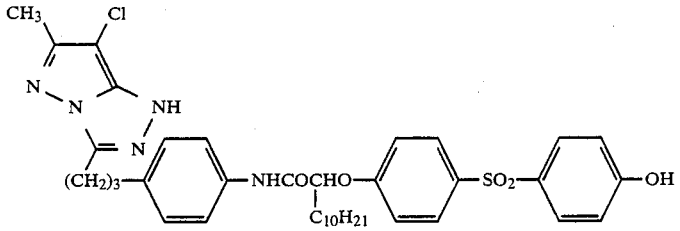
C-(39)
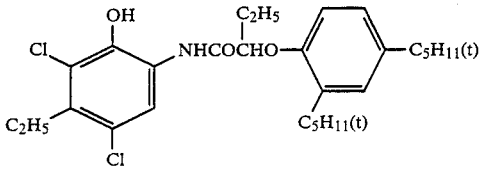
C-(40)
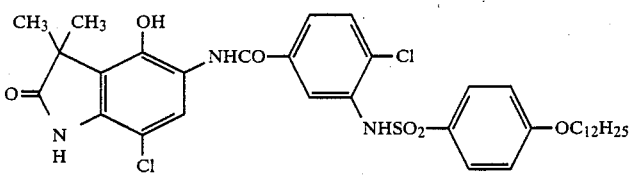
C-(41)
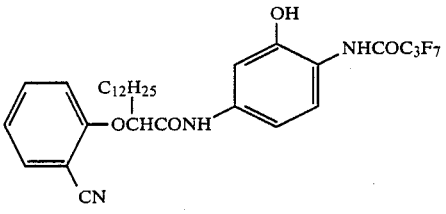

-continued
C-(42)
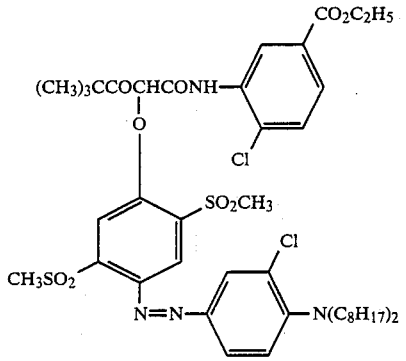
C-(43)
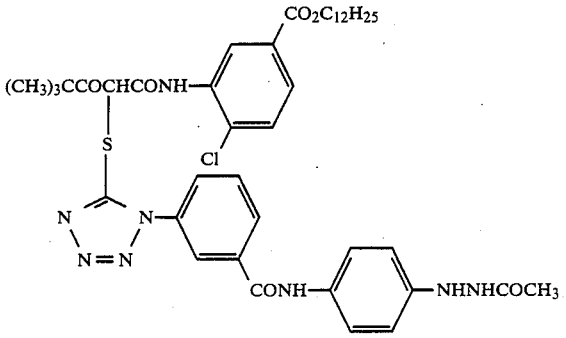
C-(44)
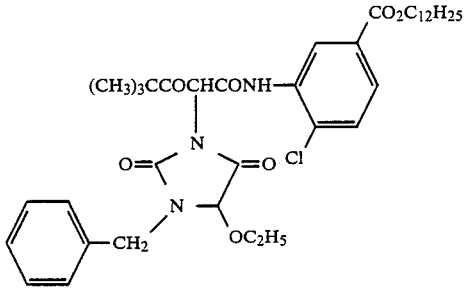
C-(45)
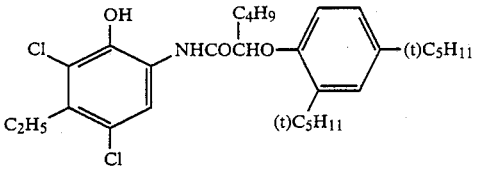
C-(46)
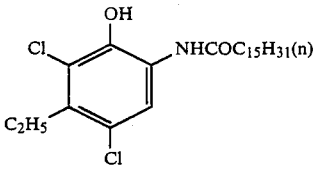
C-(47)
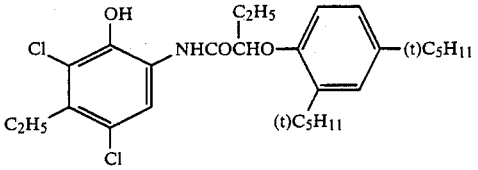

-continued
C-(48)
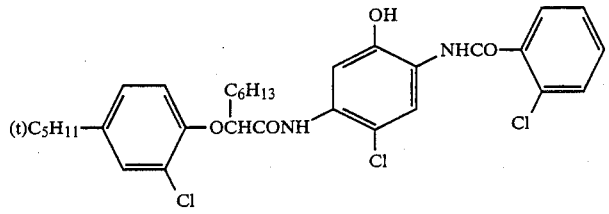
C-(49)
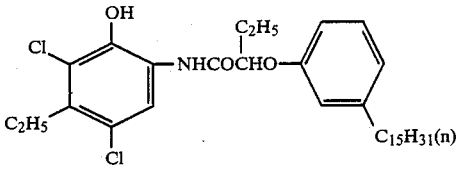
C-(50)
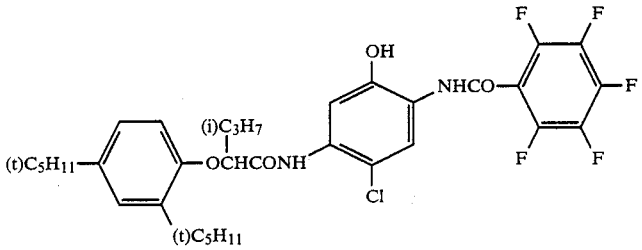
C-(51)
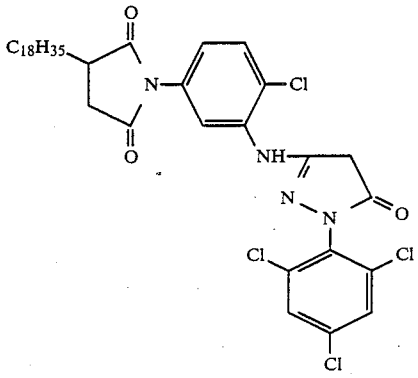
C-(52)
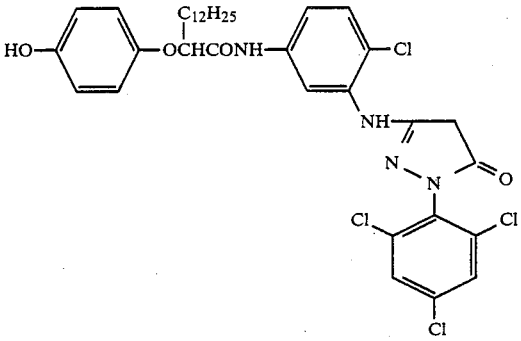

-continued
C-(53)
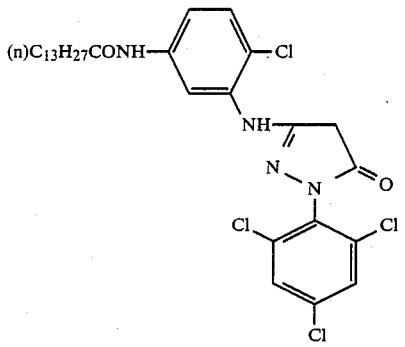
C-(54)
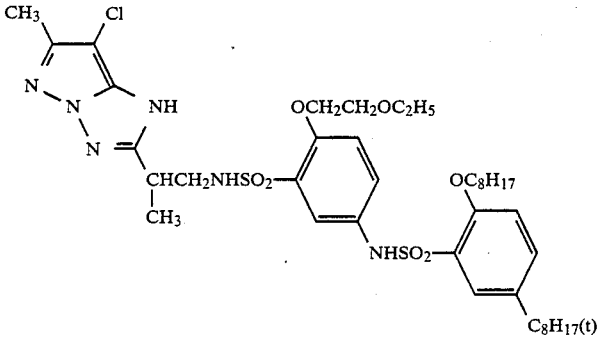
C-(55)
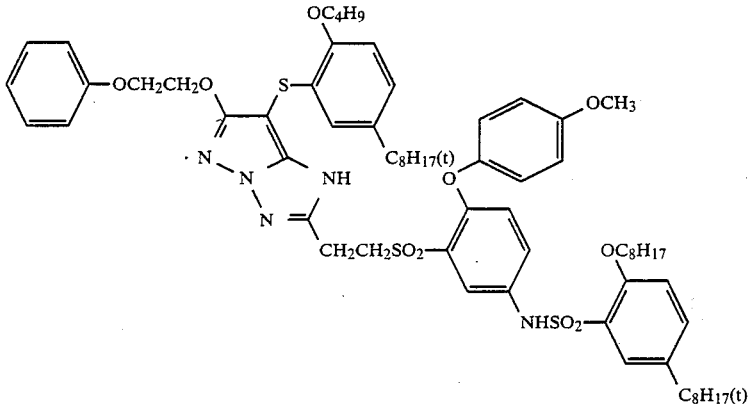
C-(56)
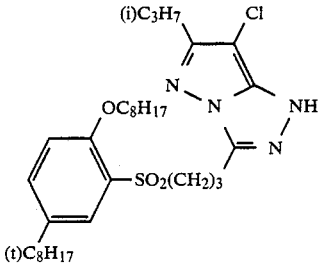

-continued

C-(57)

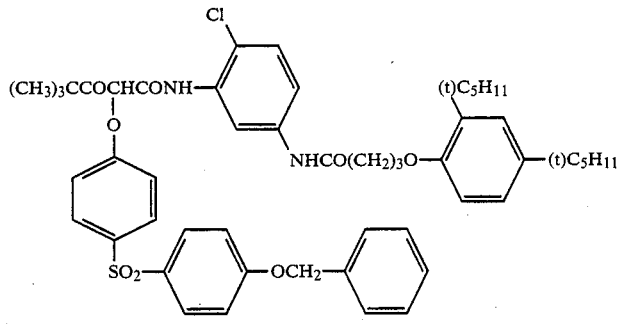

C-(58)

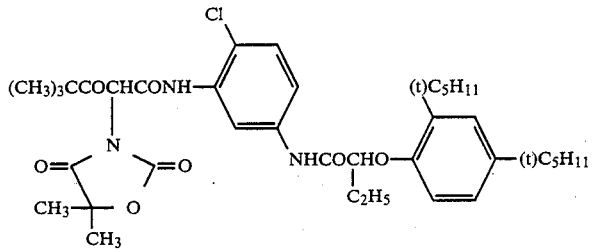

C-(59)

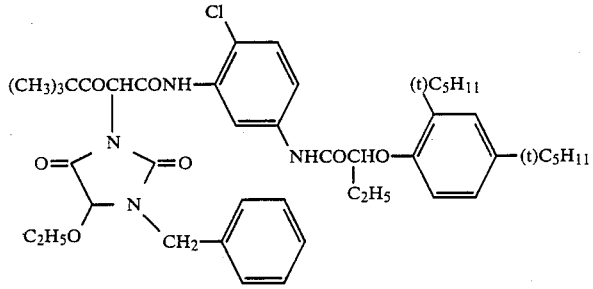

C-(60)

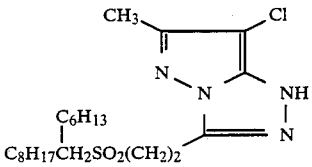

The couplers used in the invention can be introduced into the light sensitive materials using various known methods of dispersion.

Examples of high boiling point solvents which can be used in the oil in water dispersion methods have been disclosed in U.S. Pat. No. 2,322,027.

Examples of high boiling point organic solvents of boiling point at normal pressure at least 175° C. which can be used in the oil in water dispersion method include phthalic acid esters (dibutyl phthalate, dicyclohexyl phthalate, di-2-ethylhexyl phthalate, decyl phthalate, bis(2,4-di-t-amylphenyl)phthalate, bis(2,4-di-t-amylphenyl)isophthalate, bis(1,1-diethylpropyl)phthalate), phosphoric and phosphonic acid esters (triphenyl phosphate, tricresyl phosphate, 2-ethylhexyl diphenyl phosphate, tricyclohexyl phosphate, tri-2-ethylhexyl phosphate, tridodecyl phosphate, tributoxyethyl phosphate, trichloropropyl phosphate, di-2-ethylhexyl phenyl phosphonate), benzoic acid esters (2-ethylhexyl benzoate, dodecyl benzoate, 2-ethylhexyl p-hydroxybenzoate), amides (N,N-diethyldodecanamide, N,N-diethyllaurylamide, N-tetradecylpyrrolidone), alcohols or phenols (isostearyl alcohol, 2,4-di-tert-amylphenol), aliphatic carboxylic acid esters (bis(2-ethylhexyl) sebacate, dioctyl azelate, glycerol tributyrate, isostearyl lactate, trioctyl citrate etc.), aniline derivatives (N,N-dibutyl-2-butoxy-5-tert-octylaniline), and hydrocarbons (paraffins, dodecylbenzene, diisopropylnaphthalene). Furthermore, organic solvents of boiling point at least about 30° C., and preferably of boiling point at least 50° C., but less than about 160° C. can also be used as auxiliary solvents, and typical examples include ethyl acetate, butyl acetate, ethyl propionate, methyl ethyl ketone, cyclohexanone, 2-ethoxyethyl acetate, and dimethylformamide.

The processes and effects of the latex dispersion method and actual examples of latexes for impregnation purposes have been disclosed in U.S. Pat. No. 4,199,363, and in West German Patent Application (OLS) Nos. 2,541,274 and 2,541,230.

The invention can be applied to various color photosensitive materials. Typical examples include color negative films for general purposes or for cinematographic purposes, color reversal films for slides or television purposes, color papers, color positive films and color reversal papers.

Suitable supports which can be used in the invention have been disclosed, for example, on page 28 of *Re-*

*search Disclosure,* No. 17643 and in *Research Disclosure,* No. 18716 from the right hand column on page 647 to the left hand column on page 648.

Color photographic materials to which the invention applies can be developed and processed using the conventional methods disclosed on pages 28 and 29 of *Research Disclosure,* No. 17643 and from the left hand column to the right hand column of page 651 of *Research Disclosure,* No. 18716.

The color development bath used for the development processing of photosensitive materials of this invention is preferably an aqueous alkaline solution which contains a primary aromatic amine based color developing agent as the principal component. Aminophenol based compounds are also useful as color developing agents, but the use of p-phenylenediamine based compounds is preferred. Typical examples of these compounds include 3-methyl-4-amino-N,N-diethylaniline, 3-methyl-4-amino-N-ethyl-N-β-hydroxyethylaniline, 3-methyl-4-amino-N-ethyl-N-β-methanesulfonaminoethylaniline, 3-methyl-4-amino-N-ethyl-N-β-methoxyethylaniline and the sulfate, hydrochloride and p-toluenesulfonate salts of these compounds. Two or more of these compounds can be used conjointly, depending on the intended purpose.

The color development baths generally contain pH buffers, such as the carbonates, borates or phosphates of the alkali metals, and development inhibitors or antifogging agents such as bromides, iodides, benzimidazoles, benzothiazoles or mercapto compounds. They may also contain, as required, various preservatives, such as hydroxylamine, diethylhydroxylamine, sulfite, hydrazines, phenylsemicarbazides, triethanolamine, catechol sulfonic acids, triethylenediamine(1,4-diazabicyclo[2,2,2]octane), organic solvents such as ethylene glycol and diethylene glycol, development accelerators such as benzyl alcohol, poly(ethylene glycol), quaternary ammonium salts and amines, color forming couplers, competitive couplers, fogging agents such as sodium borohydride, auxiliary developing agents such as 1-phenyl-3-pyrazolidone, viscosity imparting agents, various chelating agents such as aminopolycarboxylic acids, aminopolyphosphonic acids, alkylphosphonic acids and phosphonocarboxylic acids, typical examples of which include ethylenediamine tetraacetic acid, nitrilotriacetic acid, diethylenetriamine penta-acetic acid, cyclohexanediamine tetra-acetic acid, hydroxyethyliminodiacetic acid, 1-hydroxyethylidene-1,1-diphosphonic acid, nitrilo-N,N,N-trimethylenephosphonic acid, ethylenediamine-N,N,N',N'-tetramethylenephosphonic acid, ethylenediamine di(o-hydroxyphenylacetic acid), and salts of these compounds.

Color development is carried out after normal black and white development in the case of reversal processing. Known black and white developing agents, for example the dihydroxybenzenes such as hydroquinone, the 3-pyrazolidones such as 1-phenyl-3-pyrazolidone, and the amino phenols such as N-methyl-p-aminophenol, can be used individually or conjointly in the black and white development bath.

The pH of these color development baths and black and white development baths is generally within the range from 9 to 12. Furthermore, the replenishment rate of the development bath depends on the color photographic materials which is being processed, but it is generally not more than 3 liters per square meter of photosensitive material, and it is possible, by reducing the bromide ion concentration in the replenisher, to use a replenishment rate of not more than 500 ml per square meter of photosensitive material. The prevention of loss of liquid by evaporation, and aerial oxidation, by minimizing the contact area with the air in the processing tank is desirable in cases where the replenishment rate is low. Furthermore, the replenishment rate can be reduced by suppressing the accumulation of bromide ion in the development bath.

The photographic emulsion layers are subjected to a conventional bleaching process after color development. The bleaching process may be carried out at the same time as the fixing process (in a bleach-fix process) or it may be carried out as separate process. Moreover, a bleach-fix process can be carried out after a bleach process in order to speed up processing. Moreover processing can be carried out in two connected bleach-fix baths, a fixing process can be carried out before carrying out a bleach-fix process, or a bleaching process can be carried out after a bleach-fix process, according to the intended purpose of the processing. Compounds of a poly-valent metal such as iron(III), cobalt(III), chromium(VI), copper(II), peracids, quinones, and nitro compounds can be used as bleaching agents. Typical bleaching agents include ferricyanides; dichromates; organic complex salts of iron(III) or cobalt(III), for example complex salts with aminopolycarboxylic acids such as ethylenediamine tetra-acetic acid, diethylenetriamine penta-acetic acid, cyclohexanediamine tetra-acetic acid, methylimino diacetic acid, 1,3-diaminopropane tetra-acetic acid, glycol ether diamine tetra-acetic acid, or citric acid, tartaric acid, or maleic acid; persulfates; bromates; permanganates and nitrobenzenes. Of these materials, the use of the aminopolycarboxylic acid iron(III) complex salts, principally ethylenediamine tetra-acetic acid iron(III) complex salts, and persulfates, is preferred for view of both rapid processing and the prevention of environmental pollution. Moreover, the amino polycarboxylic acid iron(III) complex salts are especially useful in both bleach baths and bleach-fix baths. The pH of a bleach or bleach-fix bath in which aminopolycarboxylic acid iron(III) complex salts are being used is normally from 5.5 to 8, but a lower pH can be used in order to speed up processing.

Bleach accelerators can be used, as required, in the bleach baths, bleach-fix baths, or bleach or bleach-fix pre-baths. Examples of useful bleach accelerators include the following: compounds which have a mercapto group or a disulfide group disclosed in U.S. Pat. No. 3,893,858, West German Patent Nos. 1,290,812 and 2,059,988, JP-A-No. 53-32736, JP-A-No. 53-57831, JP-A-No. 53-37418, JP-A-No. 53-72623, JP-A-No. 53-95630, JP-A-No. 53-95631, JP-A-No. 53-104232, JP-A-No. 53-124424, JP-A-No. 53-141623 and 53-28426, and in *Research Disclosure,* No. 17,129 (July 1978); the thiazolidine derivatives disclosed in JP-A-No. 50-140129; the thiourea derivatives disclosed in JP-B-No. 45-8506, JP-A-No. 52-20832 and JP-A-No. 53-32735, and in U.S. Pat. No. 3,706,561; the iodides disclosed in West German Patent No. 1,127,715 and in JP-A-No. 58-16235; the polyoxyethylene compounds disclosed in West German Patent Nos. 966,410 and 2,748,430; the polyamine compounds disclosed in JP-B-No. 45-8836; the other compounds disclosed in JP-A-No. 49-42434 JP-A-No. 49-59644, JP-A-No. 53-94927, 54-35727, JP-A-No. 55-26506 and JP-A-No. 58-163940; and bromide ions. Among these compounds, those which have a mercapto group or a disulfide group are preferred in view of their large accelerating effect, and the use of the compounds disclosed in U.S. Pat. No. 3,893,858, West German Patent No. 1,290,812, and in JP-A-No. 53-95630 is especially preferred. Moreover, the use of the compounds disclosed in U.S. Pat. No. 4,552,834 is also desirable. These bleach accelerators may be added to the sensitive material. These bleach accelerators are especially effective when bleach-fixing color photosensitive materials for photographic purposes.

Thiosulfates, thiocyanates, thioether based compounds, thioureas and large quantities of iodide can be used as fixing agents, but thiosulfates are generally used for this purpose, and ammonium thiosulfate in particular can be used in the widest range of applications. Sulfites, bisulfites, or carbonylbisulfite addition compounds, are preferred as preservatives for bleach-fix baths.

The silver halide color photographic materials of this invention are generally subjected to a water washing and/or stabilizing process after the desilvering process. The amount of water used in the water washing process can be fixed within a wide range according to the nature of the photosensitive material (for example the materials, such as the couplers, which are being used), the wash water temperature, the number of washing tanks (the number of washing stages), the replenishment system, i.e. whether a counter-flow or a sequential-flow system is used, and various other conditions. The relationship between the amount of water used and the number of water washing tanks in a multi-stage counter-flow system can be obtained using the method outlined on pages 248 to 253 of the *Journal of the Society of Motion Picture and Television Engineers,* Volume 64 (May 1955).

The amount of wash water can be greatly reduced by using the multi-stage counter-flow system noted in this article, but bacteria proliferate due to the increased residence time of the water in the tanks and problems arise as a result of the sediments which are formed becoming attached to the photosensitive material. The method in which the calcium ion and manganese ion concentrations are reduced disclosed in JP-A-No. 62-288838 can be used very effectively to overcome problems of this sort in the processing of color photosensitive materials of this invention. Furthermore, the isothiazolone compounds and thiabendazoles disclosed in JP-A-No. 57-8542, chlorine based disinfectants such as sodium chloroisocyanurate, and benzotriazoles, and the disinfectants disclosed in *Chemistry of Biocides and Fungicides* by Horiguchi, *Reduction of Micro-organisms, Biocidal and Fungicidal Techniques,* published by the Health and Hygiene technical Society and in *A Dictionary of Biocides and Fungicides,* published by the Japanese Biocide and Fungicide Society, can be used for this purpose.

The pH value of the wash water used in the processing of the photosensitive materials of invention is within the range from 4 to 9, and preferably within the range from 5 to 8. The wash water temperature and the washing time can be set variously according to the nature of the photosensitive material and the application etc. but, in general, washing conditions of from 20 seconds to 10 minutes at a temperature of from 15° to 45° C., and preferably of from 30 seconds to 5 minutes at a temperature of from 25° to 40° C., are selected. Moreover, the photosensitive materials of this invention can be processed directly in a stabilizing bath instead of being subjected to a water wash as described above. The known methods disclosed in JP-A- No. 57-8543, JP-A-No. 58-14834 and JP-A-No. 60-220345 can all be used for this purpose.

Furthermore, there are cases in which a stabilization process is carried out following the water washing process, and the stabilizing baths which contain formalin and surfactant which are used as a final bath for color photosensitive materials used for photographic purposes are an example of such a process. Various chelating agents and fungicides can be added to these stabilizing baths. The overflow which accompanies replenishment of the above mentioned wash water and/or stabilizer can be re-used in other processes such as the desilvering process.

A color developing agents may also be incorporated into the silver halide color photosensitive materials of this invention in order to simplify and speed-up processing. The incorporation of various color developing agent precursors is preferred. For example, the indoaniline based compounds disclosed in U.S. Pat. No. 3,342,597, the Schiff's base type compounds disclosed in U.S. Pat. No. 3,342,599 and in *Research Disclosure,* Nos. 14,850 and 15,159, the aldol compounds disclosed in *Research Disclosure,* No. 13,924, the metal salt complexes disclosed in U.S. Pat. No. 3,719,492, and the urethane based compounds disclosed in JP-A-No. 53-135628 can be used for this purpose.

Various 1-phenyl-3-pyrazolidones can be incorporated, as required, into the silver halide color photosensitive materials of this invention with a view to accelerate color development. Typical compounds of this type have been disclosed in JP-A-No. 56-64339, JP-A-No. 57-144547 and JP-A-No. 58-115438.

The various processing baths are used at a temperature of from 10° C. to 50° C. in this invention. The standard temperature is normally from 33° to 38° C., but processing is accelerated and the processing time is shortened at higher temperatures and, conversely, increased picture quality and improved stability of the processing baths can be achieved at lower temperatures. Furthermore, processes using hydrogen peroxide intensification or cobalt intensification as disclosed in West German Patent No. 2,226,770 or U.S. Pat. No. 3,674,499 can be carried out in order to economize on silver in the photosensitive material.

Furthermore, silver halide photosensitive materials of this invention can also be used as heat developable photosensitive materials as disclosed in U.S. Pat. No. 4,500,626, JP-A-No. 60-133449, JP-A-No. 59-218443 and JP-A-No. 61-238056, and in European Patent No. 210,660A2.

Color diffusion transfer photosensitive materials are another embodiment of the color photosensitive materials of this invention, including those described on pages 366 to 372 of *The Theory of the Photographic Process* (4th Edition) by James.

A photosensitive layer consisting of a silver halide emulsion layer which contains dye image forming substances, and an image receiving layer are included as the essential layers in the color diffusion transfer photosensitive materials of this invention, and other layers, such as layers which have a neutralizing function, light shielding layers, intermediate layers, protective layers, and peeling layers for facilitating the peeling off of the useless parts after processing can be included, as required.

A dispersion of a hydroquinone represented by the general formula (I) and a polymer represented by the general formula (II) of this invention can be included at any location in the photosensitive material, according to its intended purpose.

In one example, the dispersion is added as an anti-color turbidity agent to an intermediate layer, as described in *Research Disclosure,* No. 15162 (1976).

In this case, the amount of the hydroquinone compound represented by the general formula (I) added to the intermediate layer is within the range from 0.1 to 10 mmol per square meter, and preferably within the range from 0.3 to 5 mmol per square meter, and the amount of the polymer represented by the general formula (II}used is within the range from 0.1 to 20 grams per gram of hydroquinone compound, and preferably within the range from 0.1 to 10 grams, per gram of hydroquinone compound.

In another example, the dispersion is added to layers which are close to the emulsion layers (e.g., an adjacent layer, an adjacent layer to the adjacent layer) with a view to reducing the minimum density and raising the maximum density of the photograph. In this case the amount of the hydroquinone compound represented by the general formula (I) which is added is normally within the range from 0.001 to 0.1 mmol per square meter, and preferably within the range from 0.003 to 0.05 mmol per square meter, and the polymer represented by the general formula (II) is used at a rate within the range from 0.1 to 30 grams, and preferably within the range from 0.3 to 7 grams, per gram of hydroquinone compound.

(1) Dye Image Forming Substances

The dye image forming substances used in this invention are non-diffusible compound which release diffusible dyes (these may be dye precursors) or of which the diffusion properties are changed in the course of silver development, and such substances have been described in the fourth edition of *The Theory of the Photographic Process.* All of these compounds can be represented by the general formula (A) indicated below.

DYE-Y (A)

Here Dye represents a dye or a dye precursor, and Y represents a component which provides a compound which imparts different diffusion properties to the compound under alkaline conditions. The function of Y can be broadly classified as that of a negative type compound which becomes diffusible in the developed silver parts or that of the positive type which becomes diffusible in the undeveloped parts.

Specific examples of negative type Y components include those which are oxidized, undergo cleavage and release a diffusible dye during development.

Specific examples of Y have been disclosed in U.S. Pat. Nos. 3,928,312, 3,993,638, 4,076,529, 4,152,153, 4,055,428, 4,053,312, 4,198,235, 4,179,291, 4,149,892, 3,844,785, 3,443,943, 3,751,406, 3,443,939, 3,443,940, 3,628,952, 3,980,479, 4,183,753, 4,142,891, 4,278,750, 4,139,379, 4,218,368, 3,421,964, 4,199,355, 4,199,354, 4,135,929, 4,336,322 and 4,139,389, and in JP-A-No. 53-50736, JP-A-No. 51-104343, JP-A-No. 54-130122, JP-A-No. 53-110827, JP-A-No. 56-12642, JP-A-No. 56-16131, JP-A-No. 57-4043, JP-A-No. 57-650, JP-A-No. 57-20753, JP-A-No. 53-69033, JP-A-No. 54-130927, JP-A-No. 56-164342 and JP-A- No. 57-119345.

N-substituted sulfamoyl groups (with groups derived from an aromatic hydrocarbonyl ring or a heterocyclic ring as the N-substituent group) are preferred as Y groups for the negative type dye releasing redox compounds. Typical examples of such groups for Y are indicated below, but the group is not to be construed as being limited to these groups.

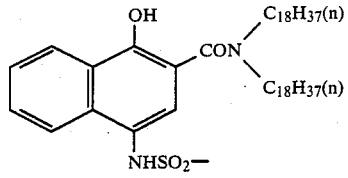

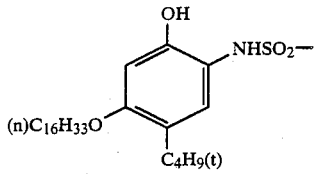

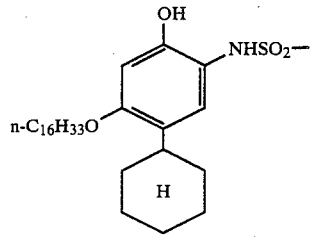

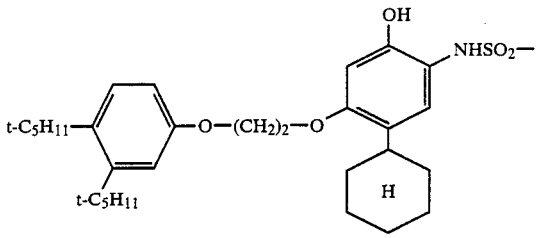

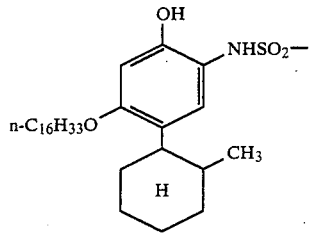

Disclosures concerning positive type compounds have been made in *Angev. Chem., Intl. Ed., (English),* 22, 191 (1982).

Specific examples include compounds (dye developers) which are initially diffusible under alkaline conditions but which are oxidized by development and rendered fast to diffusion. Typical examples of useful Y components for compounds of this type have been described in U.S. Pat. No. 2,983,606.

Furthermore, there are compounds of another type which release diffusible dyes on undergoing spontaneous ring closure under alkaline conditions. Specific examples of Y groups which have such a function have been disclosed in U.S. Pat. No. 3,980,479, in JP-A-No. 53-69033 and JP-A-No. 54-130927, and in U.S. Pat. Nos. 3,421,964 and 4,199,355.

Furthermore, there are also compounds of another type which do not themselves release a dye but which release a dye when reduced. Compounds of this type are used in combination with an electron donor and they are able to release an diffusible dye in the form of the image by reaction with the residual electron donor which has been oxidized in the form of the image by silver development. Atomic groups which have such a function have been disclosed, for example, in U.S. Pat. Nos. 4,183,753, 4,142,891, 4,278,750, 4,139,379 and 4,218,368, in JP-A-No. 53-110827, in U.S. Pat. Nos. 4,278,750, 4,356,249 and 4,358,525, in JP-A-No.110827, JP-A54-130927 and JP-A-No. 56-164342, in Kokai Giho No. 87-6199, and in European Patent No. 220,746A2.

Specific examples are indicated below, but the invention is not to be construed as being limited to these examples.

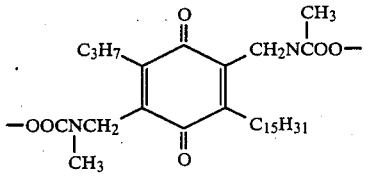

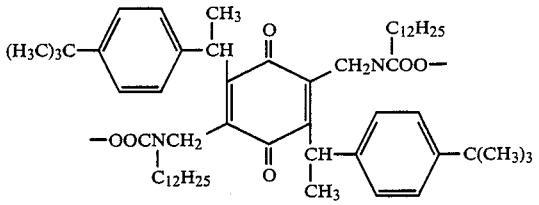

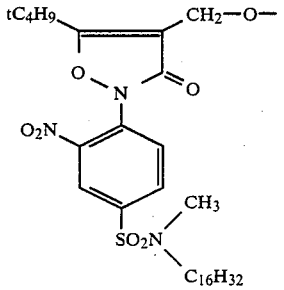

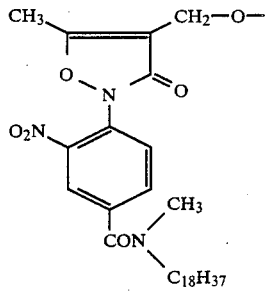

In cases where compounds of this type are used, they are preferably used in combination with a nondiffusible electron donor (commonly know as an ED compound) or precursor thereof. Examples of ED compounds have been disclosed, for example, in U.S. Pat. Nos. 4,263,393 and 4,278,750, and in JP-A-No. 56-138736.

Furthermore, the compounds indicated below can be used as examples of another type of dye image forming substance.

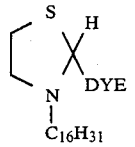

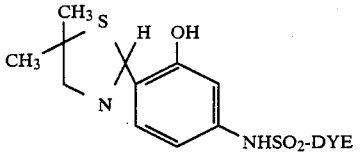

(In these formulae, DYE signifies a dye or a dye precursor as described earlier.)

These compounds have been disclosed in U.S. Pat. Nos. 3,719,489 and 4,098,783.

On the other hand, typical examples of the dyes represented by DYE in these formulae have been disclosed in the literature as indicated below.

Examples of Yellow Dyes:

Examples of yellow dyes have been disclosed in U.S. Pat. Nos. 3,597,200, 3,309,199, 4,013,633, 4,245,028, 4,156,609, 4,139,383, 4,195,992, 4,148,641, 4,148,643 and 4,336,322, in JP-A-No. 51-114930 and JP-A-No. 56-71072, and in *Research Disclosure,* 17630 (1978) and *Research Disclosure,* 16475 (1977).

Examples of Magenta Dyes:

Examples of magenta dyes have been disclosed in U.S. Pat. Nos. 3,453,107, 3,544,545, 3,932,380, 3,931,144, 3,932,308, 3,954,476, 4,233,237, 4,255,509, 4,250246, 4,142,891, 4,207,104 and 4,287,292, and in JP-A-No. 52-106727, JP-A-No. 53-23628, JP-A-No. 55-36804, JP-A-No. 56-73057, JP-A-No. 56-71060 and JP-A-No. 55-134.

Examples of Cyan Dyes:

Examples of Cyan dyes have been disclosed in U.S. Pat. Nos. 3,482,972, 3,929,760, 4,013,635, 4,268,625, 4,171,220, 4,242,435, 4,142,891, 4,195,994, 4,147,544 and 4,148,642, in British Patent Nos. 1,551,138, in JP-A-No. 54-99431, JP-A-No. 52-8827, JP-A-No. 53-47823, JP-A-No. 53-143323, JP-A-No. 54-99431 and JP-A-No. 56-71061, in European Patent Nos. 53,037B and 53,040B, and in *Research Disclosure,* Nos. 17630 (1978) and 16475 (1977).

(2) The Silver Halide Emulsion

The silver halide emulsion used in the invention may be a negative type emulsion in which the latent image is formed principally on the surface of the silver halide grains, or it may be a direct positive emulsion of the internal latent image type in which the latent image is formed within the silver halide grains.

"Conversion type" emulsions in which use is made of the difference in solubility of silver halides, or "core/-shell type" emulsions, in which at least photosensitive sites of core grains of silver halide which have been doped with metal ions, chemically sensitized or subjected to both metal doping and chemical sensitization, are covered with an outer shell of silver halide can be used as internal latent image type direct positive emulsions, and such emulsions have been disclosed in U.S. Pat. Nos. 2,592,250 and 3,206,313, in British Patent No.

1,027,146, in U.S. Pat. Nos. 3,761,276, 3,935,014, 3,447,927, 2,497,875, 2,563,785, 3,551,662 and 4,395,478, in West German Patent Application (OLS) No. 2,728,108, and in U.S. Pat. No. 4,431,730.

Furthermore, fogging nuclei must be provided on the surface of the grains using light or a nucleating agent after the imagewise exposure in cases where an internal latent image type direct positive emulsion is used.

Compounds which can be used as nucleating agents for this purpose include the hydrazines disclosed in U.S. Pat. Nos. 2,563,785 and 2,588,982, the hydrazides and hydrazones disclosed in U.S. Pat. No. 3,227,552, the heterocyclic quaternary salt compounds disclosed in British Patent No. 1,283,835, JP-A-No. 52-69613 and in U.S. Pat. Nos. 3,615,615, 3,719,494, 3,734,738, 4,094,683 and 4,115,122, the sensitizing dyes which have a substituent group which has a nucleating action within the dye molecule as disclosed in U.S. Pat. No. 3,718,470, the thiourea bond type acylhydrazine based compounds disclosed in U.S. Pat. Nos. 4,030,925, 4,031,127, 4,245,037, 4,255,511, 4,266,013 and 4,276,364, and in British Patent No. 2,012,443, etc., and the acylhydrazine based compounds which have a thioamido ring or a heterocyclic group such as a triazole or a tetrazole ring bonded as an absorbing group, as disclosed in U.S. Pat. Nos. 4,080,270 and 4,278,748, and in British Patent No. 2,011,391B.

Spectrally sensitizing dyes are used in combination with these negative type emulsions and internal latent image type direct positive emulsions in this invention. Examples have been disclosed in JP-A-No. 59-180550 and JP-A-No. 60-140335, *Research Disclosure*, No. 17029, U.S. Pat. Nos. 1,846,300, 2,078,233, 2,089,129, 2,165,338, 2,231,658, 2,917,516, 3,352,857, 3,411,916, 2,295,276, 2,481,698, 2,688,545,, 2,921,067, 3,282,933, 3,397,060, 3,660,103, 3,335,010, 3,352,680, 3,384,486, 3,623,881, 3,718,470 and 4,025,349.

(3) Photosensitive Material Layer Structure

At least two photosensitive layers consisting of emulsions which have been spectrally sensitized with the above mentioned spectrally sensitizing dyes (in combination with the abovementioned dye image forming substances which provide dyes which absorb light selectively in the same wavelength region) are used to reproduce natural colors using the substractive color process. The emulsions and the dye image forming substances can be coated on top of one another in separate layers or they may be mixed together and coated as a single layer. In cases where the dye image forming substance, in the coated form, has an absorbance in the spectrally sensitive region of the emulsion with which it is combined, the emulsion and the dye image forming substance are preferably coated in separate layers. The emulsion layers can consist of a plurality of emulsion layers which have different speeds and an optional layer may be established between the emulsion layer and the dye image forming substance layer. For example, a layer which contains a nucleation development accelerator as disclosed in JP-A-No. 60-173541, or a spacing layer as disclosed in JP-B-No. 60-15267 can be established in this position to increase the colored image density, or a reflective layer as disclosed in JP-A-No. 60-91354 can be established to increase the sensitivity of the sensitive element.

The preferred multi-layer structure has a sequential arrangement from the side which is exposed to light consisting of a unit which includes a blue sensitive emulsion, a unit which includes a green sensitive emulsion, and a unit which includes a red sensitive emulsion.

Other layers may be presented, as required, between these emulsion units. The provision of intermediate layers is especially desirable for preventing the results of the development of a certain layer having an undesirable effect on some other emulsion layer unit.

The intermediate layers, in cases where a developing agent is used in combination with a nondiffusible colored image forming substance, preferably contains a non-diffusible reducing agent for preventing the diffusion of the oxidized form of the developing agent. Examples include non-diffusible hydroquinones, sulfonamidophenols and sulfonamidonaphthols, and examples have been disclosed in JP-B-No. 50-21249 and JP-B-No. 50-23813, in JP-A-No. 49-106329, and JP-A-No. 49-129535, in U.S. Pat. Nos. 2,336,327, 2,360,290, 2,403,721, 2,544,640, 2,732,300, 2,782,659, 2,937,086, 3,637,393 and 3,700,453, in British Patent No. 557,750, and in JP-A-No. 57-24941 and JP-A-No. 58-21249. The dispersion method has been disclosed in JP-A-No. 60-238831 and JP-B-No. 60-18978.

In cases where the dispersion consisting of a combination of compound (I) and compound (II) of this invention is used in another layer, then a dispersion of these known reducing agents may be used in an intermediate layer but, as mentioned earlier, the use of a dispersion of the hydroquinone represented by compound (I) in a polymer represented by the compound (II) of this invention is preferred for markedly increasing the stability with the passage of time of the photosensitive material which is a principal objective of the invention.

In cases were compounds which release a diffusible dye with silver ions as disclosed in JP-B-No. 55-7576 are used, a compound which replenishes silver ion is preferably included in the intermediate layer.

Anti-irradiation layers, spacing layers, and protective layers may be coated, as required, in this invention.

(4) Processing Composition

The processing composition used in this embodiment of the invention is uniformly spread over, or impregnated into, the photosensitive element after exposure, and the development of the photosensitive layer is carried out by the components included in this composition. It may also have the function of shielding the photosensitive layer completely from external light, being provided, as required, on the back of the support or opposing a light shielding layer which is on the opposite side of the photosensitive layer from the processing liquid. Alkalis and developing agents, development accelerators and development inhibitors for adjusting development, antioxidants for preventing the deterioration of the developing agent and, as required, viscosity increasing agents and light shielding agents are included in these compositions.

The alkali is provided to adjust the pH of the liquid to from 10 to 14, and the alkali may be the hydroxide of an alkali metal (for example sodium hydroxide, potassium hydroxide, lithium hydroxide), an alkali metal phosphate (for example potassium phosphate), a guanidine, a quaternary amine hydroxide (for example tetramethylammonium hydroxide), and of these alkalis the use of potassium hydroxide and sodium hydroxide is preferred.

Examples of viscosity increasing agents include poly(vinyl alcohol), hydroxymethylcellulose, and alkali metal salts of carboxymethylcellulose, and the use of hydroxyethylcellulose and sodium carboxymethylcellulose is preferred.

All dyes and pigments can be used as light shielding agents provided that they do not diffuse into the dye image receiving layer and cause staining, and combinations of such dyes and pigments can be used. Carbon black is a typical light shielding agent, but titanium white and dye combinations can also be used for this purpose. Temporary light shielding dyes which become colorless after a fixed period of time during processing can also be used as light shielding dyes.

All developing agents can be used provided that they do not cause staining even when oxidized. Developing agents of this type can be used individually or two or more types can be used conjointly, and precursor types can also be used. These developing agents may be included in an appropriate layer of the photosensitive element or they may be included in the alkaline processing liquid. Specific compounds include the aminophenols and the pyrazolidinones, and of these the pyrazolidinones are preferred since they give rise to little staining.

Examples include 1-phenyl-3-pyrazolidinone, 1-p-tolyl-4,4-dihydroxymethyl-3-pyrazolidinone, 1-(3-'-methylphenyl)-4-methyl-4-hydroxymethyl-3-pyrazolidinone, 1-phenyl-4-methyl-4-hydroxymethyl-3-pyrazolidinone, and 1-p-tolyl-4-methyl-4-hydroxymethyl-3-pyrazoloidinone.

(5) Dye Image Receiving Layers

The dye image receiving layers used in this invention contain a mordant in a hydrophillic colloid. The dye image receiving layer may be a single layer or it may have a multi-layer construction in which mordants which have different mordanting capacities are coated in the form of a laminate. Such layers have been disclosed in JP-A-No. 61-252551. The use of polymeric mordants is preferred.

The polymeric mordants which can be used in the invention include polymers which contain secondary or tertiary amino groups, polymers which have nitrogen containing heterocyclic groups and polymers which contain quaternary cations thereof, and those which have a molecular weight of at least 5,000 are preferred while those which have a molecular weight of at least 10,000 are especially prefered.

For example, the vinylpyridine polymers and vinyl pyridinium cation polymers disclosed in the specifications of U.S. Pat. Nos. 2,548,564, 2,484,430, 3,148,061 and 3,756,814; the vinyl imidazolium cation polymers disclosed in the specification of U.S. Pat. No. 4,124,386; the polymeric mordants which can crosslink with gelatin as disclosed in the specifications of U.S. Pat. Nos. 3,625,694, 3,859,096 and 4,128,538 and in British Patent No. 1,277,453; the aqueous sol mordants disclosed in the specifications of U.S. Pat. Nos. 3,958,995, 2,721,852 and 2,798,063, and in JP-A-No. 54-115228, JP-A-No. 54-145529, JP-A-No. 54-126027, and JP-A-No. 54-155835 and JP-A-No. 56-17352; the water insoluble mordants disclosed in the specification of U.S. Pat. No. 3,898,088; the reactive mordants which can form covalent bonds with dyes as disclosed in the specifications of U.S. Pat. Nos. 4,168,976 and 4,201,840, ; and the mordants disclosed in the specifications of U.S. Pat. Nos. 3,709,690, 3,788,855, 3,642,482, 3,488,706, 3,557,066, 3,271,147 and 3,271,148, in JP-A-No. 53-30328, JP-A-No. 52-155528, JP-A53-125, JP-A-No. 53-1024 and JP-A-No. 53-107835, and in British Pat. No. 2,064,802 can be used for this purpose.

The mordants disclosed in the specifications of U.S. Pat. Nos. 2,675,316 and 2,882,156 can also be used for this purpose.

(6) Layers Which Have a Neutralizing Function

The layers which have a neutralizing function used in the invention are layers which contain a sufficient quantity of an acidic substance to neutralize the alkali which is carried over from the processing composition and, as required, these layers may have a multi-layer construction consisting of neutralization speed controlling layers (timing layers) and adhesion reinforcing layers. The preferred acidic substances contain an acidic group of pKa at least 9 (or a precursor group which provides such an acidic group on hydrolysis), and the more preferred substances include the higher fatty acids disclosed in U.S. Pat. No. 2,983,606, and polymers of acrylic acid, methacrylic acid or maleic acid and the partial esters or anhydrides thereof, such as those disclosed in U.S. Pat. No. 3,362,816; the acrylic acid-acrylic acid ester copolymers disclosed in French Patent No. 2,290,699, and the acidic polymers of the latex type as disclosed in U.S. Pat. No. 4,139,383 and in *Research Disclosure,* No. 16102 (1977).

Other acidic substances have been disclosed in U.S. Pat. No. 4,088,493, and in JP-A-No. 52-153739, JP-A-No. 53-1023, JP-A-No. 53-4540, JP-A-No. 53-4541, and JP-A-No. 53-4542.

Examples of acidic polymers include copolymers of ethylene and vinyl monomers such as vinyl acetate, vinyl methyl ether with maleic anhydride and n-butyl esters thereof; copolymers of butyl acrylate and acrylic acid, and cellulose acetate hydrodiene phthalate.

The aforementioned acidic polymers can be mixed with, and used with, hydrophilic polymers. Polymers of this type include polyacrylamide, polymethylpyrrolidone, poly(vinyl alcohol) (including partially saponified polymers), carboxymethylcellulose, hydroxymethylcellulose, hydroxyethylcellulose, poly(methyl vinyl ether). Of these, the use of poly(vinyl alcohol) is preferred.

The amount of the acidic polymer coated is determined by the amount of alkali which is being spread over the photosensitive element. The equivalent ratio of acidic polymer and alkali per unit area is preferably from 0.9 to 2.0. If the amount of acidic polymer used is too small then the hue of the transfer element may vary and staining may occur in the white base parts, and if too much is used then changes may occur in the hue and there is a further problem in that light fastness is reduced. The more desirable equivalent ratio is from 1.0 to 1.3. The quality of the photograph is reduced if either too much or too little of the admixed hydrophilic polymer is used. The ratio by weight of the hydrophilic polymer and the acidic polymer is within the range from 0.1 to 10, and preferably within the range from 0.3 to 3.0.

Additive for various purposes can be incorporated into the layer which has a neutralizing function in this invention. For example, film hardening agents well known to those in the industry can be added for hardening the film of this layer, and polyhydric hydroxyl compounds such as poly(ethylene glycol), poly(propylene glycol), and glycerine, can be added to improve the brittleness of the film. Moreover, antioxidants, fluorescent whiteners, and dyes such as ultramarine, can also be added, as required.

The timing layers which are used in combination with neutralizing layers consist of a polymer which has a low alkali permeability, such as gelatin, poly(vinyl alcohol), partially acetalated poly(vinyl alcohol), cellulose acetate, a partially hydrolyzed poly(vinyl acetate); latex polymers which have a high activation energy for alkali premeation made by copolymerizing small amount of hydrophilic comonomers such as acrylic acid monomer; or polymers which have a lactone ring.

Of these, the timing layers in which cellulose acetate is used as disclosed in JP-A-No. 54-136328 and in U.S. Pat. Nos. 4,267,262, 4,009,030 and 4,029,849, the latex polymers made by copolymerization with a small amount of hydrophilic copolymer such as acrylic acid as disclosed in JP-A-No. 54-128335, JP-A-No. 56-69629 and JP-A-No. 57-6843, and in U.S. Pat. Nos. 4,056,394, 4,061,496, 4,199,362, 4,250,243, 4,256,827 and 4,268,604; polymers which have lactone rings as disclosed in U.S. Pat. No. 4,229,516; and the other polymers disclosed in JP-A-No. 56-25735, JP-A-No. 56-97346 and JP-A-No. 57-6842, and in European Patent 31,957Al, 37,724Al and 48,412Al are especially useful.

Other materials which above been cited in the publications indicated below can also be used.

U.S. Pat. Nos. 3,421,893, 3,455,686, 3,575,701, 3,778,265, 3,785,815, 3,847,615, 4,088,493, 4,123,275, 4,148,653, 4,201,587, 4,288,523 and 4,297,431, West German Patent Application (OLS) Nos. 1,622,936 and 2,162,277, and *Research Disclosure,* 15162, No. 151 (1976).

The timing layers in which these materials are used be a single layer, or two or more layers can be used conjointly.

The development inhibitors and/or precursors thereof disclosed in U.S. Pat. No. 4,009,029, in West German Patent Application (OLS) Nos. 2,913,164, and 3,014,672, and in JP-A-No. 54-155837 and JP-A-No. 55-138745, the hydroquinone precursors disclosed in U.S. Pat. No. 4,201,578, and other photographically useful additives or precursors thereof can be incorporated, for example, in the timing layers consisting of these materials.

(7) Light Shielding Layers

In this invention, processing can be carried out in daylight by shielding the photosensitive layer from external light completely during the development process with light shielding layers within the photosensitive element or by means of a light shielding layer and a light shielding processing liquid which is spread over the photosensitive element during processing. In practice, a layer which contains a light shielding agent can be coated on the back of the support or between the emulsion layer and the support, or a layer which contains a light shielding agent can be provided in the support. Any material which has a light shielding function can be used as a light shielding agent, but the use of carbon black is preferred.

Any binder in which carbon black can be dispersed can be used as the binder for coating the light shielding agent, and the use of gelatin is preferred.

(8) Peeling Layer

In one embodiment of the color diffusion transfer photosensitive materials of this invention a peeling layer is established between the dye image receiving layer and the emulsion layers which contain the dye image forming substances, and the emulsion layer can be peeled away after processing. Hence, in the unprocessed state the peeling layer must maintain the adhesion between the image receiving layer and the emulsion layer and it must be such that peeling apart can be achieved easily after processing. The materials disclosed, for example, in JP-A-No. 47-8237, JP-A-No. 59-202727, JP-A-No. 59-229555, and JP-A-No. 49-4653, in U.S. Pat. Nos. 3,220,835 and 4,359,518, in JP-A-No. 59-4334, JP-A-No. 56-65133 and JP-A-No. 45-24075, and in U.S. Pat. Nos. 3,227,550, 2,759,825, 4,401,746 and 4,366,227, can be used for this purpose. Water soluble (or alkali soluble) cellulose derivatives are examples of such materials. For example, use can be made of hydroxyethylcellulose, cellulose acetate phthalate, plasticized methyl cellulose, ethyl cellulose, cellulose nitrate, and carboxymethylcellulose. Alternatively, use can be made of various natural macromolecular materials, such as for example, alginic acid, pectin, and gum arabic. Various modified gelatins, for example acetylated gelatin, phthalated gelatin, can also be used. Moreover, another alternative is to use water soluble synthetic polymers. Examples of such polymers include poly(vinyl alcohol), poly(methylacrylate), poly(methyl methacrylate), poly(butyl methacrylate), or copolymers of these materials.

The peeling layer may consist of a single layer or it may consist of a plurality of layers, and examples have been disclosed in JP-A-No. 59-220727 and JP-A-No. 60-60642.

In the color diffusion transfer method of this invention the photosensitive layer can be coated on the same support on which the image receiving layer has been coated, or the two layers may be coated on separate supports.

Furthermore, the supports which include these photosensitive layers and image receiving layers may be combined in a unified film unit, or they may be provided separately, in which case they are laminated together at the time of development and processing. The photosensitive layer and the image receiving layer may be left in a unified form after development and processing, or the photosensitive layer may be separated from the image receiving layer after processing.

The processing fluid may be packed into a processing liquid pod and spread out uniformly over the photosensitive layer using a pressure part after exposure, or the sheet which contains the photosensitive layer may be moistened with the processing liquid so as to impregnate the photosensitive layer. In a typical embodiment of a unified type film unit, the above mentioned dye image receiving layer and the silver halide photographic emulsion layer in which the dye releasing redox compounds are combined are laminated onto a single transparent support, and a white reflecting layer which contains a solid pigment such as titanium oxide is coated between the image receiving layer and the silver halide layer or the dye releasing redox compound containing layer. In such an embodiment there is no need to peel off the image receiving layer after completion of the transfer picture, as the transfer image can be viewed through the transparent support. A light shielding layer may also be provided between the white reflecting layer and the photosensitive silver halide layer so that the development processing can be completed in the dark. Furthermore, a peeling layer may be established at a suitable position so that all or part of the photosensitive element can be peeled away from the image receiving element, as required (such embodiments have been disclosed, for example, in JP-A-No. 56-67840 and in Canadian Patent No. 674,082).

Furthermore, with separate non-peeling type unified film units the image receiving element is coated onto one transparent support and a processing liquid which contains a white pigment is coated between this and a separate sheet on which the photosensitive element has been coated. Embodiments in which an image receiving element, a white reflecting layer, a peeling layer and a photosensitive element have been laminated onto the same support, so that the photosensitive element may be peeled away from the image receiving element, have been disclosed in U.S. Pat. No. 3,730,718.

Moreover, the use of unified film unit consisting of a photosensitive element which has a sequence of at least (a) a dye image receiving layer, (b) a peeling layer and (c) at least one silver halide emulsion layer in which a dye releasing redox compound is included, an alkali processing composition which contains an agent which renders.. it non-transparent, and a transparent cover sheet, on a white support, and from which the unwanted parts above the peeling layer are removed to leave the image receiving layer on the white support after processing is preferred in this invention.

Furthermore, embodiments of the peel apart type in which a photosensitive sheet for which at least a photosensitive layer has been coated on a support is laminated, after exposure, on a separate support which have been coated with an image receiving layer, an alkaline processing composition being spread between the layers, and in which the image receiving sheet is peeled away after development processing can also be used.

Another useful embodiment of a photosensitive material is that in which the photosensitive sheet obtained by coating a photosensitive layer onto a transparent support, establishing a white reflecting layer over the top, and laminating an image receiving layer on the top of this is, after exposure, moistened with developing liquid. The image receiving layer is viewed with the white support as a background.

Heat developable photosensitive elements of this invention include those which contain photosensitive silver halides, binders, dye donating compounds and reducing agents (in some cases the dye donating compounds are also reducing agents) and, moreover, they may contain an organic silver salt, as required. These components are often added to the same layer, but they may be added to separate layers provided that a reaction can occur. For example, the presence of a colored dye donating compound in a layer below the silver halide emulsion prevents any loss of speed.

A combination of least three silver halide emulsion layers which are sensitive to different regions of the spectrum are used in order to obtain a wide range of colors on the chromaticity diagram using the three primary colors yellow, magenta and cyan. For example, combinations of a blue sensitive layer, a green sensitive layer and a red sensitive layer; or a combination of a green sensitive layer, a red sensitive layer and an infrared sensitive layer, can be used. The photosensitive layers can be arranged in the various known sequences used for conventional color photosensitive materials. Furthermore, each of the photosensitive layers may be divided, as required, into two or more layers.

Various auxiliary layers, such as protective layers, undercoating layers, intermediate layers, yellow filter layers, anti-halation layers, and backing layers, can be established in a heat developable photosensitive element.

Any of the silver halides, namely silver chloride, silver bromide or silver chlorobromide, silver chloroiodide, silver iodobromide or silver chloroiodobromide, can be used in this invention.

The silver halide emulsions used in the invention may be surface latent image type emulsions or internal latent image type emulsions. Internal latent image type emulsions can be combined with nucleating agents or light fogging and used as direct reversal emulsions. Furthermore, core/shell emulsions in which the interior of the grain and the grain surface layer consist of different phases can be used. No particular limitations are imposed upon the degree of dispersion of the silver halide emulsion, crystal habit, grain size, or the method of chemical sensitization etc.

The coated weight of photosensitive silver halide used in the invention is within the range, calculated as silver, of from 1 mg to 10 grams per square meter.

Organic silver salts can be used conjointly as oxidizing agents with the photosensitive silver halides in this invention. In such a case the photosensitive in silver halide and the organic silver salt must be in a state of contact or in close proximity.

The organic silver salts are used at a rate of from 0.01 to 10 mol, and preferably at a rate of from 0.10 to 1 mol, per mol of photosensitive silver halide. The total coated weight of photosensitive silver halide and organic silver salt, calculated as silver, is suitably within the range from 50 mg to 10 grams per square meter.

Various anti-fogging agents or photographic stabilizers can be used in this invention. The silver halides used in the invention may be spectrally sensitized using methine dyes or other dyes. The sensitizing dyes may be used in combinations to achieve strong color sensitization. Furthermore, combinations with compounds other than spectrally sensitizing dyes can be used to achieve strong color sensitization.

The amount of sensitizing dye added is generally on the order of from $10^{-8}$ to $10^{-2}$ mol per mol of silver halide.

The use of hydrophilic binders is preferred in heat developable photosensitive elements of this invention. Transparent or semi-transparent hydrophilic binders include, for example, natural products such as proteins, such as gelatin and gelatin derivatives, or sugars such as cellulose derivatives, starch, gum arabic, and synthetic polymeric materials such as water soluble polyvinyl compounds, such as poly(vinyl alcohol), polyvinylpyrrolidone, partially saponified copolymers of vinyl alcohol and acrylic acid, and acrylamide polymers. Combinations of two or more types of these binders can be used. Furthermore, these binders can be added and used in the form of a latex, and dispersed vinyl compounds can be used to provide dimensional stability in the photographic material.

The coated weight of the binders in this invention is preferably not more than 20 grams per square meter, and more desirably the coated weight is not more than 10 grams per square meter, and their use at a coated weight of not more than 7 grams per square meter is most desirable.

Examples of dye donating compounds which can be used in the invention include first of all the compounds (couplers) which form dyes by an oxidative coupling reaction. These couplers may be of the four-equivalent type or of the two-equivalent type.

Furthermore, the two-equivalent couplers (including polymeric couplers) which have groups which are fast to diffusion on the elimination group and which form a diffusible dye by means of an oxidative coupling reaction are preferred.

Furthermore, the compounds which have the function of releasing and dispersing a dispersible dye in an imagewise manner can be cited as another example of dye donating substances. Compounds of this type can be represented by the following general formula (LI)

$$(\text{Dye-X})_{n-Y} \qquad \text{(LI)}$$

Here, Dye represents a dye group, a dye group which has been temporarily shifted to short wavelength, or a dye precursor group; X represents a simple bond or a divalent linking group; Y represents a group which provides a difference in the diffusion properties of the compound $(\text{Dye-X})_{n-Y}$, or releases Dye and produces a difference in the dispersion properties of the released Dye and $(\text{Dye-X})_{n-Y}$, corresponding directly or inversely to the photosensitive silver salts which have an imagewise latent image; n represents 1 or 2, and when n is 2 then the two Dye-X units may be the same or different.

Examples of dye donating substances which can be represented by the general formula (LI) include, for example, dye developing agents, non-diffusible compounds which release diffusible dyes by means of an intramolecular nucleophilic substitution reaction, non-diffusible compounds which release diffusible dyes by means of an intramolecular substitution reaction of an iso-oxazolone ring, non-diffusible compounds which release diffusible dyes on reduction, as disclosed in U.S. Pat. Nos. 4,503,137 and 4,559,290, in European Patent No. 220,746A, and in Kokai Giho No. 87-6199 (Vol. 12 to 22), non-diffusible compounds which release a diffusible dye on reaction with a base but with which essentially no dye release occurs on reaction with the oxidized form of a reducing agent (LDA compounds), non-diffusible compounds which are couplers which have a diffusible dye as an elimination group and which release the diffusible dye by means of a reaction with the oxidized form of a reducing agent (DDR couplers), and non-diffusible compounds which themselves have reducing properties and which release a diffusible dye when oxidized (DRR compounds).

Moreover, dye-silver compounds in which a dye is bonded to an organic silver salt, and azo dyes which are used in the heat developable silver dye bleach method can be used as dye donating compounds as well as the above mentioned couplers and compounds of general formula (LI).

Hydrophobic additives such as the above mentioned dye donating compounds and the image formation accelerators described hereinafter can be introduced into the layers of a photosensitive element using methods known in the industry, such as the oil protection method, the solid dispersion method and the polymer dispersion method.

The reducing agents known in the field of heat developable photosensitive materials can be used in this invention. Furthermore, dye donating compounds which have reducing properties can also be included (in this case other reducing agents can be used conjointly). Furthermore, reducing agent precursors which themselves have no reducing properties but which acquire reducing properties as a result of the action of nucleophillic reagents or heat during the course of development can also be used.

The amount of reducing agent added in this invention is from 0.10 to 20 mol, and more desirably from 0.1 to 10 mol, per mol of silver.

Compounds which activate development and which, at the same time, stabilize the image can be used in the photosensitive elements in this invention.

A dye fixing element can be used together with a photosensitive element in systems in which the image is formed by dye diffusion transfer. There are embodiments in which the dye fixing element and the photosensitive element are coated separately on separate supports, and embodiments in which the dye fixing layer and the photosensitive layer are coated on the same support. Column 57 of U.S. Pat. No. 4,500,626, for example, describes the relationship between he photosensitive element and the dye fixing element, the relationship to the supports, and the relationship to the white reflecting layers in this application.

The dye fixing elements preferably used in the invention have at least one layer which contains a mordant and a binder. The mordants well known in the photographic field can be used for the mordant. Furthermore, polymeric compounds which have a high dye receptivity can also be used for this purpose.

Auxiliary layers such as protective layers, peeling layers, and anti-curl layers, can be established, as required, in the dye fixing elements. The establishment of protective layers is especially useful.

The same natural and synthetic polymer materials used as binders in the photosensitive elements can be used as binders in the structural layers of the dye fixing elements.

Heat solvents, plasticizers, anti-color fading agents, ultraviolet absorbers, slip agents, matting agents, antioxidants, dispersed vinyl compounds for providing increased dimensional stability, surfactants, and fluorescent whiteners, can also be included in one, or in a plurality, of the structural layers of the photosensitive elements and dye fixing elements.

Image formation accelerators can be used in the photosensitive elements and/or dye fixing elements in this invention. The image formation accelerators have the function of accelerating the redox reaction of silver salt oxidizing agent and reducing agents, accelerating the reactions such as the formation of a dye from a dye donating substance, the degradation of a dye or the release of a non-diffusible dye, and of accelerating the migration of the dyes from the photosensitive layer to the dye fixing layer, and they may be classified as bases or base precursors, nucleating compounds, high boiling point organic solvents (oils), heat solvents, surfactants, compounds which interact with silver or silver ions, according to their physical and chemical properties. However, this group of compounds generally have a composite function and they normally provide a number of the acceleration effects indicated above.

Organic acids and the salts of bases which decarboxylate on heating, and compound which release amines by means of an intramolecular nucleophilic substitution reaction, a Lossen rearrangement or a Beckmann rearrangement, can be used as base precursors.

Moreover, compounds which produce bases electrolytically or by combination with compounds (called complex forming compounds) which can undergo a complex forming reaction with sparingly soluble metal compounds and the metal ions which form these sparingly soluble metal compounds can also be used as base precursors. In particular, the former is effective. The sparingly soluble metal compounds and complex forming compounds are usefully added to the photosensitive elements and the dye fixing elements respectively.

Various development inhibitors can be added to the photosensitive elements and/or dye fixing elements of this invention for obtaining a fixed picture quality irrespective of variations of the temperature during development and the processing time.

Inorganic or organic film hardening agents can also be included in the structural layers (photographic emulsion layers, dye fixing layers) of the photosensitive elements and/or dye fixing elements of this invention.

The heating temperature in the heat development process can be between about 50° C. and about 250° C., but the use of a developing temperature within the range from about 80° C. to about 180° C. is preferred. The dye diffusion transfer process may be carried out at the same time as heat development, or it may be carried out after completion of the heat development process. In the latter case, the heating temperature in the transfer process is that at which transfer can be achieved within the range from the temperature used in the heat development process to room temperature, but the use of a temperature of at least 50° C. and up to a temperature about 10° C. lower than the temperature during the heat development process is preferred.

The transfer of the dyes can be achieved using heat alone, or dye transfer promoters can be used to accelerate the dye transfer.

Furthermore, the methods in which the materials are heated in the presence- of a small quantity of solvent (especially water) and in which development and transfer are carried out simultaneously or consecutively as described in detail in JP-A-No. 59-218443 and JP-A-No. 61-238056, can also be used. In this method the heating temperature is preferably at least 50° C. but below the boiling point of the solvent. The methods in which these solvents are applied to the dye fixing element, to the photosensitive element, or to both of these elements can be used. The amount of solvents used is small being less than the amount of solvent corresponding to the maximum swelling volume of the whole coated layer (more precisely, an amount less than the amount obtained by subtracting the weight of the whole coated film from the weight of solvent corresponding to the maximum swelling volume of the whole coated film).

The heating during the development and/or transfer processes can be achieved using a hot plate, an iron, or a hot roller, or alternatively the heating can be achieved by passing electricity through an electrically conductive layer which has been established within the photosensitive element or the dye fixing element.

Any of the various types of heat developing apparatus can be used for processing the photographic elements of this invention. For example, use can be made of the apparatus disclosed in JP-A-No. 59-75247, JP-A-59-177547, JP-A-No. 59-181353 or JP-A-No. 60-18951, or in JP-A-No. U-62-25944 (the term "JP-A-No. U" as used herein means an "unexamined published Japanese utility model application).

The various additives disclosed in JP-A-No. 62-253159 can be used in this invention, as summarized in the following table.

| | JP-A-62-253159 |
|---|---|
| Silver halide emulsions | Page 13 to Page 15 |
| Protective colloids | Page 15 |
| Chemical sensitizing agents | Page 15 to Page 16 |
| Anti-fogging agents | Page 16 to Page 17 |
| Sensitizing dyes | Page 17 to Page 18 |
| Organic silver salts | Page 18 to Page 19 |
| Dye donating compounds | Page 19 to Page 24 |
| Hydrophobic additive dispersion methods | Page 24 to Page 26 |
| Reducing agents | Page 26 |
| Binders | Page 26 to Page 28 |
| Film hardening agents | Page 28 to Page 29 |
| Supports | Page 29 to Page 31 |
| Image formation accelerators | Page 31 |
| Development stoppers | Page 31 to Page 32 |
| Surfactants | Page 32 to Page 33 |
| Matting agents, oil droplets, slip agents | Page 33 to Page 35 |
| Anti-color fading agents, ultraviolet absorbers | Page 35 to Page 38 |
| Mordants | Page 40 to Page 48 |
| Dye migration promoters | Page 48 to Page 49 |

EXAMPLES

The invention is described in greater detail with reference to specific examples, but the invention is not to be construed as being limited by these examples. Unless otherwise indicated, all parts, percents and ratios are by weight.

EXAMPLE 1

(Stability with the Passage of Time Tests)

The Image receiving sheet, the photosensitive sheet A and the processing liquid of which the structures and composition are indicated below were prepared.

Image Receiving Sheet

Paper Support:

Paper of thickness 150 μm laminated with polyethylene of 30 μm thickness on both sides. Titanium oxide was added to and dispersed in the polyethylene on the side of the image receiving layer in an amount of by weight with respect to the polyethylene.

Back Side:

A light shielding layer consisting of 4.0 g/m$^2$ of carbon black and 2.0 g/m$^2$ of gelatin.

(b) A white layer consisting of 8.0 g/m$^2$ of titanium oxide and 1.0 g/m$^2$ of gelatin.

(c) A protective layer consisting of 0.6 g/m$^2$ of gelatin

The layers (a) to (c) wee coated sequentially. Light Receiving Layer Side:

(1) A neutralizing layer containing 22 g/m$^2$ of acrylic acid/butyl acrylate (mol ratio 8:2) copolymer of average molecular weight 50,000.

(2) A neutralization timing layer containing 4.5 g/m$^2$ of a mixture in the proportions by weight of 95:5 of cellulose acetate with a degree of acetylation of 51.3% (0.513 grams of acetic acid released by hydrolysis per 1 gram of sample) and styrene/maleic anhydride (mol ratio 1:1) copolymer of average molecular weight about 10,000.

(3) A layer containing a blend in the proportions, as solid fraction, of 6:4, of a polymer latex obtained by the emulsion polymerization of styrene/butyl acrylate/acrylic acid/N-methylolacrylamide in proportions by weight of 49.7/52.3/4/4 and a polymer latex obtained by the emulsion polymerization of methyl methacrylate/acrylic acid/N-methylolacrylamide in the proportions by weight of 93/3/4, the total solids content of the layer being 1.6 g/m$^2$.

(4) An image receiving layer coated using 3.0 g/m$^2$ of the polymer indicated below and 3.0 g/m$^2$ of gelatin with the compound indicated below as a coating promoter.

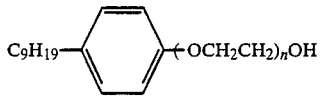

(n = 30)

Polymer:

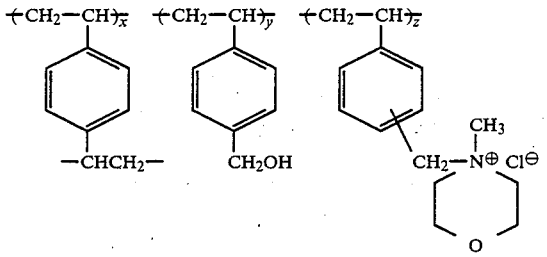

x:y:z = 5:5:90
(molecular wt)

Photosensitive Sheet

The photosensitive sheet was prepared by coating each of the following layers on a transparent poly(ethylene terephthalate) support.

Backing Side:

(a) A light shielding layer containing of 4.0 g/m$^2$ of carbon black and 2.0 g/m$^2$ of gelatin.

Emulsion Layer Side:

(1) A layer containing 0.44 g/m$^2$ of the carbon dye releasing redox compound indicated below, 0.09 g/m$^2$ of tricyclohexyl phosphate, 0.008 g/m$^2$ of 2,5-di-tert-pentadecyhydroquinone and 0.8 g/m$^2$ of gelatin.

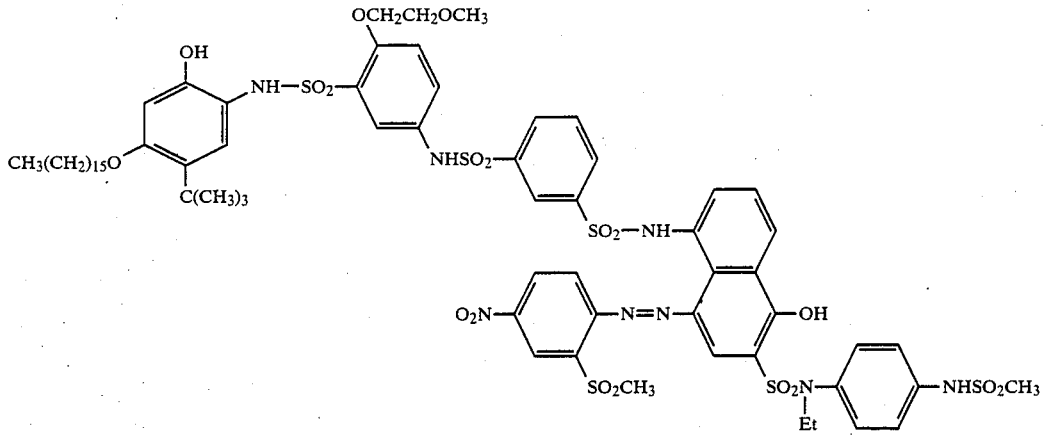

(2) A red sensitive emulsion layer containing a red sensitive internal latent image type direct positive silver bromide emulsion (1.03 g/m$^2$ as silver, 1.2 g/m$^2$ of gelatin), 0.04 mg/m$^2$ of the nucleating agent indicated below, and 0.13 sodium salt.

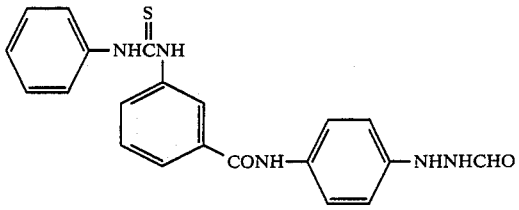

(3) An intermediate layer containing a dispersion obtained by dissolving compound I-(25) (0.4 g/m$^2$) and compound II-(1) (0.6 g/m$^2$) as disclosed herein as compounds of the invention in ethyl acetate and dispersing the solution in gelatin.

(4) A layer containing a magenta dye releasing redox compound of which the structural formula is indicated below (0.5 g/m$^2$), tricyclohexyl phosphate (0.08 g/m$^2$), 2,5-di-tert-pentadecylhydroquinone (0.009 g/m$^2$) and gelatin (0.9 g/m$^2$)

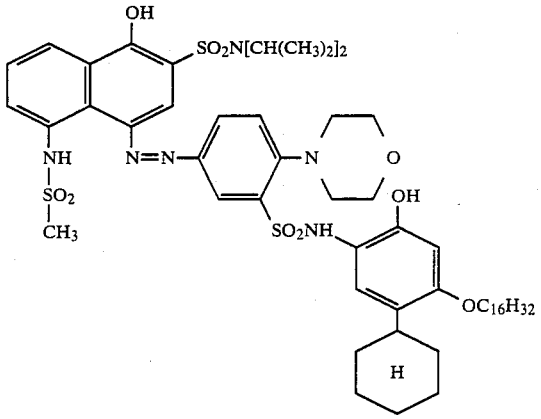

(5) A green sensitive emulsion layer containing a green sensitive internal latent image type direct positive silver bromide emulsion (0.82 g/m$^2$ as silver, 0.9 g/m$^2$ of gelatin), the same nucleating agent as in layer (2) (0.03 mg/m$^2$) and 2-sulfo-5-n-pentadecylhydroquinone, sodium salt (0.08 g/m$^2$).

(6) A layer the same as layer (3)

(7) A layer containing a yellow dye releasing redox compound of which the structure is indicated below (0.53 g/m$^2$), tricyclohexyl phosphate (0.13 g/m$^2$), 2,5-di-tert-pentadecylhydroquinone (0.014 g/m$^2$) and gelatin (0.7 g/m$^2$).

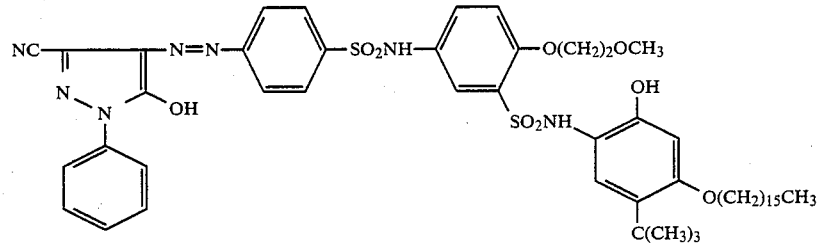

(8) A blue sensitive emulsion layer containing a blue sensitive internal latent image type direct positive silver bromide emulsion (1.09 g/m$^2$ as silver, 1.1 g/m2 of gelatin), the same nucleating agent as in layer (2) (0.04 mg/m2) and b-sulfo-5-n-pentadecylhydroquinone, sodium salt (0.07 g/m$^2$).

(9) An ultraviolet absorbing layer containing $4\times10^{-4}$ mol/m$^2$ of each of the ultraviolet absorbers indicated below and 0.5 g/m$^2$ of gelatin.

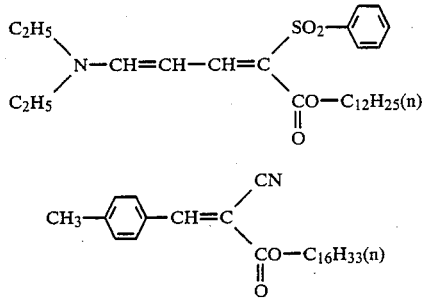

(10) A protective layer containing 1.0 g/m$^2$ of gelatin.

Processing Liquid

| Processing Liquid | |
|---|---|
| 1-m-Tolyl-4-hydroxymethyl-4-methyl-3-pyrazolidone | 10 grams |
| 1-Phenyl-4-hydroxymethyl-4-methyl-3-pyrazolidone | 4 grams |
| 5-Methyl-benzotriazole | 6 grams |
| Potassium sulfite | 8 grams |
| Hydroxyethyl cellulose | 45 grams |
| Potassium hydroxide | 64 grams |
| Benzyl alcohol | 3.4 grams |
| Water to make up to a total weight of 1 kg. | |

Furthermore, photosensitive sheet B was prepared in the same way as photosensitive sheet A except that compound I-(25) in layer (3) was replaced by compound I-(6) (0.65 g/m$^2$) and 0.35 g/m$^2$ of compound II-(1) was used, and photosensitive sheet C was prepared in the same way as photosensitive sheet A except that compound I-(24) (0.42 g/m$^2$) and compound II-(9) (0.4 g/m$^2$) were used.

Furthermore, for reference, photosensitive sheet D was prepared by replacing compound II-(1) in photosensitive sheet A with tricyclohexyl phosphate in a same amount, photosensitive sheet E was prepared by replacing compound II-(1) in photosensitive sheet B with poly(methyl methacrylate) in a same amount, and photosensitive sheet F was prepared by replacing compound II-(9) in photosensitive sheet C with poly(vinyl pyrrolidone) in a same amount.

These photosensitive sheets were left to stand for a fixed period of time under forced conditions and then exposed and laminated with an image receiving sheet in order to investigate stability with the passage of time of the photosensitive sheets.

Next, the viscous processing liquid in a processing liquid pod was spread to a thickness of 65 μm between the above mentioned photosensitive sheets and image receiving sheets using a pressure roller.

The sensitometric results obtained were as shown in Table 1.

With photosensitive sheet D which contained an oil dispersed hydroquinone compound the color density obtained was inadequate and there was a marked lowering of density with the passage of time. With photosensitive sheet E in which poly(methyl methacrylate) was used as disclosed in JP-A-56-125738 and photosensitive sheet F in which poly(vinyl pyrrolidone) was used as disclosed in JP-A- 55-144239 there was a fairly good effect, but the storage properties with the passage of time were still inadequate. In photosensitive elements A, B and C in which combinations of hydroquinone derivatives and polymers of this invention were used, an adequate color density was obtained in each case and the anti-color mixing performance was satisfactory and there was a great improvement in the lowering of density with the passage of time.

TABLE 1

| | Before Storage | | | | | | After Storage for 3 days at 45° C./80% RH | | | | | | After Storage for 3 Days at 60° C./20% RH | | | | | |
|---|---|---|---|---|---|---|---|---|---|---|---|---|---|---|---|---|---|---|
| | Max. density | | | Min. Density | | | Max. density | | | Min. Density | | | Max. density | | | Min. Density | | |
| | B | G | R | B | G | R | B | G | R | B | G | R | B | G | R | B | G | R |
| A (Invention) | 2.00 | 2.41 | 2.62 | 0.23 | 0.12 | 0.21 | 1.91 | 2.31 | 2.55 | 0.22 | 0.12 | 0.20 | 1.95 | 2.35 | 2.56 | 0.24 | 0.13 | 0.22 |
| B (Invention) | 2.01 | 2.35 | 2.58 | 0.22 | 0.12 | 0.21 | 1.93 | 2.20 | 2.46 | 0.22 | 0.13 | 0.21 | 2.00 | 2.31 | 2.50 | 0.24 | 0.12 | 0.21 |
| C (Invention) | 2.06 | 2.45 | 2.63 | 0.23 | 0.13 | 0.21 | 2.01 | 2.32 | 2.56 | 0.23 | 0.13 | 0.21 | 2.02 | 2.40 | 2.61 | 0.25 | 0.13 | 0.21 |
| Comparison | | | | | | | | | | | | | | | | | | |
| D | 1.83 | 1.1 | 1.32 | 0.24 | 0.13 | 0.22 | 1.56 | 0.62 | 0.73 | 0.25 | 0.15 | 0.25 | 1.75 | 0.95 | 1.10 | 0.27 | 0.13 | 0.23 |
| E | 2.03 | 2.43 | 2.50 | 0.22 | 0.12 | 0.20 | 1.88 | 1.11 | 1.02 | 0.23 | 0.13 | 0.21 | 1.91 | 2.25 | 2.35 | 0.23 | 0.12 | 0.21 |

TABLE 1-continued

| | Before Storage | | | | | | After Storage for 3 days at 45° C./80% RH | | | | | | After Storage for 3 Days at 60° C./20% RH | | | | | |
|---|---|---|---|---|---|---|---|---|---|---|---|---|---|---|---|---|---|---|
| | Max. density | | | Min. Density | | | Max. density | | | Min. Density | | | Max. density | | | Min. Density | | |
| | B | G | R | B | G | R | B | G | R | B | G | R | B | G | R | B | G | R |
| F | 2.02 | 2.41 | 2.51 | 0.23 | 0.12 | 0.21 | 1.96 | 1.98 | 2.21 | 0.23 | 0.12 | 0.23 | 1.97 | 2.31 | 2.41 | 0.24 | 0.12 | 0.21 |

EXAMPLE 2

(Improvement of Interlayer Adhesion)

A carbon black layer (3.0 g/m$^2$ of carbon black and 4.5 g/m$^2$ of gelatin) and a titanium white layer (3.0 g/m$^2$ of titanium white and 1.0 g/m$^2$ of gelatin) were sequentially coated as light shielding layer on the back of a polyethyleneterephthalate support which contained titanium white as a white pigment.

The following layers were then coated sequentially on the opposite side of the support to light shielding layers to provide a photosensitive sheet.

(1) A neutralizing layer containing 4.0 g/m$^2$ of poly(acrylic acid), 4.0 g/m$^2$ of poly(vinyl alcohol) and 0.04 g/m$^2$ of 1,4-bis(2,3-epoxypropoxy)butane.

(2) A timing layer containing 6 g/m$^2$ of cellulose acetate which had a degree of acetylation of 55% and a methyl vinyl ether/maleic anhydride (mol ratio 1:1) copolymer in proportions by weight of 95:5.

(3) An adhesion reinforcing layer containing 0.4 g/m$^2$ of hydroxyethyl methacrylate.

(4) A layer containing a blend of a polymer latex obtained by the emulsion polymerization of styrene/butyl acrylate/acrylic acid/n-methylol acrylic acid amide in the ratio by weight of 49.7/42.3/4/4 and a polymer latex obtained by the emulsion polymerization of methyl methacrylate/acrylic acid/n-methylolacrylic acid amide in the ratio by weight of 93/3/4, in the proportions of solid fractions of 6:4, the total solids content being 2.5 g/m$^2$.

(5) A mordant layer containing 3 g/m$^2$ of the polymer latex mordant indicated below and 3 g/m$^2$ of gelatin.

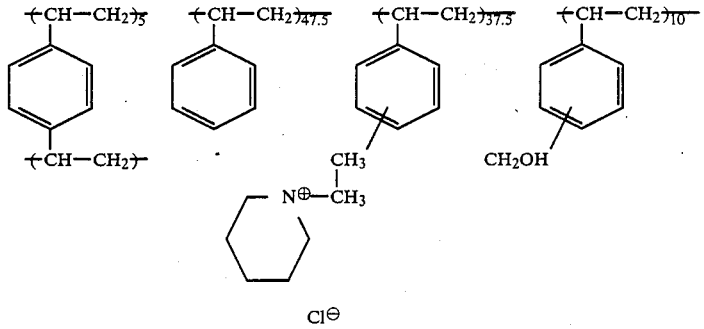

(6) A peeling layer containing 0.6 g/m$^2$ of hydroxyethyl cellulose and 0.03 g/m$^2$ of FC-413 ®(a surfactant made by 3M Co.)

(7) A layer containing 4 g/m$^2$ of titanium white and 0.6 g/m$^2$ of gelatin.

(8) A layer containing the same dye releasing redox compound as layer (1) of the photosensitive sheet described in Example 1.

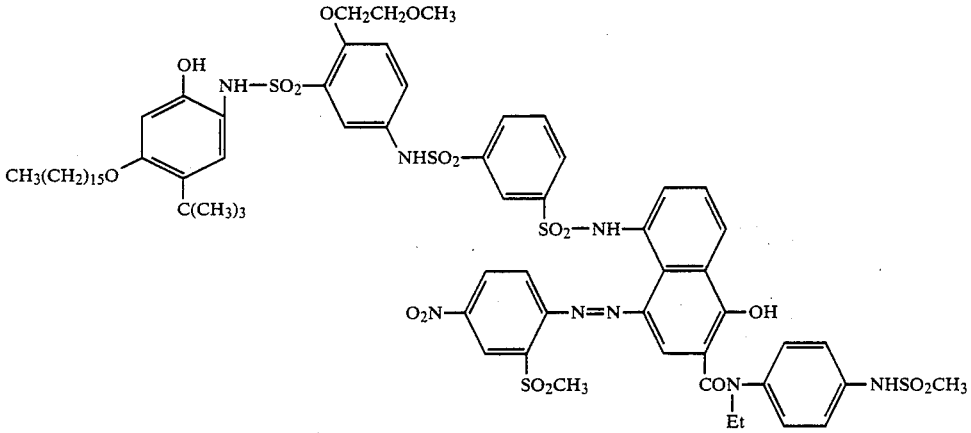

(9) A layer containing 0.5 g/m$^2$ of gelatin.

(10) A red sensitive emulsion layer containing a red sensitive internal latent image type direct positive silver bromide emulsion containing octahedral grains of average grain size 1.0 μm (0.6 g/m$^2$ as silver), 1 g/m$^2$ of gelatin, 0.015 mg/m$^2$ of the same nucleating agent as in Example 1, and 0.06 g/m$^2$ of 2-sulfo-5-n-pentadecylhydroquinone, sodium salt.

(11) An intermediate layer containing 0.3 g/m$^2$ of gelatin, including a dispersion in gelatin of a solution in ethyl acetate of compound I-(6) (0.7 g/m$^2$) and compound II-(1) (0.36 g/m$^2$) of this invention.

(12) A layer containing the same magenta dye releasing redox compound containing as layer (4) in the photosensitive sheet in Example 1.

(13) A green sensitive emulsion layer containing a green sensitive internal latent image type direct positive silver bromide emulsion containing octahedral grains of average grain size 1.0 μm (0.45 g/m$^2$ as silver), 0.75 g/m$^2$ of gelatin, 0.013 mg/m$^2$ of the same nucleating agent as in layer (10) and 0.07 g/m$^2$ of 2-sulfo-5-n-pentadecylhydroquinone, sodium salt.

(14) A layer the same as layer (11)

(15) A layer containing the same yellow dye releasing redox compound as layer (7) in the photosensitive sheet in Example 1.

(16) A blue sensitive emulsion layer containing a blue sensitive internal latent image type direct positive silver bromide emulsion containing octahedral grains of average grain size 1.1 μm (0.6 g/m$^2$ as silver), 1 g/m$^2$ of gelatin, 0.019 mg/m$^2$ of the same nucleating agent as in layer (10) and 0.06 g/m$^2$ of 2-sulfo-5-n pentadecylhydroquinone, sodium salt.

(17) An ultraviolet absorbing layer the same as layer (9) in the photosensitive sheet in Example 1.

(18) A protective layer containing 1.0 g/m$^2$ of gelatin.

An alkaline processing liquid containing a light shielding agent was then prepared as indicated below and this was packed into a processing liquid pod.

| Processing Liquid | |
|---|---|
| 1-m-Tolyl-4-hydroxymethyl-4-methyl-3-pyrazolidone | 10 grams |
| 1-Phenyl-4-hydroxymethyl-4-methyl-3-pyrazolidone | 4 grams |
| 5-Methyl-benzotriazole | 6 grams |
| Potassium sulfite | 8 grams |
| Hydroxyethyl cellulose | 45 grams |
| Potassium hydroxide | 64 grams |
| Carbon black | 150 grams |
| Benzyl alcohol | 3.4 grams |
| Water to make up to a total weight of 1 kg. | |

The above mentioned photosensitive sheet and the processing liquid pod were assembled with a transparent, undercoated polyethyleneterephthalate sheet as a cover sheet to form a unified unit as shown in FIG. 1.

Discontinuous perforations as described in JP-A-56-67840 were formed in the support on the side to which the processing liquid pod had been fitted For comparative purposes, a comparative photosensitive sheet was prepared in the same way except that poly(methyl methacrylate) (0.36 g/m$^2$) which is a known compound was used instead of the compound II-(1) of this invention in layer (11).

These film units were exposed through the cover sheets and then passed between a pair of rollers to spread the processing liquid in the processing liquid pod uniformly between the photosensitive element and the cover sheet.

Part E was strongly folded back and severed after 2 minutes, 1 hour or 1 day after processing and the cover sheet was peeled away.

The part A in FIG. 1-(*a*) is the part over which the alkaline processing composition is spread, and this part was wet after processing. The part B is laminated with a spacer for ensuring that the processing liquid is spread at a constant thickness and so this part was not moistened by the processing liquid. After peeling the apart, the residual fraction of the photo-sensitive layer in the parts A and B were as shown in Table 2.

TABLE 2

| Residual fraction of photosensitive layer adhering to the Image Receiving Layer After Peeling (Area, %) | | | | | | |
|---|---|---|---|---|---|---|
| Peeling Time | Part A | | | Part B | | |
| After | 2 mins. | 1 hour | 1 day | 2 min. | 1 hour | 1 day |
| This Invention | 0% | 0% | 0% | 0% | 0% | 0% |
| Comparative Example | 0% | 0% | 10% | 45% | 45% | 46% |

With the comparative photosensitive sheet, adhesion within the photosensitive layer was poor and some of the photosensitive layer was left behind on the image receiving sheet, particularly, in the unprocessed B part, and the print obtained was contaminated.

With the photosensitive sheet of this invention peeling only occurred at the prescribed location (peeling layer) because adhesion was strong within the photosensitive layer and very satisfactory results were obtained.

EXAMPLE 3

(Storage Stability Test)

Sample 101, a multi-layer color photosensitive material, was prepared by coating each of the layers of which the compositions are indicated below on an undercoated cellulose triacetate film support.

Composition of the Photosensitive layer

The coated weight are indicated in units of grams of silver per square meter in the case of silver halide and colloidal silver, in units of grams per square meter in the case of couplers, additives and gelatin, and in units of mol per mol of silver halide in the same layer in the case of the sensitizing dyes.

| | |
|---|---|
| First Layer (Anti-halation Layer) | |
| Black colloidal silver | 0.2 |
| Gelatin | 1.3 |
| ExM-8 | 0.06 |
| UV-1 | 0.1 |
| UV-2 | 0.2 |
| Solv-1 | 0.01 |
| Solv-2 | 0.01 |
| Second Layer (Intermediate Layer) | |
| Fine grain silver bromide (average grain size 0.07 μm) | 0.10 |
| Gelatin | 1.5 |
| UV-1 | 0.06 |
| UV-2 | 0.03 |
| ExC-2 | 0.02 |
| ExF-1 | 0.004 |
| Solv-1 | 0.1 |
| Solv-2 | 0.09 |
| Third Layer (First Red Sensitive Emulsion Layer) | |
| Silver iodobromide emulsion (AgI 2 mol %, high internal AgI type, corresponding sphere diameter 0.3 μm, variation coefficient of corresponding sphere diameter 29%, regular crystals, twinned crystal admixed grains, diameter/thickness ratio 2.5) | 0.4 (Coated silver weight) |
| Gelatin | 0.6 |
| ExS-1 | $1.0 \times 10^{-4}$ |
| ExS-2 | $3.0 \times 10^{-4}$ |
| ExS-3 | $1.0 \times 10^{-5}$ |
| ExC-3 | 0.06 |
| ExC-4 | 0.06 |
| ExC-7 | 0.04 |
| ExC-2 | 0.03 |
| Solv-1 | 0.03 |

-continued

| | |
|---|---|
| Solv-3 | 0.012 |
| Fourth Layer (Second Red Sensitive Emulsion Layer) | |
| Silver iodobromide emulsion (AgI 5 mol %, high internal AgI type, corresponding sphere diameter 0.7 μm, variation coefficient of corresponding sphere diameter 25%, regular crystals, twinned crystal admixed grains, diameter/thickness ratio 4) | 0.7 (Coated silver weight) |
| Gelatin | 0.5 |
| ExS-1 | $1.0 \times 10^{-4}$ |
| ExS-2 | $3.0 \times 10^{-4}$ |
| ExS-3 | $1.0 \times 10^{-5}$ |
| ExC-3 | 0.24 |
| ExC-4 | 0.24 |
| ExC-7 | 0.04 |
| ExC-2 | 0.04 |
| Solv-1 | 0.15 |
| Solv-3 | 0.02 |
| Fifth Layer (Third Red Sensitive Emulsion Layer) | |
| Silver iodobromide emulsion (AgI 10 mol %, high internal AgI type, corresponding sphere diameter 0.8 μm, variation coefficient of corresponding sphere diameter 16%, regular crystals, twinned crystal admixed grains, diameter/thickness ratio 1.3) | 1.0 (Coated silver weight) |
| Gelatin | 1.0 |
| ExS-1 | $1.0 \times 10^{-4}$ |
| ExS-2 | $3.0 \times 10^{-4}$ |
| ExS-3 | $1.0 \times 10^{-5}$ |
| ExC-5 | 0.05 |
| ExC-6 | 0.1 |
| Solv-1 | 0.01 |
| Solv-2 | 0.005 |
| Sixth Layer (Intermediate Layer) | |
| Gelatin | 1.0 |
| Cpd-1 | 0.03 |
| Solv-1 | 0.05 |
| Seventh Layer (First Green Sensitive Emulsion Layer) | |
| Silver iodobromide emulsion (AgI 12 mol %, high internal AgI type, corresponding sphere diameter 0.3 μm, variation coefficient of corresponding sphere diameter 28%, regular crystals, twinned crystal admixed grains, diameter/thickness ratio 2.5) | 0.30 (Coated silver weight) |
| ExS-4 | $5.0 \times 10^{-4}$ |
| ExS-6 | $0.3 \times 10^{-4}$ |
| ExS-5 | $2.0 \times 10^{-4}$ |
| Gelatin | 1.0 |
| ExM-9 | 0.2 |
| ExY-14 | 0.03 |
| ExM-8 | 0.03 |
| Solv-1 | 0.5 |
| Eighth Layer (Second Green Sensitive Emulsion Layer) | |
| Silver iodobromide emulsion (AgI 14 mol %, high internal AgI type, corresponding sphere diameter 0.6 μm, variation coefficient of corresponding sphere diameter 38%, regular crystals, twinned crystal admixed grains, diameter/thickness ratio 4) | 0.4 (Coated silver weight) |
| Gelatin | 0.5 |
| ExS-4 | $5.0 \times 10^{-4}$ |
| ExS-5 | $2.0 \times 10^{-4}$ |
| ExS-6 | $0.3 \times 10^{-4}$ |
| ExM-9 | 0.25 |
| ExM-8 | 0.03 |
| ExM-10 | 0.015 |
| ExY-14 | 0.01 |
| Solv-1 | 0.2 |

-continued

| | |
|---|---|
| Ninth Layer (Third Green Sensitive Emulsion Layer) | |
| Silver iodobromide emulsion (AgI 16 mol %, high internal AgI type, corresponding sphere diameter 1.0 μm, variation coefficient of corresponding sphere diameter 80%, regular crystals, twinned crystal admixed grains, diameter/thickness ratio 1.2) | 0.85 (Coated silver weight) |
| Gelatin | 1.0 |
| ExS-7 | $3.5 \times 10^{-4}$ |
| ExS-8 | $1.4 \times 10^{-4}$ |
| ExM-11 | 0.01 |
| ExM-12 | 0.03 |
| ExM-13 | 0.20 |
| ExM-8 | 0.02 |
| ExY-15 | 0.02 |
| Solv-1 | 0.20 |
| Solv-2 | 0.05 |
| Tenth Layer (Yellow First Layer) | |
| Gelatin | 1.2 |
| Yellow colloidal silver | 0.08 |
| Compound I-(2) of this invention | 0.1 |
| Solv-1 | 0.08 |
| Solv-2 | 0.06 |
| Eleventh Layer (First Blue Sensitive Emulsion Layer) | |
| Silver iodobromide emulsion (AgI 14 mol %, high internal AgI type, corresponding sphere diameter 0.5 μm, variation coefficient of corresponding sphere diameter 15%, octahedral grains) | 0.4 (Coated silver weight) |
| Gelatin | 1.0 |
| ExS-9 | $2.0 \times 10^{-4}$ |
| ExY-16 | 0.9 |
| ExY-14 | 0.07 |
| Solv-1 | 0.2 |
| Twelfth Layer (Second Blue Sensitive Emulsion Layer) | |
| Silver iodobromide emulsion (AgI 10 mol %, high internal AgI type, corresponding sphere diameter 1.3 μm, variation coefficient of corresponding sphere diameter 25%, regular crystals, twinned crystal admixed grains, diameter/thickness ratio 4.5) | 0.5 (Coated silver weight) |
| Gelatin | 0.6 |
| ExS-9 | $1.0 \times 10^{-4}$ |
| ExY-16 | 0.25 |
| ExC-17 | 0.005 |
| Solv-1 | 0.07 |
| Thirteenth Layer (First Protective Layer) | |
| Gelatin | 0.8 |
| UV-1 | 0.1 |
| UV-2 | 0.2 |
| Solv-1 | 0.01 |
| Solv-2 | 0.01 |
| Fourteenth Layer (Second Protective Layer) | |
| Fine grain silver bromide (average grain size 0.07 μm) | 0.5 |
| Gelatin | 0.45 |
| Poly(methyl methacrylate) grains (diameter 1.5 μm) | 0.2 |
| H-1 | 0.4 |
| Cpd-3 | 0.5 |
| Cpd-4 | 0.5 |

Surfactants were added as coating promoters to each layer in addition to the components indicated above. The sample prepared in this was sample 101.

The chemical structural formula or chemical name of each of the compounds used in this example is indicated below.

UV-1
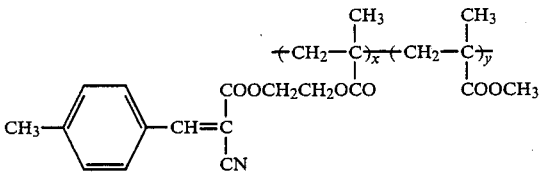
x/y = 7/3 (by weight)
UV-2
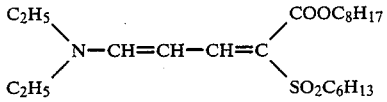
Tricresyl phosphate *Solv-1
Dibutyl phthalate *Solv-2
Bis(2-ethylhexyl)phthalate *Solv-3
ExM-8
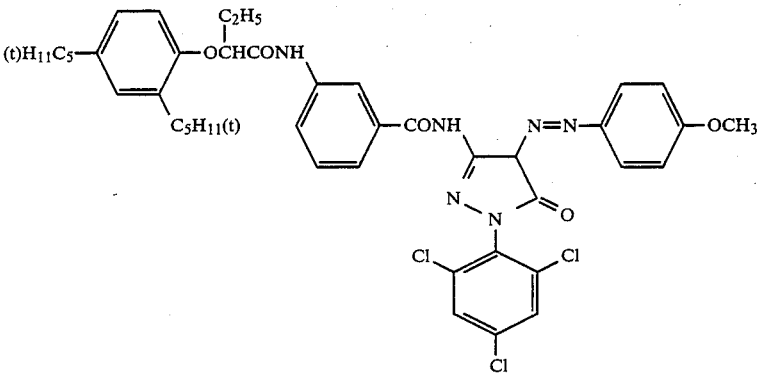
ExF-1
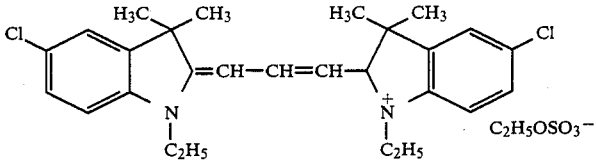
ExC-2
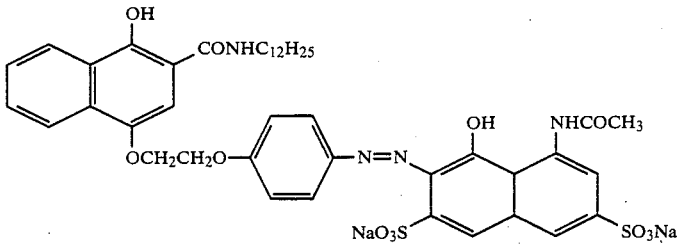
ExC-3
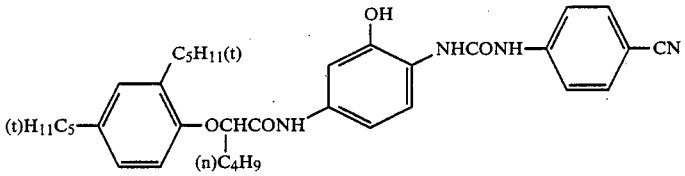
ExC-4
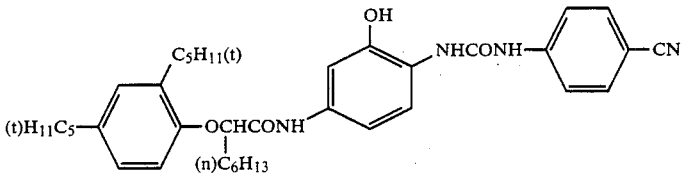

-continued
ExY-14
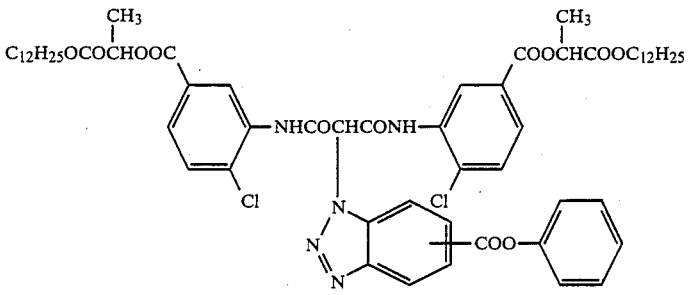
ExY-15
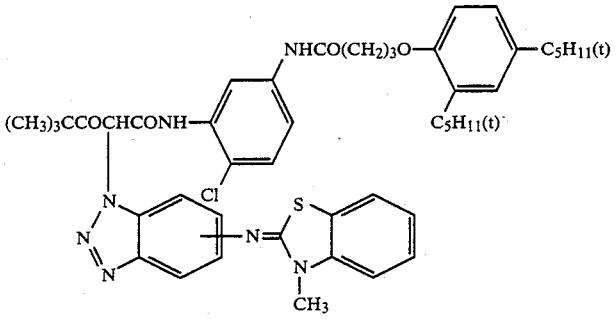
ExC-5
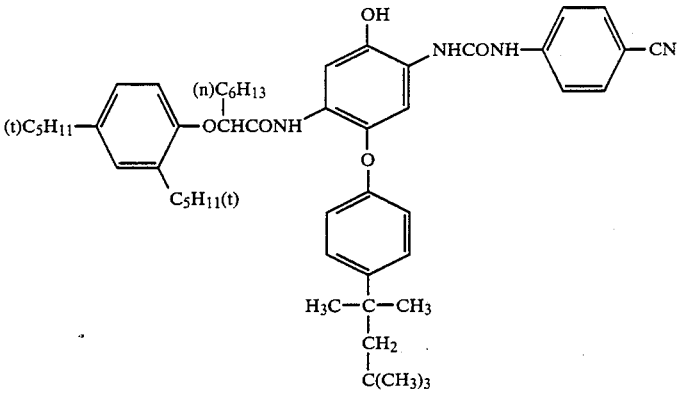
ExC-6
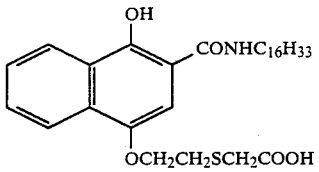
ExC-7
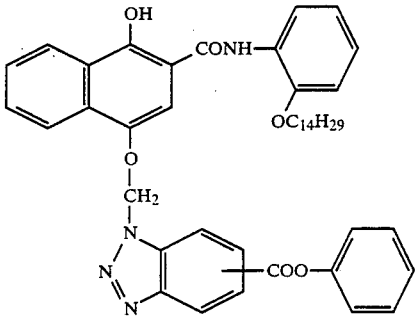

-continued
ExM-9
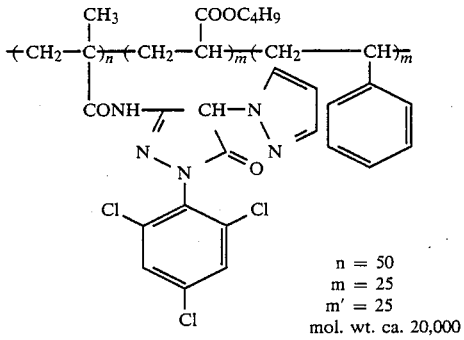
ExM-10
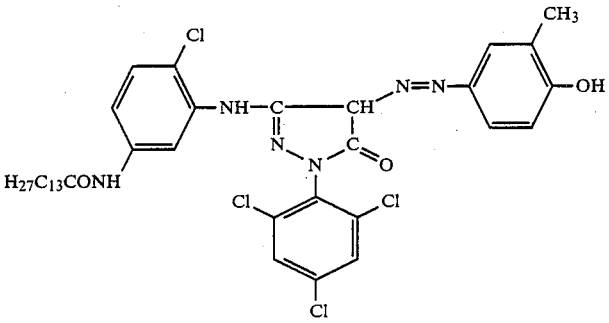
ExM-11
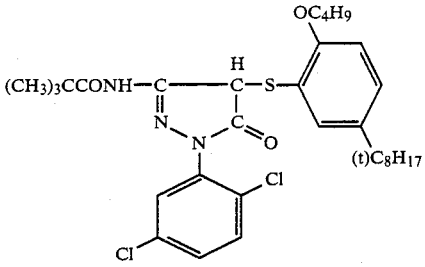
ExM-12
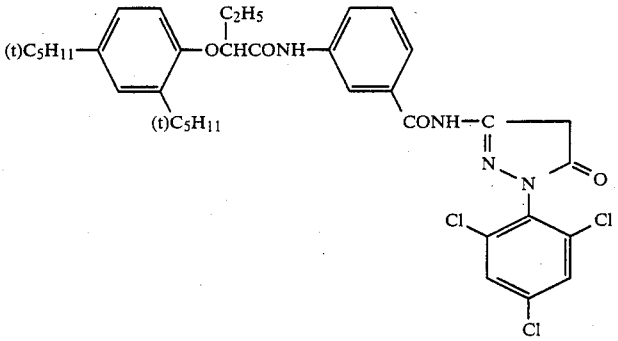
ExM-13
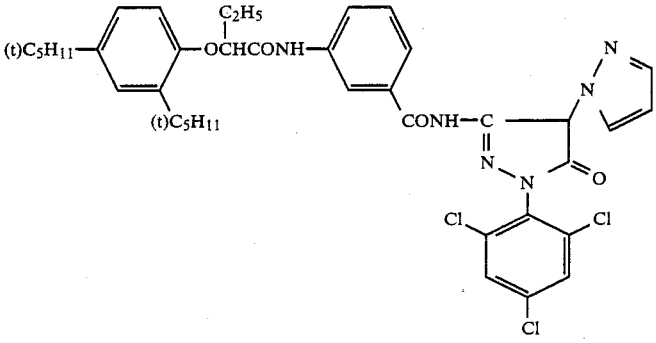

-continued
ExY-16
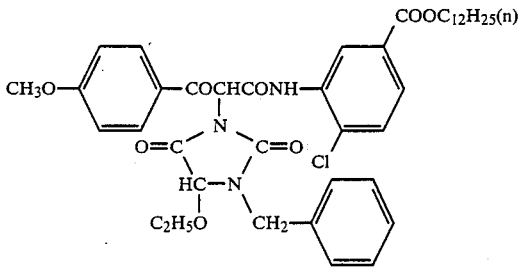
Cpd-1
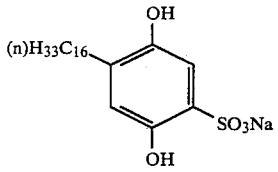
ExC-17
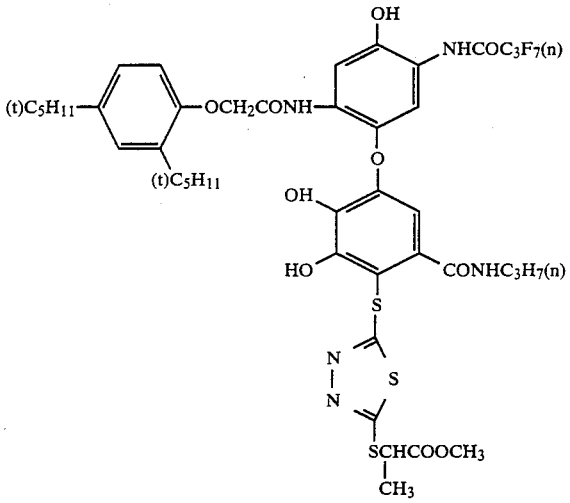
ExS-1
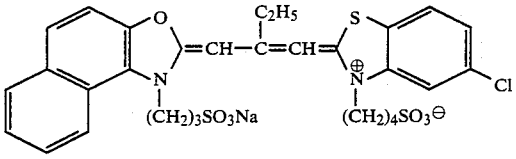
ExS-2
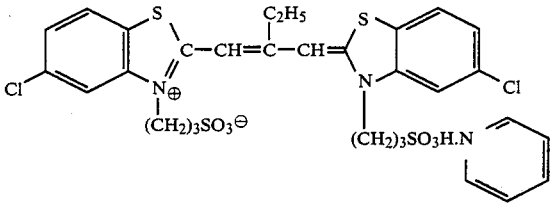
ExS-3
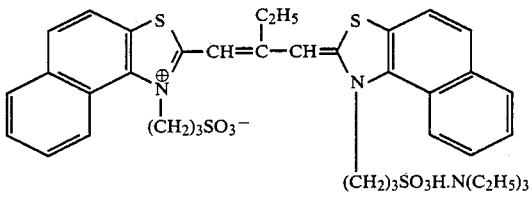

-continued
ExS-4
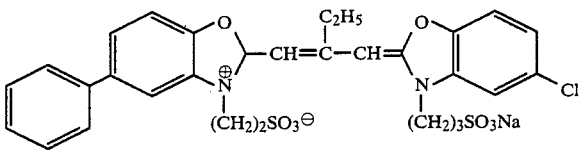
ExS-5
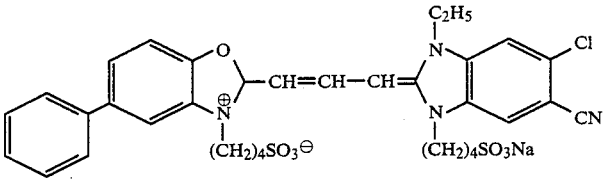
ExS-6
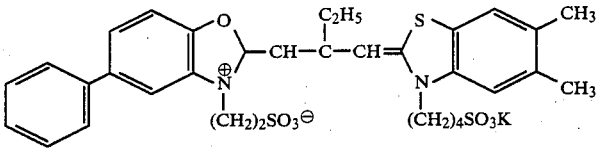
ExS-7
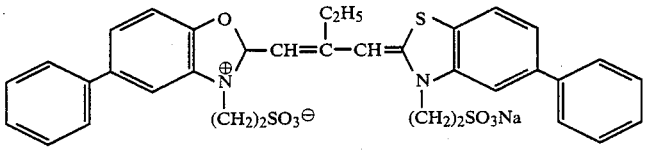
ExS-8
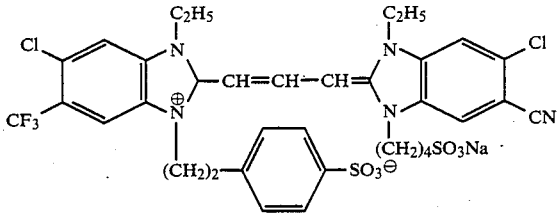
ExS-9
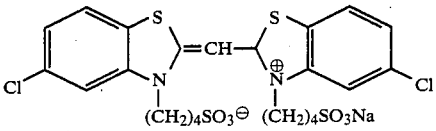
H-1
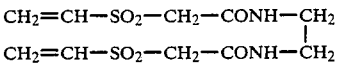
Cpd-3
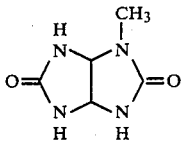
Cpd-4
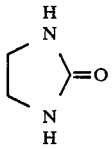
Samples 102 to 104
Samples 102, 103 and 104 were prepared by replacing the compound I-(2) in the tenth layer of Sample 101 with equal weights of the Compounds I-(4), I-(9) and I-(12).
Samples 105 to 106
Samples 105 and 106 were prepared by excluding Compound I-(2) from the tenth layer of Sample 101 and coating with the polymers II-(1), II-(17) of this invention in an amount of 0.1 gram per square meter.

Samples 107 to 117

Samples 107 to 117 which had tenth layer composition as shown Table 3 were prepared in the same way as described above.

These samples were subjected to an imagewise exposure through a green filter (BPN-53, made by Fuji Photo Film Co., Ltd.) after being left to stand (A) for 14 days at a temperature of 25° C, 60% relative humidity, or (B) for 14 days at a temperature of 45° C, 75% relative humidity, after which they were color developed and processed in the way indicated below. After processing, the samples were subjected to density measurements and the values obtained by subtracting the yellow density at the exposure required to provide a magenta density of (fog+1.0) from the respective fog density was taken as the degree of color staining, and the results obtained were as shown in Table 3.

The changes in the relative speed of the green sensitive layer under conditions B with respect to conditions A after leaving the samples to stand under conditions A and conditions B as described above following a white, imagewise exposure and then carrying out the color development processing described hereinafter were as shown in Table 3. The relative speed is indicated as the relative value of the reciprocal of the exposure required to provide a magenta density of (fog+0.2).

| Color Development Process | |
|---|---|
| Color Development | 3 minutes 15 seconds |
| Bleach | 1 minute |
| Bleach-Fix | 3 minutes 15 seconds |
| Water wash (1) | 40 seconds |
| Water wash (2) | 1 minute |
| Stabilization | 40 seconds |
| Drying (50° C.) | 1 minute 15 seconds |

A counter-flow water washing system from water wash (2) to water wash (1) was used in the processing operation described above. The compositions of each of the processing baths were as indicated below.

Moreover, the replenishment rate of each processing bath was 1,200 ml per square meter of color photosensitive material in the case of the color developer, and 800 ml per square meter of color photosensitive material in all other cases, including the water wash. Furthermore, the carry over to the water wash process was 50 ml per square meter of color photosensitive material.

| | Tank Solution | Replenisher |
|---|---|---|
| Color Development Bath | | |
| Diethylenetriamine penta-acetic acid | 1.0 gram | 1.1 gram |

-continued

| | Tank Solution | Replenisher |
|---|---|---|
| 1-Hydroxyethylidene-1,1-diphosphonic acid | 2.0 grams | 2.2 grams |
| Sodium sulfite | 4.0 grams | 4.4 grams |
| Potassium carbonate | 30.0 grams | 32.0 grams |
| Potassium bromide | 1.4 grams | 0.7 gram |
| Potassium iodide | 1.3 mg | |
| Hydroxylamine sulfate | 2.4 grams | 2.6 grams |
| 4-(N-Ethyl-N-β-hydroxyethyl-amino)-2-2-methylaniline sulfate | 4.5 grams | 5.0 grams |
| Water to make up to | 1.0 liter | 1.0 liter |
| pH | 10.0 | 10.05 |
| Bleach Bath | | |
| (Tank Solution = Replenisher) | | |
| Ethylenediamine tetra-acetic acid, ferric ammonium salt | | 120.0 grams |
| Etylenediamine tetra-acetic acid disodium salt | | 10.0 grams |
| Ammonium nitrate | | 10.0 grams |
| Ammonium bromide | | 100.0 grams |
| Bleach accelerator | | $5 \times 10^{-3}$ mol |

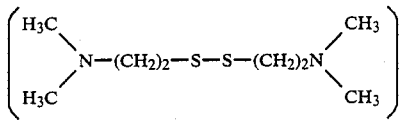

| | |
|---|---|
| Aqueous ammonia added to provide a pH of | 6.3 |
| Water to make up to | 1.0 liter |
| Bleach-Fix Bath | |
| (Tank Solution = Replenisher) | |
| Ethylenediamine tetra-acetic acid, ferric ammonium salt | 50.0 grams |
| Ethylenediamine tetra-acetic acid, disodium salt | 5.0 grams |
| Sodium sulfite | 12.0 grams |
| Aqueous ammonium thiosulfate solution (70%) | 240 ml |
| Aqueous ammonia added to provide a pH of | 7.3 |
| Water to make up to | 1.0 liter |
| Water Wash Water | |
| City water containing 32 mg/l of calcium ion and 7.3 g/l of magnesium ion was passed through a column packed with an H-type anion exchange resin and an OH-type basic anion exchange resin to provide water which contained 1.2 mg/l of calcium ion and 0.4 mg/l of magnesium ion, to which 20 mg per liter of sodium dichloroisocyanurate was added for use. | |
| Stablilizer bath | |
| (Tank Solution = Replenisher) | |
| Formalin (37% W/V) | 2.0 ml |
| Polyoxyethylene-p-monononyl-phenyl ether (average degree of polymerization 10) | 0.3 gram |
| Ethylenediamine tetra-acetic acid, disodium salt | 0.05 gram |
| Water to make up to | 10. liter |
| pH | 5.8 |
| Drying | |
| The drying temperature was 50° C. | |

TABLE 3

| Sample | Tenth Layer Compound | Tenth Layer Polymer | Extent of Color Standing (A) Normal Conditions | Extent of Color Standing (B) Forced Conditions | Change in Relative Speed Under Forced Degrading Conditions |
|---|---|---|---|---|---|
| Comparative Examples | | | | | |
| 101 | I-(2) | — | +0.02 | +0.05 | +0.05 |
| 102 | I-(4) | — | 0 | +0.04 | 0.04 |
| 103 | I-(9) | — | +0.01 | +0.04 | +0.05 |
| 104 | I-(12) | — | +0.02 | +0.05 | +0.05 |
| 105 | — | II-(1) | +0.08 | +0.11 | −0.01 |
| 106 | — | II-(17) | +0.08 | +0.12 | −0.01 |

This

TABLE 3-continued

| Sample | Tenth Layer Compound | Tenth Layer Polymer | Extent of Color Standing (A) Normal Conditions | Extent of Color Standing (B) Forced Conditions | Change in Relative Speed Under Forced Degrading Conditions |
|---|---|---|---|---|---|
| Invention | | | | | |
| 107 | I-(2) | II-(1) | +0.02 | +0.03 | +0.01 |
| 108 | I-(4) | II-(1) | 0 +0.01 | 0 | |
| 109 | I-(9) | II-(1) | +0.01 | +0.01 | +0.01 |
| 110 | I-(12) | II-(1) | +0.01 | +0.02 | +0.01 |
| 111 | I-(20) | II-(1) | +0.01 | +0.02 | +0.01 |
| 112 | I-(23) | II-(1) | +0.02 | +0.02 | +0.01 |
| 113 | I-(2) | II-(17) | +0.02 | +0.02 | +0.01 |
| 114 | I-(4) | II-(17) | 0 0 | +0.01 | |
| 115 | I-(9) | II-(17) | +0.01 | +0.01 | +0.01 |
| 116 | I-(12) | II-(17) | +0.01 | +0.02 | 0 |
| 117 | I-(2) | II-(12) | +0.02 | +0.02 | +0.02 |

It is clear from Table 3 that color staining was prevented under normal conditions with the samples which contained only a compound of general formula (I) of this invention, but the anti-color staining capacity under forced conditions was quite small and there was a marked change in speed. However, in the samples in which a polymer of this invention was used in combination, the anti-color staining performance was considerable even under forced conditions and the change in the relative speed was slight.

EXAMPLE 4

Sample 301 was prepared by forming a multilayer color photosensitive material consisting of the layers of which the compositions are indicated below on an undercoated cellulose triacetate film support.

| | |
|---|---|
| First Layer (Anti-halation Layer) | |
| Black colloidal silver | 0.25 g/m$^2$ |
| Ultraviolet absorber U-1 | 0.1 g/m$^2$ |
| Ultraviolet absorber U-2 | 0.1 g/m$^2$ |
| High boiling point organic solvent Oil-1 | 0.1 g/m$^2$ |
| Gelatin | 1.9 g/m$^2$ |
| Second Layer (Intermediate Layer 1) | |
| Cpd-C | 10 mg/m$^2$ |
| Compound I-12 | 0.1 mg/m$^2$ |
| High boiling point organic solvent Oil-3 | 40 mg/m$^2$ |
| Gelatin | 0.4 g/m$^2$ |
| Third Layer (Intermediate Layer 2) | |
| Surface fogged fine grain silver iodobromide emulsion (average grain size 0.06 μm, AgI content 1 mol %) as silver | 0.05 g/m$^2$ |
| Gelatin | 0.4 g/m$^2$ |
| Fourth Layer (First Red Sensitive Emulsion Layer) | |
| Silver iodobromide emulsion spectrally sensitized with the sensitizing dyes S-1 and S-2 (a 1:1 mixture of mono-disperse cubic grains of average grain size 0.2 μm, AgI content 5 mol %, and monodisperse cubic grains of average grain size 0.1 μm, AgI content 5 mol %) as silver | 0.4 g/m$^2$ |
| Coupler C-1 | 0.2 g/m$^2$ |
| Coupler C-2 | 0.05 g/m$^2$ |
| High boiling point organic solvent, Oil-2 | 0.1 cc/m$^2$ |
| Gelatin | 0.8 g/m$^2$ |
| Fifth Layer (Second Red Sensitive Emulsion Layer) | |
| Silver iodobromide emulsion spectrally sensitized with the sensitizing dyes S-1 and S-2 (mono-disperse cubic emulsion of average grain size 0.3 μm, AgI content 4 mol %) as silver | 0.4 g/m$^2$ |
| Coupler C-1 | 0.2 g/m$^2$ |
| Coupler C-3 | 0.2 g/m$^2$ |
| Coupler C-2 | 0.05 g/m$^2$ |
| High boiling point organic solvent, Oil-2 | 0.1 cc/m$^2$ |
| Gelatin | 0.8 g/m$^2$ |
| Sixth Layer (Third Red Sensitive Emulsion Layer) | |

-continued

| | |
|---|---|
| Silver iodobromide emulsion spectrally sensitized with the sensitizing dyes S-1 and S-2 (Mono-disperse cubic emulsion of average grain size 0.4 μm, AgI content 2 mol %) as silver | 0.4 g/m$^2$ |
| Coupler C-3 | 0.7 g/m$^2$ |
| Gelatin | 1.1 g/m$^2$ |
| Seventh Layer (Intermediate Layer 3) | |
| Dye D-1 | 0.02 g/m$^2$ |
| Gelatin | 0.6 g/m$^2$ |
| Eighth Layer (Intermediate Layer 4) | |
| Surface fogged fine grain silver iodobromide emulsion, average grain size 0.06 μm, AgI content 1 mol % as silver | 0.05 g/m$^2$ |
| Compound I-12 | 0.2 g/m$^2$ |
| Gelatin | 1.0 g/m$^2$ |
| Ninth Layer (First Green Sensitive Emulsion Layer) | |
| Silver iodobromide emulsion spectrally sensitized with the sensitizing dyes S-3 and S-4 (a 1:1 mixture of a mono-disperse cubic emulsion of average grain size 0.2 μm, AgI content 5 mol % and a mono-disperse cubic emulsion of average grain size 0.1 μm, AgI content 5 mol %) as silver | 0.5 g/m$^2$ |
| Coupler C-4 | 0.3 g/m$^2$ |
| Compound Cpd A | 0.03 g/m$^2$ |
| Gelatin | 0.5 g/m$^2$ |
| Tenth Layer (Second Green Sensitive Emulsion Layer) | |
| Silver iodobromide emulsion spectrally sensitized with the sensitizing dyes S-3 and S-4 (a mono-disperse cubic emulsion of average grain size 0.4 μm, AgI content 5 mol %) as silver | 0.4 g/m$^2$ |
| Coupler C-4 | 0.3 g/m$^2$ |
| Compound Cpd A | 0.03 g/m$^2$ |
| Gelatin | 0.6 g/m$^2$ |
| Eleventh Layer (Third Green Sensitive Emulsion Layer) | |
| Silver iodobromide emulsion spectrally sensitized with the sensitizing dyes S-3 and S-4 (a tabular emulsion of average grain size 0.5 μm, AgI content 2 mol %) as silver | 0.5 g/m$^2$ |
| Coupler C-4 | 0.8 g/m$^2$ |
| Compound Cpd A | 0.08 g/m$^2$ |
| Gelatin | 1.0 g/m$^2$ |
| Twelfth Layer (Intermediate Layer 5) | |
| Dye D-2 | 0.05 g/m$^2$ |
| Gelatin | 0.6 g/m$^2$ |
| Thirteenth Layer (Yellow Filter Layer) | |
| Yellow colloidal silver | 0.1 g/m$^2$ |
| Compound I-12 | 0.04 g/m$^2$ |
| Gelatin | 1.1 g/m$^2$ |
| Fourteenth Layer (First Blue Sensitive Emulsion Layer) | |
| Silver iodobromide emulsion spectrally sensitized with the sensitizing dyes S-5 and S-6 (a 1:1 mixture of a mono-disperse cubic emulsion of average grain size 0.2 μm, AgI content 3 mol %, and | 0.6 g/m$^2$ |

-continued

| | |
|---|---|
| a mono-disperse cubic emulsion of average grain size 0.1 μm, AgI content 3 mol %) as silver | |
| Coupler C-5 | 0.6 g/m$^2$ |
| Gelatin | 0.8 g/m$^2$ |
| Fifteenth Layer (Second Blue Sensitive Emulsion Layer) | |
| Silver iodobromide emulsion spectrally sensitized with the sensitizing dyes S-5 and S-6 (a tabular emulsion of average grain size 0.5 μm, aspect ratio 7, AgI content 2 mol %) as silver | 0.4 g/m$^2$ |
| Coupler C-5 | 0.3 g/m$^2$ |
| Coupler C-6 | 0.3 g/m$^2$ |
| Gelatin | 0.9 9/m$^2$ |
| Sixteenth Layer (Third Blue Sensitive Emulsion Layer) | |
| Silver iodobromide emulsion spectrally sensitized with the sensitizing dyes S-5 and S-6 (a tabular emulsion of average grain size 1.0 μm, aspect ratio 7, AgI content 2 mol %) as silver | 0.4 g/m$^2$ |
| Coupler C-6 | 0.7 g/m$^2$ |
| Gelatin | 1.2 g/m$^2$ |
| Seventeenth Layer (First Protective Layer) | |
| Ultraviolet absorber U-1 | 0.04 g/m$^2$ |
| Ultraviolet absorber U-3 | 0.03 g/m$^2$ |

-continued

| | |
|---|---|
| Ultraviolet absorber U-4 | 0.03 g/m$^2$ |
| Ultraviolet absorber U-5 | 0.05 g/m$^2$ |
| Ultraviolet absorber U-6 | 0.05 g/m$^2$ |
| Compound Cpd B | 0.8 g/m$^2$ |
| Compound I-12 | 0.1 g/m$^2$ |
| D-3 | 0.05 g/m$^2$ |
| Gelatin | 0.7 g/m$^2$ |
| Eighteenth Layer (Second Protective Layer) | |
| Unfogged fine grain silver iodobromide emulsion (average grain size 0.06 μm, AgI content 1 mol %) as silver | 0.1 g/m$^2$ |
| Poly(methyl methacrylate) particles (average particle size 1.5 μm) | 0.1 g/m$^2$ |
| A 4:6 copolymer of methyl acrylate and acrylic acid (average particle size 1.5 μm) | 0.1 g/m$^2$ |
| Silicone oil | 0.03 g/m$^2$ |
| Fluorine containing surfactant W-1 | 3 mg/m$^2$ |
| Gelatin | 0.8 g/m$^2$ |

Gelatin hardening agent H-1 and surfactants were added to each layer in addition to the compositions indicated above. The compounds used in the preparation of the sample are indicated below.

C-1

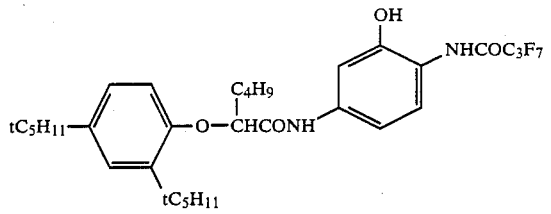

C-2

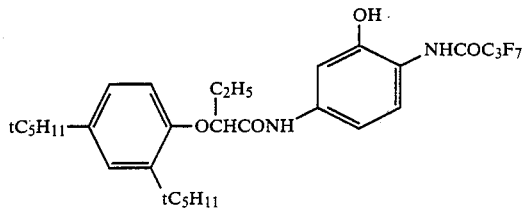

C-3

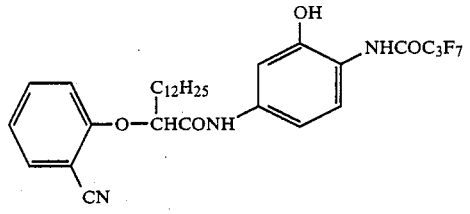

C-4

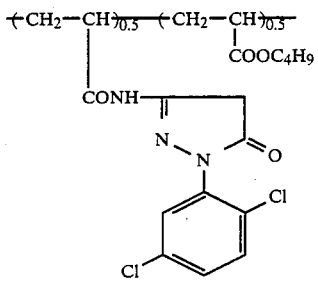

-continued
C-5
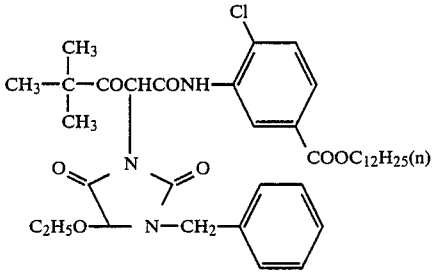
C-6
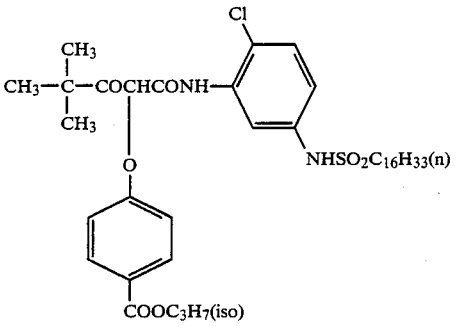
| | |
|---|---|
| Dibutyl phthalate | Oil-1 |
| Tricresyl phosphate | Oil-2 |
Oil-3
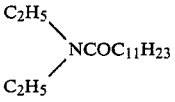
Cpd A
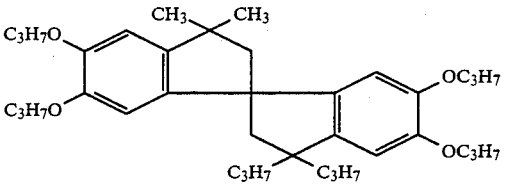
Cpd B
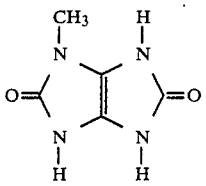
Cpd C
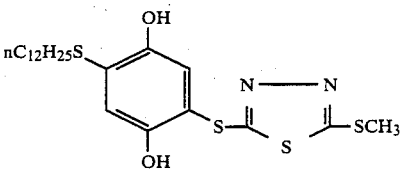
U-1
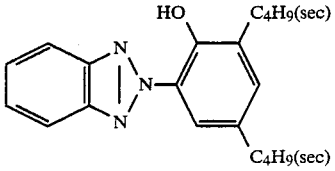
U-2
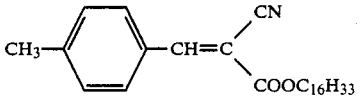

-continued
U-3
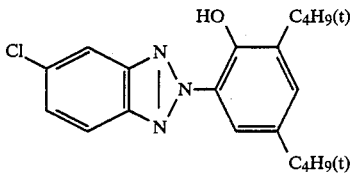
U-4
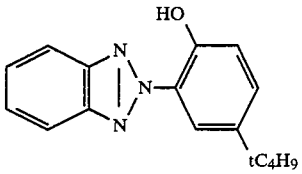
U-5
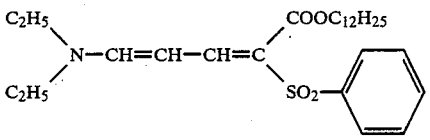
U-6
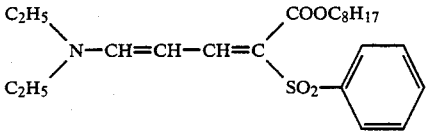
S-1
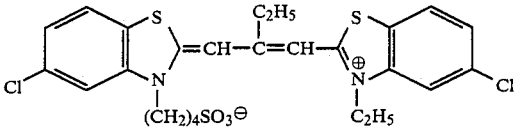
S-2
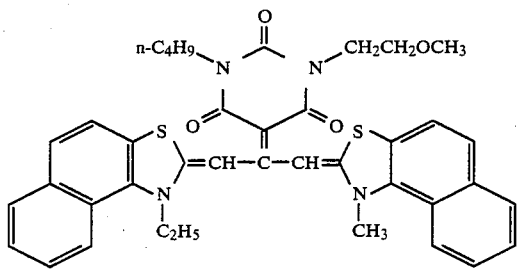
S-3
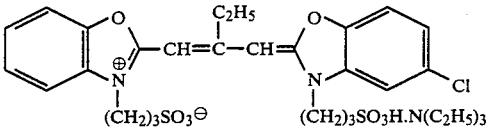
S-4
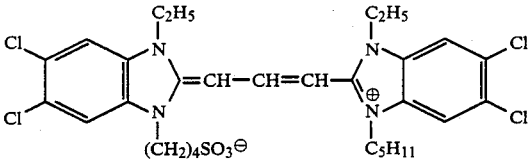
S-5
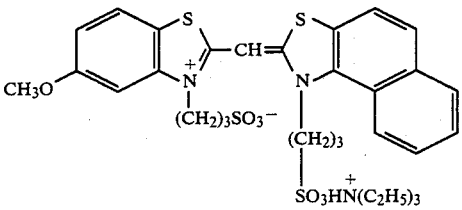

-continued

S-6

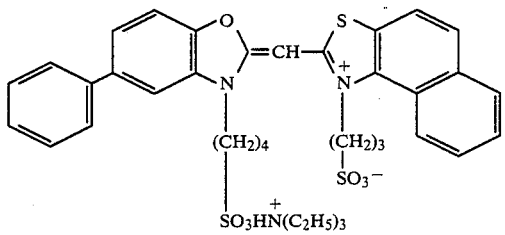

D-1

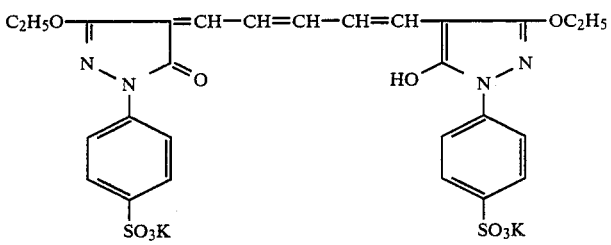

D-2

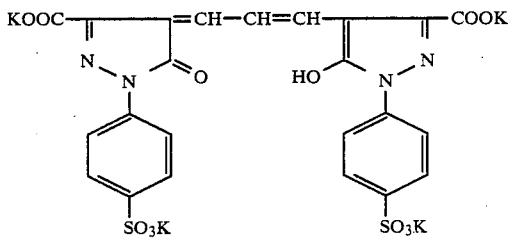

D-3

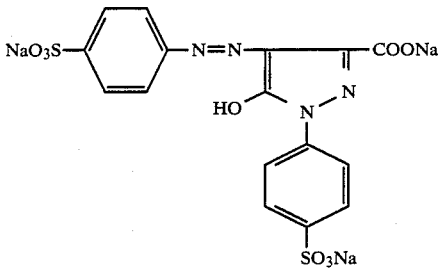

H-1

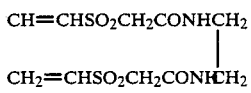

W-1

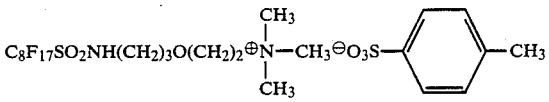

P-1

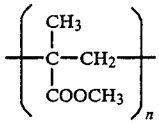

Average Molecular Weight 50,000

Sample 302 was prepared by adding a co-dispersion of equal amounts of Compound I-12 of the second, eighth, thirteenth and seventeenth layer in Sample 1 and Compound P-1 to each of these four layers and adjusting the increase in volume with gelatin. Samples 303, 304 and 305 were prepared by replacing the compound P-1 with the Compounds II-(1), II-(4) and II-(8) of this invention respectively, using the same composition and procedures as for Sample 302.

Each of the Samples 301 to 305 obtained was left to stand under storage conditions of 25° C., 60% RH (referred to a fresh samples) or under storage conditions of 50° C., 80% RH×3 days, and then the samples were given a wedge exposure with white light and processed using the processing operations indicated below.

| Processing Operations | | |
|---|---|---|
| Process | Time | Temperature |
| First Development | 6 minutes | 38° C. |
| Water Wash | 2 minutes | 38° C. |
| Reversal | 2 minutes | 38° C. |
| Color Development | 6 minutes | 38° C. |
| Conditioning | 2 minutes | 38° C. |
| Bleaching | 6 minutes | 38° C. |
| Fixing | 4 minutes | 38° C. |
| Water Wash | 4 minutes | 38° C. |
| Stabilization | 1 minute | Normal Temp. |
| Drying | | |

The processing baths used were as follows:

| | |
|---|---|
| First Development Bath | |
| Water | 700 ml |
| Nitrilo-N,N,N-trimethylene-phosphonic acid, penta-sodium salt | 2 grams |
| Sodium sulfite | 20 grams |
| Hydroquinone monosulfonate | 30 grams |
| Sodium carbonate (monohydrate) | 30 grams |
| 1-Phenyl-4-methyl-4-hydroxy-methyl-3-pyrazolidone | 2 grams |
| Potassium bromide | 2.5 grams |
| Potassium thiocyanate | 1.2 grams |
| Potassium iodide (0.1% solution) | 2 ml |
| Water | to make up to 1000 ml |
| Reversal Bath | |
| Water | 700 ml |
| Nitrilo-N,N,N-trimethylene-phosphonic acid, penta-sodium salt | 3 grams |
| Stannous chloride (dihydrate) | 1 gram |
| p-Aminophenol | 0.1 gram |
| Sodium hydroxide | 8 grams |
| Glacial acetic acid | 15 ml |
| Water | to make up to 1000 ml |
| Color Development Bath | |
| Water | 700 ml |
| Nitrilo-N,N,N-triethylene-phosphonic acid, penta-sodium salt | 3 grams |
| Sodium sulfite | 7 grams |
| Trisodium phosphate (dodeca-hydrate) | 36 grams |
| Potassium bromide | 1 grams |
| Potassium iodide (0.1% solution) | 90 ml |
| Sodium hydroxide | 3 grams |
| Citrazininc acid | 1.5 grams |
| N-Ethyl-N-(β-methanesulfonamido-ethyl)-3-methyl-4-aminoaniline sulfate | 11 grams |
| 3,6-Dithiaoctan-1,8-diol | 1 gram |
| Water | to make up to 1000 ml |
| pH | 12.0 |
| Conditioner Bath | |
| Water | 700 ml |
| Sodium sulfite | 12 grams |
| Ethylenediamine tetra-acetic acid, sodium salt (dihydrate) | 8 grams |
| Thioglycerine | 0.4 ml |
| Glacial acetic acid | 3 ml |
| Water | to make up to 1000 ml |
| Bleach Bath | |
| Water | 800 ml |

-continued

| | |
|---|---|
| Ethylenediamine tetra-acetic acid (sodium salt dihydrate) | 2 grams |
| Ethylenediamine tetra-acetic acid iron(III) ammonium salt (dihydrate) | 120 grams |
| Potassium bromide | 100 grams |
| Water | to make up to 1000 ml |
| Fixing Bath | |
| Water | 800 ml |
| Sodium thiosulfite | 80.0 grams |
| Sodium sulfite | 5.0 grams |
| Sodium bisulfite | 5.0 grams |
| Water | to make up to 1000 ml |
| Stabilizer Bath | |
| Water | 800 ml |
| Formalin (37 wt %) | 5.0 ml |
| "Fuji Driwel" (a surfactant made by Fuji Photo Film Co., Ltd.) | 5.0 ml |
| Water | to make up to 1000 ml |

The results obtained were as shown in Table 4.

TABLE 4

| Sensitive Layer Sample | Fresh, Maximum Density Red (Cyan) | Green (Magenta) | Green (Yellow) | 3 days × 50° C. 80% RH, Max. Density Red (Cyan) | Green (Magenta) | Green (Yellow) |
|---|---|---|---|---|---|---|
| 301 (Comp. Ex.) | 3.21 | 3.73 | 3.50 | 2.84 | 3.43 | 3.18 |
| 302 (Comp. Ex.) | 3.18 | 3.70 | 3.48 | 2.91 | 3.49 | 3.25 |
| 303 (The Invent.) | 3.22 | 3.73 | 3.51 | 3.12 | 3.66 | 3.42 |
| 304 (The Invent.) | 3.19 | 3.71 | 3.49 | 3.05 | 3.62 | 3.37 |
| 305 (The Invent.) | 3.20 | 3.72 | 3.49 | 3.08 | 3.64 | 3.40 |

It is clear that in comparison to samples 301 and 302, samples 303 to 305 of this invention showed little reduction of maximum color densities of the red, green and blue sensitive layers of the fresh materials even after standing under storage conditions of high temperature and high humidity.

While the invention has been described in detail and with reference to specific embodiments thereof, it will be apparent to one skilled in the art that various changes and modifications can be made therein without departing from the spirit and scope thereof.

What is claimed is:

1. A silver halide color photographic material comprising a support having thereon at least one light-sensitive silver halide emulsion layer, at least one layer of the material containing the combination of a water-insoluble homopolymer or copolymer which has an amido bond in the repeating unit and at least one compound represented by the formula (I):

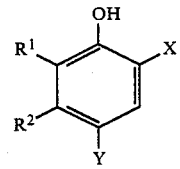

(I)

wherein X represents an alkyl group, an alkoxy group, an aryloxy group, an alkylthio group, an arylthio group, an amido group or a sulfonamido group; $R^1$ and $R^2$, which may be the same or different, each represents an alkyl group, an alkoxy group, an aryloxy group, an alkylthio group, an arylthio group, an amido group, a sulfonamido group, hydrogen, a halogen atom, a sulfo group, a carboxyl group, a carbamoyl group, a sulfamoyl group, an acyl group or a sulfonyl group, provided that $R^1$ and $R^2$ may be linked to form a carbocyclic ring; and Y represents a hydroxyl group or a sulfonamido group wherein the water-insoluble homopolymer or copolymer is represented by the formula (II):

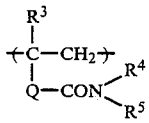

(II)

wherein $R^3$ represents hydrogen or an alkyl group; Q represents a single bond; $R^4$ and $R^5$, which may be the same or different, each represents hydrogen or an alkyl group; and $R^4$ and $R^5$ maybe linked to form a heterocyclic ring.

2. The silver halide color photographic material as claimed in claim 1, wherein X represents an alkyl group, an alkylthio group, an amido group or a sulfonamido group; $R^1$ and $R^2$ each represents hydrogen, a halogen atom, a sulfo group, an alkyl group, an alkylthio group or a sulfonyl group; and Y represents a hydroxyl group.

3. The silver halide color photographic material as claimed in claim 2, wherein X represents an alkyl group or an amido group; $R^1$ and $R^2$ each represents hydrogen, a halogen atom, an alkyl group or a sulfonyl group.

4. The silver halide color photographic material as claimed in claim 1, wherein said compound represented by formula (I) and said water-insoluble homopolymer or copolymer are present in a layer other than said light-sensitive silver halide emulsion layer, said compound represented by formula (I) being present in an amount of from $1.0\times10^{-2}$ to $1.0\times10^{31\ 5}$ mol/m$^2$ of said layer and said homopolymer or copolymer being present in an amount of from 10 g/m$^2$ to $1\times10^{-3}$ g/m$^2$.

5. The silver halide color photographic material as claimed in claim 1, wherein said compound represented by formula (I) and said water-insoluble homopolymer or copolymer are present in said light-sensitive silver halide emulsion layer, said compound represented by formula (I) being present in an amount of from $1.0\times10^{-4}$ to $1.0\times10^{-6}$ mol/m$^2$ of said layer and said homopolymer or copolymer being present in an amount of from 0.1 g/m$^2$ to $1\times10^{-4}$g/m$^2$.

6. The silver halide color photographic material as claimed in claim 1, wherein $R^3$ represents hydrogen or methyl; and at least one of $R^4$ and $R^5$ represents an alkyl group.

7. The silver halide color photographic material as claimed in claim 1, wherein said water-insoluble homopolymer or copolymer comprises at least 30% by weight of said monomer represented by formula (II).

8. The silver halide color photographic material as claimed in claim 7, wherein said water-insoluble homopolymer or copolymer comprises at least 60% by weight of said monomer represented by formula (II).

9. The silver halide color photographic material as claimed in claim 1, wherein the molecular weight of said homopolymer or copolymer is at most 500,000.

10. The silver halide color photographic material as claimed in claim 9, wherein the molecular weight of said homopolymer or copolymer is at most 80,000.

11. The silver halide color photographic material as claimed in claim 1, comprising at least one silver halide emulsion layer sensitive to red light; at least one silver halide emulsion layer sensitive to blue light; at least one silver halide emulsion layer sensitive to green light; and at least one intermediate layer between said light-sensitive layers comprising a dispersion of the combination of a water-insoluble homopolymer or copolymer which has an amido bond in the repeating unit and at least one compound represented by formula (I).

12. The silver halide color photographic material as claimed in claim 11, wherein said intermediate layer comprises from 0.1 to 10 mmol/m$^2$ of said compound represented by formula (I) and from 0.1 to 20 grams of said homopolymer or copolymer represented by formula (II) per gram of said compound represented by formula (I).

13. The silver halide color photographic material as claimed in claim 12, wherein said intermediate layer comprises from 0.3 to 5 mmol/m$^2$ of said compound represented by formula (I) and from 0.1 to 10 grams of said homopolymer or copolymer represented by formula (II) per gram of said compound represented by formula (I).

14. The silver halide color photographic material as claimed in claim 11, wherein said intermediate layer comprises from 0.001 to 0.1 mmol/m$^2$ of said compound represented by formula (I) and from 0.1 to 30 grams of said homopolymer or copolymer represented by formula (II) per gram of said compound represented by formula (I).

15. The silver halide color photographic material as claimed in claim 14, wherein said intermediate layer comprises from 0.003 to 0.005 mmol/m$^2$ of said compound represented by formula (I) and from 0.3 to 7 grams of said homopolymer or copolymer represented by formula (II) per gram of said compound represented by formula (I).

16. The silver halide color photographic material as claimed in claim 1, wherein the total number of carbon atoms contained in X, $R^1$, $R^2$ and Y is at least 10.

* * * * *